US010525488B2

(12) United States Patent
Cacka et al.

(10) Patent No.: US 10,525,488 B2
(45) Date of Patent: Jan. 7, 2020

(54) SHOWERHEAD WITH ENGINE RELEASE ASSEMBLY

(71) Applicant: Water Pik, Inc., Fort Collins, CO (US)

(72) Inventors: Joseph W. Cacka, Berthoud, CO (US); Leland C. Leber, Fort Collins, CO (US); Michael J. Quinn, Windsor, CO (US)

(73) Assignee: WATER PIK, INC., Fort Collins, CO (US)

( * ) Notice: Subject to any disclaimer, the term of this patent is extended or adjusted under 35 U.S.C. 154(b) by 0 days.

(21) Appl. No.: 15/937,719

(22) Filed: Mar. 27, 2018

(65) Prior Publication Data

US 2018/0214895 A1 Aug. 2, 2018

Related U.S. Application Data

(62) Division of application No. 15/208,158, filed on Jul. 12, 2016, which is a division of application No. (Continued)

(51) Int. Cl.
*B05B 17/04* (2006.01)
*B05B 1/18* (2006.01)
(Continued)

(52) U.S. Cl.
CPC ..... *B05B 1/185* (2013.01); *B05B 1/169* (2013.01); *B05B 1/1654* (2013.01);
(Continued)

(58) Field of Classification Search
CPC ..... B05B 1/185; B05B 1/1654; B05B 1/1663; B05B 1/169; B05B 1/18; B05B 3/04; B05B 15/654; E03C 1/0405; E03C 1/0409
(Continued)

(56) References Cited

U.S. PATENT DOCUMENTS 203,094 A 4/1878 Wakeman
204,333 A 5/1878 Josias
(Continued)

FOREIGN PATENT DOCUMENTS

CA 659510 3/1963
CA 2341041 8/1999
(Continued)

OTHER PUBLICATIONS

Author Unknown, "Flipside: The Bold Look of Kohler," 1 page, at least as early as Jun. 2011.
(Continued)

*Primary Examiner* — Davis D Hwu
(74) *Attorney, Agent, or Firm* — Dorsey & Whitney LLP

(57) ABSTRACT

The present disclosure is related to a showerhead. The showerhead includes a housing, an engine received within the housing, and an engine release assembly connected to the housing and the engine. The housing may define a chamber in fluid communication with a fluid source. The engine may be fluidly connected to the chamber. The engine may include a plurality of outlets in selective communication with the chamber. The engine release assembly may selectively secure and release the engine from the housing.

20 Claims, 32 Drawing Sheets

Related U.S. Application Data

14/304,495, filed on Jun. 13, 2014, now Pat. No. 9,404,243.

(60) Provisional application No. 61/834,816, filed on Jun. 13, 2013.

(51) Int. Cl.

| | |
|---|---|
| ***E03C 1/04*** | (2006.01) |
| ***B05B 1/16*** | (2006.01) |
| ***B05B 3/04*** | (2006.01) |
| ***B05B 1/30*** | (2006.01) |

(52) U.S. Cl.

CPC ..... *B05B 1/1663* (2013.01); *B05B 1/18* (2013.01); *B05B 1/3026* (2013.01); *B05B 3/04* (2013.01); *E03C 1/0405* (2013.01); *E03C 1/0409* (2013.01)

(58) Field of Classification Search

USPC ..... 239/600

See application file for complete search history.

(56) References Cited

U.S. PATENT DOCUMENTS

| | | | |
|---|---|---|---|
| 309,349 | A | 12/1884 | Hart |
| 428,023 | A | 5/1890 | Schoff |
| 432,712 | A | 7/1890 | Taylor |
| 445,250 | A | 1/1891 | Lawless |
| 453,109 | A | 5/1891 | Dreisorner |
| 486,986 | A | 11/1892 | Schinke |
| 566,384 | A | 8/1896 | Engelhart |
| 566,410 | A | 8/1896 | Schinke |
| 570,405 | A | 10/1896 | Jerguson et al. |
| 694,888 | A | 3/1902 | Pfluger |
| 800,802 | A | 10/1905 | Franquist |
| 832,523 | A | 10/1906 | Andersson |
| 835,678 | A | 11/1906 | Hammond |
| 845,540 | A | 2/1907 | Ferguson |
| 854,094 | A | 5/1907 | Klein |
| 926,929 | A | 7/1909 | Dusseau |
| 1,001,842 | A | 8/1911 | Greenfield |
| 1,003,037 | A | 9/1911 | Crowe |
| 1,018,143 | A | 2/1912 | Vissering |
| 1,046,573 | A | 12/1912 | Ellis |
| 1,130,520 | A | 3/1915 | Kenney |
| 1,203,466 | A | 10/1916 | Benson |
| 1,217,254 | A | 2/1917 | Winslow |
| 1,218,895 | A | 3/1917 | Porter |
| 1,255,577 | A | 2/1918 | Berry |
| 1,260,181 | A | 3/1918 | Garnero |
| 1,276,117 | A | 8/1918 | Riebe |
| 1,284,099 | A | 11/1918 | Harris |
| 1,327,428 | A | 1/1920 | Gregory |
| 1,451,800 | A | 4/1923 | Agner |
| 1,459,582 | A | 6/1923 | Dubee |
| 1,469,528 | A | 10/1923 | Owens |
| 1,500,921 | A | 7/1924 | Bramson et al. |
| 1,560,789 | A | 11/1925 | Johnson et al. |
| 1,597,477 | A | 8/1926 | Panhorst |
| 1,633,531 | A | 6/1927 | Keller |
| 1,669,949 | A | 5/1928 | Reynolds |
| 1,692,394 | A | 11/1928 | Sundh |
| 1,695,263 | A | 12/1928 | Jacques |
| 1,724,147 | A | 8/1929 | Russell |
| 1,724,161 | A | 8/1929 | Wuesthoff |
| 1,736,160 | A | 11/1929 | Jonsson |
| 1,754,127 | A | 4/1930 | Srulowitz |
| 1,758,115 | A | 5/1930 | Kelly |
| 1,778,658 | A | 10/1930 | Baker |
| 1,821,274 | A | 9/1931 | Plummer |
| 1,849,517 | A | 3/1932 | Fraser |
| 1,890,156 | A | 12/1932 | Konig |
| 1,906,575 | A | 5/1933 | Goeriz |
| 1,934,553 | A | 11/1933 | Mueller et al. |
| 1,946,207 | A | 2/1934 | Haire |
| 2,011,446 | A | 8/1935 | Judell |
| 2,024,930 | A | 12/1935 | Judell |
| 2,033,467 | A | 3/1936 | Groeniger |
| 2,044,445 | A | 6/1936 | Price et al. |
| 2,085,854 | A | 7/1937 | Hathaway et al. |
| 2,096,912 | A | 10/1937 | Morris |
| 2,117,152 | A | 5/1938 | Crosti |
| D113,439 | S | 2/1939 | Reinecke |
| 2,196,783 | A | 4/1940 | Shook |
| 2,197,667 | A | 4/1940 | Shook |
| 2,216,149 | A | 10/1940 | Weiss |
| D126,433 | S | 4/1941 | Enthof |
| 2,251,192 | A | 7/1941 | Krumsiek et al. |
| 2,268,263 | A | 12/1941 | Newell et al. |
| 2,285,831 | A | 6/1942 | Pennypacker |
| 2,342,757 | A | 2/1944 | Roser |
| 2,402,741 | A | 6/1946 | Draviner |
| D147,258 | S | 8/1947 | Becker |
| D152,584 | S | 2/1949 | Becker |
| 2,467,954 | A | 4/1949 | Becker |
| 2,518,709 | A | 8/1950 | Mosby, Jr. |
| 2,546,348 | A | 3/1951 | Schuman |
| 2,567,642 | A | 9/1951 | Penshaw |
| 2,581,129 | A | 1/1952 | Muldoon |
| D166,073 | S | 3/1952 | Dunkelberger |
| 2,648,762 | A | 8/1953 | Dunkelberger |
| 2,664,271 | A | 12/1953 | Arutunoff |
| 2,671,693 | A | 3/1954 | Hyser et al. |
| 2,676,806 | A | 4/1954 | Bachman |
| 2,679,575 | A | 5/1954 | Haberstump |
| 2,680,358 | A | 6/1954 | Zublin |
| 2,726,120 | A | 12/1955 | Bletcher et al. |
| 2,759,765 | A | 8/1956 | Pawley |
| 2,776,168 | A | 1/1957 | Schweda |
| 2,792,847 | A | 5/1957 | Spencer |
| 2,873,999 | A | 2/1959 | Webb |
| 2,930,505 | A | 3/1960 | Meyer |
| 2,931,672 | A | 4/1960 | Merritt et al. |
| 2,935,265 | A | 5/1960 | Richter |
| 2,949,242 | A | 8/1960 | Blumberg et al. |
| 2,957,587 | A | 10/1960 | Tobin |
| 2,966,311 | A | 12/1960 | Davis |
| D190,295 | S | 5/1961 | Becker |
| 2,992,437 | A | 7/1961 | Nelson et al. |
| 3,007,648 | A | 11/1961 | Fraser |
| D192,935 | S | 5/1962 | Becker |
| 3,032,357 | A | 5/1962 | Shames et al. |
| 3,034,809 | A | 5/1962 | Greenberg |
| 3,037,799 | A | 6/1962 | Mulac |
| 3,081,339 | A | 3/1963 | Green et al. |
| 3,092,333 | A | 6/1963 | Gaiotto |
| 3,098,508 | A | 7/1963 | Gerdes |
| 3,103,723 | A | 9/1963 | Becker |
| 3,104,815 | A | 9/1963 | Schultz |
| 3,104,827 | A | 9/1963 | Aghnides |
| 3,111,277 | A | 11/1963 | Grimsley |
| 3,112,073 | A | 11/1963 | Larson et al. |
| 3,143,857 | A | 8/1964 | Eaton |
| 3,196,463 | A | 7/1965 | Farneth |
| 3,231,200 | A | 1/1966 | Heald |
| 3,236,545 | A | 2/1966 | Parkes et al. |
| 3,239,152 | A | 3/1966 | Bachli et al. |
| 3,266,059 | A | 8/1966 | Stelle |
| 3,272,437 | A | 9/1966 | Coson |
| 3,273,359 | A | 9/1966 | Fregeolle |
| 3,306,634 | A | 2/1967 | Groves et al. |
| 3,323,148 | A | 6/1967 | Burnon |
| 3,329,967 | A | 7/1967 | Martinez et al. |
| 3,341,132 | A | 9/1967 | Parkison |
| 3,342,419 | A | 9/1967 | Weese |
| 3,344,994 | A | 10/1967 | Fife |
| 3,363,842 | A | 1/1968 | Burns |
| 3,383,051 | A | 5/1968 | Fiorentino |
| 3,389,925 | A | 6/1968 | Gottschald |
| 3,393,311 | A | 7/1968 | Dahl |
| 3,393,312 | A | 7/1968 | Dahl |
| 3,404,410 | A | 10/1968 | Sumida |

(56) References Cited

U.S. PATENT DOCUMENTS 3,492,029 A 1/1970 French et al.
3,516,611 A 6/1970 Piggott
3,546,961 A 12/1970 Marton
3,550,863 A 12/1970 McDermott
3,552,436 A 1/1971 Stewart
3,565,116 A 2/1971 Gabin
3,566,917 A 3/1971 White
3,580,513 A 5/1971 Martin
3,584,822 A 6/1971 Oram
3,596,835 A 8/1971 Smith et al.
3,612,577 A 10/1971 Pope
3,637,143 A 1/1972 Shames et al.
3,641,333 A 2/1972 Gendron
3,647,144 A 3/1972 Parkison et al.
3,663,044 A 5/1972 Contreras et al.
3,669,470 A 6/1972 Deurloo
3,672,648 A 6/1972 Price
3,682,392 A 8/1972 Kint
3,685,745 A 8/1972 Peschcke-koedt
D224,834 S 9/1972 Laudell
3,711,029 A 1/1973 Bartlett
3,722,798 A 3/1973 Bletcher et al.
3,722,799 A 3/1973 Rauh
3,731,084 A 5/1973 Trevorrow
3,754,779 A 8/1973 Peress
D228,622 S 10/1973 Juhlin
3,762,648 A 10/1973 Deines et al.
3,768,735 A 10/1973 Ward
3,786,995 A 1/1974 Manoogian et al.
3,801,019 A 4/1974 Trenary et al.
3,810,580 A 5/1974 Rauh
3,826,454 A 7/1974 Zieger
3,840,734 A 10/1974 Oram
3,845,291 A 10/1974 Portyrata
3,860,271 A 1/1975 Rodgers
3,861,719 A 1/1975 Hand
3,865,310 A 2/1975 Elkins et al.
3,869,151 A 3/1975 Fletcher et al.
3,887,136 A 6/1975 Anderson
3,896,845 A 7/1975 Parker
3,902,671 A 9/1975 Symmons
3,910,277 A 10/1975 Zimmer
D237,708 S 11/1975 Grohe
3,929,164 A 12/1975 Richter
3,929,287 A 12/1975 Givler et al.
3,958,756 A 5/1976 Trenary et al.
D240,322 S 6/1976 Staub
3,963,179 A 6/1976 Tomaro
3,967,783 A 7/1976 Halsted et al.
3,979,096 A 9/1976 Zieger
3,994,443 A 11/1976 Shenker
3,997,116 A 12/1976 Moen
3,998,390 A 12/1976 Peterson et al.
3,999,714 A 12/1976 Lang
4,005,880 A 2/1977 Anderson et al.
4,006,920 A 2/1977 Sadler et al.
4,023,782 A 5/1977 Eifer
4,042,984 A 8/1977 Butler
4,045,054 A 8/1977 Arnold
D245,858 S 9/1977 Grube
D245,860 S 9/1977 Grube
4,068,801 A 1/1978 Leutheuser
4,081,135 A 3/1978 Tomaro
4,084,271 A 4/1978 Ginsberg
4,091,998 A 5/1978 Peterson
D249,356 S 9/1978 Nagy
4,117,979 A 10/1978 Lagarelli et al.
4,129,257 A 12/1978 Eggert
4,130,120 A 12/1978 Kohler, Jr.
4,131,233 A 12/1978 Koenig
4,133,486 A 1/1979 Fanella
4,135,549 A 1/1979 Baker
D251,045 S 2/1979 Grube
4,141,502 A 2/1979 Grohe
4,151,955 A 5/1979 Stouffer
4,151,957 A 5/1979 Gecewicz et al.
4,162,801 A 7/1979 Kresky et al.
4,165,837 A 8/1979 Rundzaitis
4,167,196 A 9/1979 Morris
4,174,822 A 11/1979 Larsson
4,185,781 A 1/1980 O'Brien
4,190,207 A 2/1980 Fienhold et al.
4,191,332 A 3/1980 De Langis et al.
4,203,550 A 5/1980 On
4,209,132 A 6/1980 Kwan
D255,626 S 7/1980 Grube
4,219,160 A 8/1980 Allred, Jr.
4,221,338 A 9/1980 Shames et al.
4,239,409 A 12/1980 Osrwo
4,243,253 A 1/1981 Rogers, Jr.
4,244,526 A 1/1981 Arth
D258,677 S 3/1981 Larsson
4,254,914 A 3/1981 Shames et al.
4,258,414 A 3/1981 Sokol
4,272,022 A 6/1981 Evans
4,274,400 A 6/1981 Baus
4,275,843 A 6/1981 Moen
4,282,612 A 8/1981 King
D261,300 S 10/1981 Klose
D261,417 S 10/1981 Klose
4,303,201 A 12/1981 Elkins et al.
4,319,608 A 3/1982 Raikov et al.
4,324,364 A 4/1982 Buzzi et al.
4,330,089 A 5/1982 Finkbeiner
D266,212 S 9/1982 Haug et al.
4,350,298 A 9/1982 Tada
4,353,508 A 10/1982 Butterfield et al.
4,358,056 A 11/1982 Greenhut et al.
D267,582 S 1/1983 Mackay et al.
D268,359 S 3/1983 Klose
D268,442 S 3/1983 Darmon
D268,611 S 4/1983 Klose
4,383,554 A 5/1983 Merriman
4,396,797 A 8/1983 Sakuragi et al.
4,398,669 A 8/1983 Fienhold
4,425,965 A 1/1984 Bayh, III et al.
4,432,392 A 2/1984 Paley
D274,457 S 6/1984 Haug
4,461,052 A 7/1984 Mostul
4,465,308 A 8/1984 Martini
4,467,964 A 8/1984 Kaeser
4,495,550 A 1/1985 Visciano
4,527,745 A 7/1985 Butterfield et al.
4,540,202 A 9/1985 Amphoux et al.
4,545,081 A 10/1985 Nestor et al.
4,553,775 A 11/1985 Halling
D281,820 S 12/1985 Oba et al.
4,561,593 A 12/1985 Cammack et al.
4,564,889 A 1/1986 Bolson
4,571,003 A 2/1986 Roling et al.
4,572,232 A 2/1986 Gruber
D283,645 S 4/1986 Tanaka
4,587,991 A 5/1986 Chorkey
4,588,130 A 5/1986 Trenary et al.
4,598,866 A 7/1986 Cammack et al.
4,614,303 A 9/1986 Moseley, Jr. et al.
4,616,298 A 10/1986 Bolson
4,618,100 A 10/1986 White et al.
4,629,124 A 12/1986 Gruber
4,629,125 A 12/1986 Liu
4,643,463 A 2/1987 Halling et al.
4,645,244 A 2/1987 Curtis
RE32,386 E 3/1987 Hunter
4,650,120 A 3/1987 Kress
4,650,470 A 3/1987 Epstein
4,652,025 A 3/1987 Conroy, Sr.
4,654,900 A 4/1987 McGhee
4,657,185 A 4/1987 Rundzaitis
4,669,666 A 6/1987 Finkbeiner
4,669,757 A 6/1987 Bartholomew
4,674,687 A 6/1987 Smith et al.
4,683,917 A 8/1987 Bartholomew
4,703,893 A 11/1987 Gruber
4,717,180 A 1/1988 Roman

(56) References Cited

U.S. PATENT DOCUMENTS 4,719,654 A 1/1988 Blessing
4,733,337 A 3/1988 Bieberstein
D295,437 S 4/1988 Fabian
4,739,801 A 4/1988 Kimura et al.
4,749,126 A 6/1988 Kessener et al.
D296,582 S 7/1988 Haug et al.
4,754,928 A 7/1988 Rogers et al.
D297,160 S 8/1988 Robbins
4,764,047 A 8/1988 Johnston et al.
4,778,104 A 10/1988 Fisher
4,778,111 A 10/1988 Leap
4,787,591 A 11/1988 Villacorta
4,790,294 A 12/1988 Allred, III et al.
4,801,091 A 1/1989 Sandvik
4,809,369 A 3/1989 Bowden
4,839,599 A 6/1989 Fischer
4,841,590 A 6/1989 Terry
4,842,059 A 6/1989 Tomek
D302,325 S 7/1989 Charet et al.
4,850,616 A 7/1989 Pava
4,854,499 A 8/1989 Neuman
4,856,822 A 8/1989 Parker
4,865,362 A 9/1989 Holden
D303,830 S 10/1989 Ramsey et al.
4,871,196 A 10/1989 Kingsford
4,896,658 A 1/1990 Yonekubo et al.
D306,351 S 2/1990 Charet et al.
4,901,927 A 2/1990 Valdivia
4,903,178 A 2/1990 Englot et al.
4,903,897 A 2/1990 Hayes
4,903,922 A 2/1990 Harris, III
4,907,137 A 3/1990 Schladitz et al.
4,907,744 A 3/1990 Jousson
4,909,435 A 3/1990 Kidouchi et al.
4,914,759 A 4/1990 Goff
4,946,202 A 8/1990 Perricone
4,951,329 A 8/1990 Shaw
4,953,585 A 9/1990 Rollini et al.
4,964,573 A 10/1990 Lipski
4,972,048 A 11/1990 Martin
D313,267 S 12/1990 Lenci et al.
4,976,460 A 12/1990 Newcombe et al.
D314,246 S 1/1991 Bache
D315,191 S 3/1991 Mikol
4,998,673 A 3/1991 Pilolla
5,004,158 A 4/1991 Halem et al.
D317,348 S 6/1991 Geneve et al.
5,020,570 A 6/1991 Cotter
5,022,103 A 6/1991 Faist
D317,968 S 7/1991 Tsai
5,032,015 A 7/1991 Christianson
5,033,528 A 7/1991 Volcani
5,033,897 A 7/1991 Chen
D319,294 S 8/1991 Kohler, Jr. et al.
D320,064 S 9/1991 Presman
5,046,764 A 9/1991 Kimura et al.
D321,062 S 10/1991 Bonbright
5,058,804 A 10/1991 Yonekubo et al.
D322,119 S 12/1991 Haug et al.
D322,681 S 12/1991 Yuen
5,070,552 A 12/1991 Gentry et al.
D323,545 S 1/1992 Ward
5,082,019 A 1/1992 Tetrault
5,086,878 A 2/1992 Swift
5,090,624 A 2/1992 Rogers
5,100,055 A 3/1992 Rokitenetz et al.
D325,769 S 4/1992 Haug et al.
D325,770 S 4/1992 Haug et al.
5,103,384 A 4/1992 Drohan
D326,311 S 5/1992 Lenci et al.
D327,115 S 6/1992 Rogers
5,121,511 A 6/1992 Sakamoto et al.
D327,729 S 7/1992 Rogers
5,127,580 A 7/1992 Fu-I
5,134,251 A 7/1992 Martin
D328,944 S 8/1992 Robbins
5,141,016 A 8/1992 Nowicki
D329,504 S 9/1992 Yuen
5,143,300 A 9/1992 Cutler
5,145,114 A 9/1992 Monch
5,148,556 A 9/1992 Bottoms et al.
D330,068 S 10/1992 Haug et al.
D330,408 S 10/1992 Thacker
D330,409 S 10/1992 Raffo
5,153,976 A 10/1992 Benchaar et al.
5,154,355 A 10/1992 Gonzalez
5,154,483 A 10/1992 Zeller
5,161,567 A 11/1992 Humpert
5,163,752 A 11/1992 Copeland et al.
5,171,429 A 12/1992 Yasuo
5,172,860 A 12/1992 Yuch
5,172,862 A 12/1992 Heimann et al.
5,172,866 A 12/1992 Ward
D332,303 S 1/1993 Klose
D332,994 S 2/1993 Huen
D333,339 S 2/1993 Klose
5,197,767 A 3/1993 Kimura et al.
D334,794 S 4/1993 Klose
D335,171 S 4/1993 Lenci et al.
5,201,468 A 4/1993 Freier et al.
5,206,963 A 5/1993 Wiens
5,207,499 A 5/1993 Vajda et al.
5,213,267 A 5/1993 Heimann et al.
5,220,697 A 6/1993 Birchfield
D337,839 S 7/1993 Zeller
5,228,625 A 7/1993 Grassberger
5,230,106 A 7/1993 Henkin et al.
D338,542 S 8/1993 Yuen
5,232,162 A 8/1993 Chih
D339,492 S 9/1993 Klose
D339,627 S 9/1993 Klose
D339,848 S 9/1993 Gottwald
5,246,169 A 9/1993 Heimann et al.
5,246,301 A 9/1993 Hirasawa
D340,376 S 10/1993 Klose
5,253,670 A 10/1993 Perrott
5,253,807 A 10/1993 Newbegin
5,254,809 A 10/1993 Martin
D341,007 S 11/1993 Haug et al.
D341,191 S 11/1993 Klose
D341,220 S 11/1993 Eagan
5,263,646 A 11/1993 McCauley
5,265,833 A 11/1993 Heimann et al.
5,268,826 A 12/1993 Greene
5,276,596 A 1/1994 Krenzel
5,277,391 A 1/1994 Haug et al.
5,286,071 A 2/1994 Storage
5,288,110 A 2/1994 Allread
5,294,054 A 3/1994 Benedict et al.
5,297,735 A 3/1994 Heimann et al.
5,297,739 A 3/1994 Allen
D345,811 S 4/1994 Van Deursen et al.
D346,426 S 4/1994 Warshawsky
D346,428 S 4/1994 Warshawsky
D346,430 S 4/1994 Warshawsky
D347,262 S 5/1994 Black et al.
D347,265 S 5/1994 Gottwald
5,316,216 A 5/1994 Cammack et al.
D348,720 S 7/1994 Haug et al.
5,329,650 A 7/1994 Zaccai et al.
D349,947 S 8/1994 Hing-Wah
5,333,787 A 8/1994 Smith et al.
5,333,789 A 8/1994 Garneys
5,340,064 A 8/1994 Heimann et al.
5,340,165 A 8/1994 Sheppard
D350,808 S 9/1994 Warshawsky
5,344,080 A 9/1994 Matsui
5,349,987 A 9/1994 Shieh
5,356,076 A 10/1994 Bishop
5,356,077 A 10/1994 Shames
D352,092 S 11/1994 Warshawsky
D352,347 S 11/1994 Dannenberg
D352,766 S 11/1994 Hill et al.
5,368,235 A 11/1994 Drozdoff et al.

(56) References Cited

U.S. PATENT DOCUMENTS

| | | | |
|---|---|---|---|
| 5,369,556 | A | 11/1994 | Zeller |
| 5,370,427 | A | 12/1994 | Hoelle et al. |
| 5,385,500 | A | 1/1995 | Schmidt |
| D355,242 | S | 2/1995 | Warshawsky |
| D355,703 | S | 2/1995 | Duell |
| D356,626 | S | 3/1995 | Wang |
| 5,397,064 | A | 3/1995 | Heitzman |
| 5,398,872 | A | 3/1995 | Joubran |
| 5,398,977 | A | 3/1995 | Berger et al. |
| 5,402,812 | A | 4/1995 | Moineau et al. |
| 5,405,089 | A | 4/1995 | Heimann et al. |
| 5,414,879 | A | 5/1995 | Hiraishi et al. |
| 5,423,348 | A | 6/1995 | Jezek et al. |
| 5,433,384 | A | 7/1995 | Chan et al. |
| D361,399 | S | 8/1995 | Carbone et al. |
| D361,623 | S | 8/1995 | Huen |
| 5,441,075 | A | 8/1995 | Clare |
| 5,449,206 | A | 9/1995 | Lockwood |
| D363,360 | S | 10/1995 | Santarsiero |
| 5,454,809 | A | 10/1995 | Janssen |
| 5,468,057 | A | 11/1995 | Megerle et al. |
| D364,935 | S | 12/1995 | deBlois |
| D365,625 | S | 12/1995 | Bova |
| D365,646 | S | 12/1995 | deBlois |
| 5,476,225 | A | 12/1995 | Chan |
| D366,309 | S | 1/1996 | Huang |
| D366,707 | S | 1/1996 | Kaiser |
| D366,708 | S | 1/1996 | Santarsiero |
| D366,709 | S | 1/1996 | Szymanski |
| D366,710 | S | 1/1996 | Szymanski |
| 5,481,765 | A | 1/1996 | Wang |
| D366,948 | S | 2/1996 | Carbone |
| D367,315 | S | 2/1996 | Andrus |
| D367,333 | S | 2/1996 | Swyst |
| D367,696 | S | 3/1996 | Andrus |
| D367,934 | S | 3/1996 | Carbone |
| D368,146 | S | 3/1996 | Carbone |
| D368,317 | S | 3/1996 | Swyst |
| 5,499,767 | A | 3/1996 | Morand |
| D368,539 | S | 4/1996 | Carbone et al. |
| D368,540 | S | 4/1996 | Santarsiero |
| D368,541 | S | 4/1996 | Kaiser et al. |
| D368,542 | S | 4/1996 | deBlois et al. |
| D369,204 | S | 4/1996 | Andrus |
| D369,205 | S | 4/1996 | Andrus |
| 5,507,436 | A | 4/1996 | Ruttenberg |
| D369,873 | S | 5/1996 | deBlois et al. |
| D369,874 | S | 5/1996 | Santarsiero |
| D369,875 | S | 5/1996 | Carbone |
| D370,052 | S | 5/1996 | Chan et al. |
| D370,250 | S | 5/1996 | Fawcett et al. |
| D370,277 | S | 5/1996 | Kaiser |
| D370,278 | S | 5/1996 | Nolan |
| D370,279 | S | 5/1996 | deBlois |
| D370,280 | S | 5/1996 | Kaiser |
| D370,281 | S | 5/1996 | Johnstone et al. |
| 5,517,392 | A | 5/1996 | Rousso et al. |
| 5,521,803 | A | 5/1996 | Eckert et al. |
| D370,542 | S | 6/1996 | Santarsiero |
| D370,735 | S | 6/1996 | deBlois |
| D370,987 | S | 6/1996 | Santarsiero |
| D370,988 | S | 6/1996 | Santarsiero |
| D371,448 | S | 7/1996 | Santarsiero |
| D371,618 | S | 7/1996 | Nolan |
| D371,619 | S | 7/1996 | Szymanski |
| D371,856 | S | 7/1996 | Carbone |
| D372,318 | S | 7/1996 | Szymanski |
| D372,319 | S | 7/1996 | Carbone |
| 5,531,625 | A | 7/1996 | Zhong |
| 5,539,624 | A | 7/1996 | Dougherty |
| D372,548 | S | 8/1996 | Carbone |
| D372,998 | S | 8/1996 | Carbone |
| D373,210 | S | 8/1996 | Santarsiero |
| 5,547,132 | A | 8/1996 | Grogran |
| 5,547,374 | A | 8/1996 | Coleman |
| D373,434 | S | 9/1996 | Nolan |
| D373,435 | S | 9/1996 | Nolan |
| D373,645 | S | 9/1996 | Johnstone et al. |
| D373,646 | S | 9/1996 | Szymanski et al. |
| D373,647 | S | 9/1996 | Kaiser |
| D373,648 | S | 9/1996 | Kaiser |
| D373,649 | S | 9/1996 | Carbone |
| D373,651 | S | 9/1996 | Szymanski |
| D373,652 | S | 9/1996 | Kaiser |
| 5,551,637 | A | 9/1996 | Lo |
| 5,552,973 | A | 9/1996 | Hsu |
| 5,558,278 | A | 9/1996 | Gallorini |
| D374,271 | S | 10/1996 | Fleischmann |
| D374,297 | S | 10/1996 | Kaiser |
| D374,298 | S | 10/1996 | Swyst |
| D374,299 | S | 10/1996 | Carbone |
| D374,493 | S | 10/1996 | Szymanski |
| D374,494 | S | 10/1996 | Santarsiero |
| D374,732 | S | 10/1996 | Kaiser |
| D374,733 | S | 10/1996 | Santasiero |
| 5,560,548 | A | 10/1996 | Mueller et al. |
| 5,567,115 | A | 10/1996 | Carbone |
| D375,541 | S | 11/1996 | Michaluk |
| 5,577,664 | A | 11/1996 | Heitzman |
| D376,217 | S | 12/1996 | Kaiser |
| D376,860 | S | 12/1996 | Santarsiero |
| D376,861 | S | 12/1996 | Johnstone et al. |
| D376,862 | S | 12/1996 | Carbone |
| 5,605,173 | A | 2/1997 | Arnaud |
| D378,401 | S | 3/1997 | Neufeld et al. |
| 5,613,638 | A | 3/1997 | Blessing |
| 5,613,639 | A | 3/1997 | Storm et al. |
| 5,615,837 | A | 4/1997 | Roman |
| 5,624,074 | A | 4/1997 | Parisi |
| 5,624,498 | A | 4/1997 | Lee et al. |
| D379,212 | S | 5/1997 | Chan |
| D379,404 | S | 5/1997 | Spelts |
| 5,632,049 | A | 5/1997 | Chen |
| D381,405 | S | 7/1997 | Waidele et al. |
| D381,737 | S | 7/1997 | Chan |
| D382,936 | S | 8/1997 | Shfaram |
| 5,653,260 | A | 8/1997 | Huber |
| 5,667,146 | A | 9/1997 | Pimentel et al. |
| D385,332 | S | 10/1997 | Andrus |
| D385,333 | S | 10/1997 | Caroen et al. |
| D385,334 | S | 10/1997 | Caroen et al. |
| D385,616 | S | 10/1997 | Dow et al. |
| D385,947 | S | 11/1997 | Dow et al. |
| D387,230 | S | 12/1997 | von Buelow et al. |
| 5,697,557 | A | 12/1997 | Blessing et al. |
| 5,699,964 | A | 12/1997 | Bergmann et al. |
| 5,702,057 | A | 12/1997 | Huber |
| D389,558 | S | 1/1998 | Andrus |
| 5,704,080 | A | 1/1998 | Kuhne |
| 5,707,011 | A | 1/1998 | Bosio |
| 5,718,380 | A | 2/1998 | Schorn et al. |
| D392,369 | S | 3/1998 | Chan |
| 5,730,361 | A | 3/1998 | Thonnes |
| 5,730,362 | A | 3/1998 | Cordes |
| 5,730,363 | A | 3/1998 | Kress |
| 5,742,961 | A | 4/1998 | Casperson et al. |
| D394,490 | S | 5/1998 | Andrus et al. |
| 5,746,375 | A | 5/1998 | Guo |
| 5,749,552 | A | 5/1998 | Fan |
| 5,749,602 | A | 5/1998 | Delaney et al. |
| D394,899 | S | 6/1998 | Caroen et al. |
| D395,074 | S | 6/1998 | Neibrook et al. |
| D395,075 | S | 6/1998 | Kolada |
| D395,142 | S | 6/1998 | Neibrook |
| 5,764,760 | A | 6/1998 | Grandbert et al. |
| 5,765,760 | A | 6/1998 | Kuo |
| 5,769,802 | A | 6/1998 | Wang |
| 5,772,120 | A | 6/1998 | Huber |
| 5,778,939 | A | 7/1998 | Hok-Yin |
| 5,788,157 | A | 8/1998 | Kress |
| D398,370 | S | 9/1998 | Purdy |
| 5,806,771 | A | 9/1998 | Loschelder et al. |
| 5,819,791 | A | 10/1998 | Chronister et al. |
| 5,820,574 | A | 10/1998 | Henkin et al. |

(56) References Cited

U.S. PATENT DOCUMENTS

| | | | |
|---|---|---|---|
| 5,823,431 | A | 10/1998 | Pierce |
| 5,823,442 | A | 10/1998 | Guo |
| 5,826,803 | A | 10/1998 | Cooper |
| 5,833,138 | A | 11/1998 | Crane et al. |
| 5,839,666 | A | 11/1998 | Heimann et al. |
| D402,350 | S | 12/1998 | Andrus |
| D403,754 | S | 1/1999 | Gottwald |
| D404,116 | S | 1/1999 | Bosio |
| 5,855,348 | A | 1/1999 | Fornara |
| 5,860,599 | A | 1/1999 | Lin |
| 5,862,543 | A | 1/1999 | Reynoso et al. |
| 5,862,985 | A | 1/1999 | Neibrook et al. |
| D405,502 | S | 2/1999 | Tse |
| 5,865,375 | A | 2/1999 | Hsu |
| 5,865,378 | A | 2/1999 | Hollinshead et al. |
| 5,873,647 | A | 2/1999 | Kurtz et al. |
| D408,893 | S | 4/1999 | Tse |
| D409,276 | S | 5/1999 | Ratzlaff |
| D410,276 | S | 5/1999 | Ben-Tsur |
| 5,918,809 | A | 7/1999 | Simmons |
| 5,918,811 | A | 7/1999 | Denham et al. |
| D413,157 | S | 8/1999 | Ratzlaff |
| 5,937,905 | A | 8/1999 | Santos |
| 5,938,123 | A | 8/1999 | Heitzman |
| 5,941,462 | A | 8/1999 | Sandor |
| 5,947,388 | A | 9/1999 | Woodruff |
| D415,247 | S | 10/1999 | Haverstraw et al. |
| 5,961,046 | A | 10/1999 | Joubran |
| 5,967,417 | A | 10/1999 | Mantel |
| 5,979,776 | A | 11/1999 | Williams |
| 5,992,762 | A | 11/1999 | Wang |
| D418,200 | S | 12/1999 | Ben-Tsur |
| 5,997,047 | A | 12/1999 | Pimentel et al. |
| 6,003,165 | A | 12/1999 | Loyd |
| D418,902 | S | 1/2000 | Haverstraw et al. |
| D418,903 | S | 1/2000 | Haverstraw et al. |
| D418,904 | S | 1/2000 | Milrud |
| 6,016,975 | A | 1/2000 | Amaduzzi |
| D421,099 | S | 2/2000 | Mullenmeister |
| 6,021,960 | A | 2/2000 | Kehat |
| D422,053 | S | 3/2000 | Brenner et al. |
| 6,042,027 | A | 3/2000 | Sandvik |
| 6,042,155 | A | 3/2000 | Lockwood |
| D422,336 | S | 4/2000 | Haverstraw et al. |
| D422,337 | S | 4/2000 | Chan |
| D423,083 | S | 4/2000 | Haug et al. |
| D423,110 | S | 4/2000 | Cipkowski |
| D424,160 | S | 5/2000 | Haug et al. |
| D424,161 | S | 5/2000 | Haug et al. |
| D424,162 | S | 5/2000 | Haug et al. |
| D424,163 | S | 5/2000 | Haug et al. |
| D426,290 | S | 6/2000 | Haug et al. |
| 6,076,747 | A | 6/2000 | Ming-Yuan |
| D427,661 | S | 7/2000 | Haverstraw et al. |
| D428,110 | S | 7/2000 | Haug et al. |
| D428,125 | S | 7/2000 | Chan |
| 6,085,780 | A | 7/2000 | Morris |
| D430,267 | S | 8/2000 | Milrud et al. |
| 6,095,801 | A | 8/2000 | Spiewak |
| D430,643 | S | 9/2000 | Tse |
| 6,113,002 | A | 9/2000 | Finkbeiner |
| 6,123,272 | A | 9/2000 | Havican et al. |
| 6,123,308 | A | 9/2000 | Faisst |
| D432,624 | S | 10/2000 | Chan |
| D432,625 | S | 10/2000 | Chan |
| D433,096 | S | 10/2000 | Tse |
| D433,097 | S | 10/2000 | Tse |
| 6,126,091 | A | 10/2000 | Heitzman |
| 6,126,290 | A | 10/2000 | Veigel |
| D434,109 | S | 11/2000 | Ko |
| 6,164,569 | A | 12/2000 | Hollinshead et al. |
| 6,164,570 | A | 12/2000 | Smeltzer |
| D435,889 | S | 1/2001 | Ben-Tsur et al. |
| D439,305 | S | 3/2001 | Slothower |
| 6,199,580 | B1 | 3/2001 | Morris |
| 6,202,679 | B1 | 3/2001 | Titus |
| D440,276 | S | 4/2001 | Slothower |
| D440,277 | S | 4/2001 | Slothower |
| D440,278 | S | 4/2001 | Slothower |
| D441,059 | S | 4/2001 | Fleischmann |
| 6,209,799 | B1 | 4/2001 | Finkbeiner |
| D443,025 | S | 5/2001 | Kollmann et al. |
| D443,026 | S | 5/2001 | Kollmann et al. |
| D443,027 | S | 5/2001 | Kollmann et al. |
| D443,029 | S | 5/2001 | Kollmann et al. |
| 6,223,998 | B1 | 5/2001 | Heitzman |
| 6,230,984 | B1 | 5/2001 | Jager |
| 6,230,988 | B1 | 5/2001 | Chao et al. |
| 6,230,989 | B1 | 5/2001 | Haverstraw et al. |
| D443,335 | S | 6/2001 | Andrus |
| D443,336 | S | 6/2001 | Kollmann et al. |
| D443,347 | S | 6/2001 | Gottwald |
| 6,241,166 | B1 | 6/2001 | Overington et al. |
| 6,250,572 | B1 | 6/2001 | Chen |
| D444,846 | S | 7/2001 | Cross |
| D444,865 | S | 7/2001 | Gottwald |
| D445,871 | S | 7/2001 | Fan |
| 6,254,014 | B1 | 7/2001 | Clearman et al. |
| 6,270,278 | B1 | 8/2001 | Mauro |
| 6,276,004 | B1 | 8/2001 | Bertrand et al. |
| 6,283,447 | B1 | 9/2001 | Fleet |
| 6,286,764 | B1 | 9/2001 | Garvey et al. |
| D449,673 | S | 10/2001 | Kollmann et al. |
| D450,370 | S | 11/2001 | Wales et al. |
| D450,805 | S | 11/2001 | Lindholm et al. |
| D450,806 | S | 11/2001 | Lindholm et al. |
| D450,807 | S | 11/2001 | Lindholm et al. |
| D451,169 | S | 11/2001 | Lindholm et al. |
| D451,170 | S | 11/2001 | Lindholm et al. |
| D451,171 | S | 11/2001 | Lindholm et al. |
| D451,172 | S | 11/2001 | Lindholm et al. |
| 6,321,777 | B1 | 11/2001 | Wu |
| 6,322,006 | B1 | 11/2001 | Guo |
| D451,583 | S | 12/2001 | Lindholm et al. |
| D451,980 | S | 12/2001 | Lindholm et al. |
| D452,553 | S | 12/2001 | Lindholm et al. |
| D452,725 | S | 1/2002 | Lindholm et al. |
| D452,897 | S | 1/2002 | Gillette et al. |
| 6,336,764 | B1 | 1/2002 | Liu |
| 6,338,170 | B1 | 1/2002 | De Simone |
| 6,341,737 | B1 | 1/2002 | Chang |
| D453,369 | S | 2/2002 | Lobermeier |
| D453,370 | S | 2/2002 | Lindholm et al. |
| D453,551 | S | 2/2002 | Lindholm et al. |
| 6,349,735 | B2 | 2/2002 | Gul |
| D454,617 | S | 3/2002 | Curbbun et al. |
| D454,938 | S | 3/2002 | Lord |
| 6,375,342 | B1 | 4/2002 | Koren et al. |
| D457,937 | S | 5/2002 | Lindholm et al. |
| 6,382,531 | B1 | 5/2002 | Tracy |
| D458,348 | S | 6/2002 | Mullenmeister |
| 6,412,711 | B1 | 7/2002 | Fan |
| D461,224 | S | 8/2002 | Lobermeier |
| D461,878 | S | 8/2002 | Green et al. |
| 6,450,425 | B1 | 9/2002 | Chen |
| 6,454,186 | B2 | 9/2002 | Haverstraw et al. |
| 6,463,658 | B1 | 10/2002 | Larsson |
| 6,464,265 | B1 | 10/2002 | Mikol |
| D465,552 | S | 11/2002 | Tse |
| D465,553 | S | 11/2002 | Singtoroj |
| 6,484,952 | B2 | 11/2002 | Koren |
| D468,800 | S | 1/2003 | Tse |
| D469,165 | S | 1/2003 | Lim |
| 6,502,796 | B1 | 1/2003 | Wales |
| 6,508,415 | B2 | 1/2003 | Wang |
| 6,511,001 | B1 | 1/2003 | Huang |
| D470,219 | S | 2/2003 | Schweitzer |
| 6,516,070 | B2 | 2/2003 | Macey |
| D471,253 | S | 3/2003 | Tse |
| D471,953 | S | 3/2003 | Colligan et al. |
| 6,533,194 | B2 | 3/2003 | Marsh et al. |
| 6,537,455 | B2 | 3/2003 | Farley |
| D472,958 | S | 4/2003 | Ouyoung |
| 6,550,697 | B2 | 4/2003 | Lai |

(56) References Cited

U.S. PATENT DOCUMENTS

| | | | |
|---|---|---|---|
| 6,585,174 | B1 | 7/2003 | Huang |
| 6,595,439 | B1 | 7/2003 | Chen |
| 6,607,148 | B1 | 8/2003 | Marsh et al. |
| 6,611,971 | B1 | 9/2003 | Antoniello et al. |
| 6,637,676 | B2 | 10/2003 | Zieger et al. |
| 6,641,057 | B2 | 11/2003 | Thomas et al. |
| D483,837 | S | 12/2003 | Fan |
| 6,659,117 | B2 | 12/2003 | Gilmore |
| 6,659,372 | B2 | 12/2003 | Marsh et al. |
| D485,887 | S | 1/2004 | Luettgen et al. |
| D486,888 | S | 2/2004 | Lobermeier |
| 6,691,338 | B2 | 2/2004 | Zieger |
| 6,691,933 | B1 | 2/2004 | Bosio |
| D487,301 | S | 3/2004 | Haug et al. |
| D487,498 | S | 3/2004 | Blomstrom |
| 6,701,953 | B2 | 3/2004 | Agosta |
| 6,715,699 | B1 | 4/2004 | Greenberg et al. |
| 6,719,218 | B2 | 4/2004 | Cool et al. |
| D489,798 | S | 5/2004 | Hunt |
| D490,498 | S | 5/2004 | Golichowski |
| 6,736,336 | B2 | 5/2004 | Wong |
| 6,739,523 | B2 | 5/2004 | Haverstraw et al. |
| 6,739,527 | B1 | 5/2004 | Chung |
| D492,004 | S | 6/2004 | Haug et al. |
| D492,007 | S | 6/2004 | Kollmann et al. |
| 6,742,725 | B1 | 6/2004 | Fan |
| D493,208 | S | 7/2004 | Lin |
| D493,864 | S | 8/2004 | Haug et al. |
| D494,655 | S | 8/2004 | Lin |
| D494,661 | S | 8/2004 | Zieger et al. |
| D495,027 | S | 8/2004 | Mazzola |
| 6,776,357 | B1 | 8/2004 | Naito |
| 6,789,751 | B1 | 9/2004 | Fan |
| D496,987 | S | 10/2004 | Glunk |
| D497,974 | S | 11/2004 | Haug et al. |
| D498,514 | S | 11/2004 | Haug et al. |
| D500,121 | S | 12/2004 | Blomstrom |
| 6,827,039 | B1 | 12/2004 | Nelson |
| D500,549 | S | 1/2005 | Blomstrom |
| D501,242 | S | 1/2005 | Blomstrom |
| D502,760 | S | 3/2005 | Zieger et al. |
| D502,761 | S | 3/2005 | Zieger et al. |
| D503,211 | S | 3/2005 | Lin |
| D503,463 | S | 3/2005 | Hughes et al. |
| 6,863,227 | B2 | 3/2005 | Wollenberg et al. |
| 6,869,030 | B2 | 3/2005 | Blessing et al. |
| D503,774 | S | 4/2005 | Zieger |
| D503,775 | S | 4/2005 | Zieger |
| D503,966 | S | 4/2005 | Zieger |
| 6,899,292 | B2 | 5/2005 | Titinet |
| D506,243 | S | 6/2005 | Wu |
| D507,037 | S | 7/2005 | Wu |
| 6,935,581 | B2 | 8/2005 | Titinet |
| D509,280 | S | 9/2005 | Bailey et al. |
| D509,563 | S | 9/2005 | Bailey et al. |
| D510,123 | S | 9/2005 | Tsai |
| D511,809 | S | 11/2005 | Haug et al. |
| D512,119 | S | 11/2005 | Haug et al. |
| 6,981,661 | B1 | 1/2006 | Chen |
| D516,169 | S | 2/2006 | Wu |
| 7,000,854 | B2 | 2/2006 | Malek et al. |
| 7,004,409 | B2 | 2/2006 | Okubo |
| 7,004,410 | B2 | 2/2006 | Li |
| D520,109 | S | 5/2006 | Wu |
| 7,040,554 | B2 | 5/2006 | Drennow |
| 7,048,210 | B2 | 5/2006 | Clark |
| 7,055,767 | B1 | 6/2006 | Ko |
| D525,341 | S | 7/2006 | Bossini |
| 7,070,125 | B2 | 7/2006 | Williams et al. |
| 7,077,342 | B2 | 7/2006 | Lee |
| D527,440 | S | 8/2006 | Macan |
| 7,093,780 | B1 | 8/2006 | Chung |
| 7,097,122 | B1 | 8/2006 | Farley |
| D527,790 | S | 9/2006 | Hughes et al. |
| D528,631 | S | 9/2006 | Gillette et al. |
| 7,100,845 | B1 | 9/2006 | Hsieh |
| 7,111,795 | B2 | 9/2006 | Thong |
| 7,111,798 | B2 | 9/2006 | Thomas et al. |
| D530,389 | S | 10/2006 | Glenslak et al. |
| D530,392 | S | 10/2006 | Tse |
| D531,259 | S | 10/2006 | Hsieh |
| 7,114,666 | B2 | 10/2006 | Luettgen et al. |
| D533,253 | S | 12/2006 | Luettgen et al. |
| D534,239 | S | 12/2006 | Dingler et al. |
| D535,354 | S | 1/2007 | Wu |
| D536,060 | S | 1/2007 | Sadler |
| 7,156,325 | B1 | 1/2007 | Chen |
| 7,182,043 | B1 | 2/2007 | Nelson |
| D538,391 | S | 3/2007 | Mazzola |
| D540,424 | S | 4/2007 | Kirar |
| D540,425 | S | 4/2007 | Endo et al. |
| D540,426 | S | 4/2007 | Cropelli |
| D540,427 | S | 4/2007 | Bouroullec et al. |
| D542,391 | S | 5/2007 | Gilbert |
| D542,393 | S | 5/2007 | Haug et al. |
| D544,573 | S | 6/2007 | Dingler et al. |
| 7,229,031 | B2 | 6/2007 | Schmidt |
| 7,243,863 | B2 | 7/2007 | Glunk |
| 7,246,760 | B2 | 7/2007 | Marty et al. |
| D552,713 | S | 10/2007 | Rexach |
| 7,278,591 | B2 | 10/2007 | Clearman et al. |
| D556,295 | S | 11/2007 | Genord et al. |
| 7,299,510 | B2 | 11/2007 | Tsai |
| D557,763 | S | 12/2007 | Schonherr et al. |
| D557,764 | S | 12/2007 | Schonherr et al. |
| D557,765 | S | 12/2007 | Schonherr et al. |
| D558,301 | S | 12/2007 | Hoernig |
| 7,303,151 | B2 | 12/2007 | Wu |
| D559,357 | S | 1/2008 | Wang et al. |
| D559,945 | S | 1/2008 | Patterson et al. |
| D560,269 | S | 1/2008 | Tse |
| D562,937 | S | 2/2008 | Schonherr et al. |
| D562,938 | S | 2/2008 | Blessing |
| D562,941 | S | 2/2008 | Pan |
| 7,331,536 | B1 | 2/2008 | Zhen et al. |
| 7,347,388 | B2 | 3/2008 | Chung |
| D565,699 | S | 4/2008 | Berberet |
| D565,702 | S | 4/2008 | Daunter et al. |
| D565,703 | S | 4/2008 | Lammel et al. |
| D566,228 | S | 4/2008 | Neagoe |
| D566,229 | S | 4/2008 | Rexach |
| D567,328 | S | 4/2008 | Spangler et al. |
| D567,335 | S | 4/2008 | Huang |
| 7,360,723 | B2 | 4/2008 | Lev |
| 7,364,097 | B2 | 4/2008 | Okuma |
| 7,374,112 | B1 | 5/2008 | Bulan et al. |
| 7,384,007 | B2 | 6/2008 | Ho |
| D577,099 | S | 9/2008 | Leber |
| D577,793 | S | 9/2008 | Leber |
| D578,604 | S | 10/2008 | Wu et al. |
| D578,605 | S | 10/2008 | Wu et al. |
| D578,608 | S | 10/2008 | Wu et al. |
| D580,012 | S | 11/2008 | Quinn et al. |
| D580,513 | S | 11/2008 | Quinn et al. |
| D581,013 | S | 11/2008 | Citterio |
| D581,014 | S | 11/2008 | Quinn et al. |
| D586,426 | S | 2/2009 | Schoenherr et al. |
| 7,503,345 | B2 | 3/2009 | Paterson et al. |
| D590,048 | S | 4/2009 | Leber et al. |
| 7,520,448 | B2 | 4/2009 | Luettgen et al. |
| D592,276 | S | 5/2009 | Shoenherr et al. |
| D592,278 | S | 5/2009 | Leber |
| 7,537,175 | B2 | 5/2009 | Miura et al. |
| D600,777 | S | 9/2009 | Whitaker et al. |
| D603,935 | S | 11/2009 | Leber |
| 7,617,990 | B2 | 11/2009 | Huffman |
| D605,731 | S | 12/2009 | Leber |
| D606,623 | S | 12/2009 | Whitaker et al. |
| D606,626 | S | 12/2009 | Zore |
| D608,412 | S | 1/2010 | Barnard et al. |
| D608,413 | S | 1/2010 | Barnard et al. |
| D616,061 | S | 5/2010 | Whitaker et al. |
| 7,721,979 | B2 | 5/2010 | Mazzola |
| D617,419 | S | 6/2010 | Lee |

(56) References Cited

U.S. PATENT DOCUMENTS

| | | | | |
|---|---|---|---|---|
| D617,873 | S | 6/2010 | Lee | |
| 7,740,186 | B2 | 6/2010 | Macan et al. | |
| D621,904 | S | 8/2010 | Yoo et al. | |
| D621,905 | S | 8/2010 | Yoo et al. | |
| 7,766,260 | B2 * | 8/2010 | Lin | B05B 1/18 239/389 |
| 7,770,820 | B2 | 8/2010 | Clearman et al. | |
| 7,770,822 | B2 | 8/2010 | Leber | |
| D624,156 | S | 9/2010 | Leber | |
| 7,789,326 | B2 | 9/2010 | Luettgen et al. | |
| D625,776 | S | 10/2010 | Williams | |
| 7,832,662 | B2 | 11/2010 | Gallo | |
| D628,676 | S | 12/2010 | Lee | |
| D629,867 | S | 12/2010 | Rexach et al. | |
| 7,871,020 | B2 | 1/2011 | Nelson et al. | |
| D641,830 | S | 7/2011 | Alexander | |
| D641,831 | S | 7/2011 | Williams | |
| 8,020,787 | B2 | 9/2011 | Leber | |
| 8,020,788 | B2 | 9/2011 | Luettgen et al. | |
| 8,028,935 | B2 | 10/2011 | Leber | |
| D652,108 | S | 1/2012 | Eads | |
| D652,110 | S | 1/2012 | Nichols | |
| D652,114 | S | 1/2012 | Yoo | |
| D652,894 | S | 1/2012 | Nichols | |
| 8,109,450 | B2 | 2/2012 | Luettgen et al. | |
| D656,582 | S | 3/2012 | Flowers et al. | |
| 8,132,745 | B2 | 3/2012 | Leber et al. | |
| 8,146,838 | B2 | 4/2012 | Luettgen et al. | |
| 8,220,726 | B2 | 7/2012 | Qui et al. | |
| D667,531 | S | 9/2012 | Romero et al. | |
| D669,158 | S | 10/2012 | Flowers et al. | |
| 8,292,200 | B2 | 10/2012 | Macan et al. | |
| 8,297,534 | B2 | 10/2012 | Li et al. | |
| D672,433 | S | 12/2012 | Yoo et al. | |
| D673,649 | S | 1/2013 | Quinn et al. | |
| D674,047 | S | 1/2013 | Yoo et al. | |
| D674,050 | S | 1/2013 | Quinn et al. | |
| 8,348,181 | B2 | 1/2013 | Whitaker | |
| 8,360,346 | B2 | 1/2013 | Furseth | |
| 8,366,024 | B2 | 2/2013 | Leber | |
| D678,463 | S | 3/2013 | Quinn et al. | |
| D678,467 | S | 3/2013 | Quinn et al. | |
| 8,511,587 | B2 * | 8/2013 | Miller | B05B 1/185 239/548 |
| 8,640,973 | B2 | 2/2014 | Gansebom | |
| D737,931 | S | 9/2015 | Schoenherr | |
| D744,612 | S | 12/2015 | Peterson | |
| 9,295,997 | B2 | 3/2016 | Harwanko et al. | |
| D755,346 | S | 5/2016 | Yan | |
| 9,387,493 | B2 | 7/2016 | Lev | |
| 9,399,860 | B2 | 7/2016 | Lev | |
| 2001/0042797 | A1 | 11/2001 | Shrigley | |
| 2002/0109023 | A1 | 8/2002 | Thomas et al. | |
| 2003/0042332 | A1 | 3/2003 | Lai | |
| 2003/0062426 | A1 | 4/2003 | Gregory et al. | |
| 2003/0121993 | A1 | 7/2003 | Haverstraw et al. | |
| 2004/0074993 | A1 | 4/2004 | Thomas et al. | |
| 2004/0118949 | A1 | 6/2004 | Marks | |
| 2004/0217209 | A1 | 11/2004 | Bui | |
| 2004/0244105 | A1 | 12/2004 | Tsai | |
| 2005/0001072 | A1 | 1/2005 | Bolus et al. | |
| 2005/0284967 | A1 * | 12/2005 | Korb | B05B 1/18 239/552 |
| 2006/0016908 | A1 | 1/2006 | Chung | |
| 2006/0016913 | A1 | 1/2006 | Lo | |
| 2006/0102747 | A1 | 5/2006 | Ho | |
| 2006/0163391 | A1 | 7/2006 | Schorn | |
| 2006/0219822 | A1 | 10/2006 | Miller et al. | |
| 2006/0272086 | A1 | 12/2006 | Mesa | |
| 2007/0040054 | A1 | 2/2007 | Farzan | |
| 2007/0200013 | A1 | 8/2007 | Hsiao | |
| 2007/0246577 | A1 | 10/2007 | Leber | |
| 2007/0252021 | A1 | 11/2007 | Cristina | |
| 2007/0272770 | A1 | 11/2007 | Leber et al. | |
| 2008/0073449 | A1 | 3/2008 | Haynes et al. | |
| 2008/0083844 | A1 | 4/2008 | Leber et al. | |
| 2008/0121293 | A1 | 5/2008 | Leber et al. | |
| 2008/0156897 | A1 | 7/2008 | Leber | |
| 2008/0223957 | A1 | 9/2008 | Schorn | |
| 2008/0272591 | A1 | 11/2008 | Leber | |
| 2009/0039181 | A1 | 2/2009 | Auer, Jr. | |
| 2009/0200404 | A1 | 8/2009 | Cristina | |
| 2009/0218420 | A1 | 9/2009 | Mazzola | |
| 2009/0307836 | A1 | 12/2009 | Blattner et al. | |
| 2010/0038454 | A1 | 2/2010 | Shieh | |
| 2010/0127096 | A1 | 5/2010 | Leber | |
| 2011/0000983 | A1 | 1/2011 | Chang | |
| 2011/0011953 | A1 | 1/2011 | Macan et al. | |
| 2011/0073678 | A1 | 3/2011 | Qiu et al. | |
| 2011/0114753 | A1 | 5/2011 | Li et al. | |
| 2011/0121098 | A1 | 5/2011 | Luettgen et al. | |
| 2012/0048968 | A1 | 3/2012 | Williams | |
| 2012/0222207 | A1 | 9/2012 | Slothower et al. | |
| 2013/0126646 | A1 | 5/2013 | Wu | |
| 2013/0147186 | A1 | 6/2013 | Leber | |
| 2014/0252138 | A1 | 9/2014 | Wischstadt et al. | |
| 2014/0367482 | A1 | 12/2014 | Cacka | |
| 2015/0165452 | A1 | 6/2015 | Luettgen et al. | |
| 2015/0211728 | A1 | 12/2015 | Zhadanov | |
| 2016/0015000 | A1 | 1/2016 | Diez | |

FOREIGN PATENT DOCUMENTS

| | | | |
|---|---|---|---|
| CH | 234284 | | 3/1963 |
| CN | 201260999 | Y | 6/2009 |
| CN | 200920182881 | | 9/2009 |
| CN | 101628263 | A | 1/2010 |
| CN | 101773880 | A | 7/2010 |
| CN | 201940296 | U | 8/2011 |
| CN | 201230021930 | | 2/2012 |
| CN | 202516711 | U | 11/2012 |
| DE | 352813 | | 5/1922 |
| DE | 848627 | | 9/1952 |
| DE | 854100 | | 10/1952 |
| DE | 2360534 | | 6/1974 |
| DE | 2806093 | | 8/1979 |
| DE | 3107808 | | 9/1982 |
| DE | 3246327 | | 6/1984 |
| DE | 3440901 | | 7/1985 |
| DE | 3706320 | | 3/1988 |
| DE | 8804236 | | 6/1988 |
| DE | 4034695 | | 5/1991 |
| DE | 19608085 | | 9/1996 |
| DE | 20012539 | U1 | 10/2000 |
| DE | 10034818 | A1 | 1/2002 |
| DE | 202005000881 | | 3/2005 |
| DE | 102006032017 | | 1/2008 |
| DE | 202008009530 | | 9/2008 |
| DE | 202013101201 | | 3/2013 |
| EP | 0167063 | | 6/1985 |
| EP | 0478999 | | 4/1992 |
| EP | 0514753 | | 11/1992 |
| EP | 0435030 | | 7/1993 |
| EP | 0617644 | | 10/1994 |
| EP | 0683354 | | 11/1995 |
| EP | 0687851 | | 12/1995 |
| EP | 0695907 | | 2/1996 |
| EP | 0700729 | | 3/1996 |
| EP | 0719588 | | 7/1996 |
| EP | 0721082 | | 7/1996 |
| EP | 0733747 | | 9/1996 |
| EP | 0808661 | | 11/1997 |
| EP | 0726811 | | 1/1998 |
| EP | 2164642 | | 10/2010 |
| EP | 2260945 | | 12/2010 |
| FR | 538538 | | 6/1922 |
| FR | 873808 | | 7/1942 |
| FR | 1039750 | | 10/1953 |
| FR | 1098836 | | 8/1955 |
| FR | 2591099 | | 6/1987 |
| FR | 2596492 | | 10/1987 |
| FR | 2695452 | | 3/1994 |
| GB | 10086 | | 4/1894 |
| GB | 3314 | | 12/1914 |

(56) References Cited

FOREIGN PATENT DOCUMENTS

| | | | |
|---|---|---|---|
| GB | 129812 | | 7/1919 |
| GB | 204600 | | 10/1923 |
| GB | 634483 | | 3/1950 |
| GB | 971866 | | 10/1964 |
| GB | 1111126 | | 4/1968 |
| GB | 2066074 | | 1/1980 |
| GB | 2066704 | | 7/1981 |
| GB | 2068778 | | 8/1981 |
| GB | 2121319 | | 12/1983 |
| GB | 2155984 | | 10/1985 |
| GB | 2156932 | A | 10/1985 |
| GB | 2199771 | | 7/1988 |
| GB | 2298595 | | 11/1996 |
| GB | 2337471 | | 11/1999 |
| IT | 327400 | | 7/1935 |
| IT | 350359 | | 7/1937 |
| IT | 563459 | | 5/1957 |
| JP | S63-181459 | | 11/1988 |
| JP | H2-78660 | | 6/1990 |
| JP | 4062238 | | 2/1992 |
| JP | 4146708 | | 5/1992 |
| JP | 2004278194 | | 10/2004 |
| NL | 8902957 | | 6/1991 |
| WO | WO93/12894 | | 7/1993 |
| WO | WO93/25839 | | 12/1993 |
| WO | WO96/00617 | | 1/1996 |
| WO | WO98/30336 | | 7/1998 |
| WO | WO99/59726 | | 11/1999 |
| WO | WO00/10720 | | 3/2000 |
| WO | WO08/082699 | | 7/2008 |
| WO | WO10/04593 | | 1/2010 |

OTHER PUBLICATIONS

Color Copy, Labeled 1A, Gemlo, available at least as early as Dec. 2, 1998.

Color Copy, Labeled 1B, Gemlo, available at least as early as Dec. 2, 1998.

International Search Report, PCT/US07/88962, 9 pages, dated Jun. 10, 2008.

International Search Report, PCT/US07/67141, 8 pages, dated Jul. 2, 2008.

EZ Wash Wand, accessed at least as early as Feb. 2016, http://www.ezwashwand.com.

WashWands, accessed at least as early as Feb. 2016, http://www.washwand.com.

Woof Washer, accessed at least as early as Feb. 2016, http://www.woofwasher.com.

* cited by examiner

SHOWERHEAD WITH ENGINE RELEASE ASSEMBLY

CROSS REFERENCE TO RELATED APPLICATIONS

The present application is a divisional application of U.S. Nonprovisional patent application Ser. No. 15/208,158, filed on Jul. 12, 2016 which is a divisional application of U.S. Nonprovisional patent application Ser. No. 14/304,495, filed on Jun. 13, 2017, now U.S. Pat. No. 9,404,243 B2, issued on Aug. 2, 2016 which claims priority under 35 U.S.C. § 119(e) to U.S. Provisional Patent Application No. 61/834,816, filed on Jun. 13, 2013 the disclosures of which are incorporated by reference herein in their entireties.

TECHNICAL FIELD

The technology disclosed herein relates generally to showerheads, and more specifically to pulsating showerheads.

BACKGROUND

Showers provide an alternative to bathing in a bathtub. Generally, showerheads are used to direct water from the home water supply onto a user for personal hygiene purposes.

In the past, bathing was the overwhelmingly popular choice for personal cleansing. However, in recent years showers have become increasingly popular for several reasons. First, showers generally take less time than baths. Second, showers generally use significantly less water than baths. Third, shower stalls and bathtubs with showerheads are typically easier to maintain. Fourth, showers tend to cause less soap scum build-up. Fifth, by showering, a bather does not sit in dirty water—the dirty water is constantly rinsed away.

With the increase in popularity of showers has come an increase in showerhead designs and showerhead manufacturers. Many showerheads emit pulsating streams of water in a so-called "massage" mode. Other showerheads are referred to as "drenching" showerheads, since they have relatively large faceplates and emit water in a steady, soft spray pattern.

The information included in this Background section of the specification, including any references cited herein and any description or discussion thereof, is included for technical reference purposes only and is not to be regarded subject matter by which the scope of the invention is to be bound.

SUMMARY

A showerhead per the disclosure herein has a water-powered turbine, a cam, and a shutter. The shutter is connected to the turbine and the cam so as to oscillate across groups of nozzle outlet holes in a massaging showerhead.

Another embodiment includes an apparatus including a turbine attached to a cam, where the turbine is operatively connected to two or more shutters through links. Movement of the turbine causes the shutters to oscillate across groups of nozzle outlet holes.

Yet another embodiment includes a showerhead including a housing defining a chamber in fluid communication with a fluid inlet such as a water source, a first bank of nozzles, and a second bank of nozzles. The showerhead also includes a massage mode assembly that is at least partially received within the chamber. The massage mode assembly includes a turbine, a cam connected to or formed integrally with the turbine, and a shutter connected to the cam. With the structure of the massage mode assembly, the movement of the shutter is restricted along a single axis such that as the turbine rotates, the cam causes the shutter to alternatingly fluidly connect and disconnect the first bank of nozzles and the second bank of nozzles from the fluid inlet.

Another embodiment of the present disclosure includes a method for producing a massaging spray mode for a showerhead. The method includes fluidly connecting a first plurality of nozzles to a fluid source, where each of the nozzles within the first plurality of nozzles are opened substantially simultaneously and fluidly disconnecting the first plurality of nozzles form the fluid source, where each of the nozzles in the first plurality of nozzles are closed substantially simultaneously.

Yet another embodiment of the present disclosure includes a showerhead having a spray head, an engine, and a face plate. The engine is fluidly connected to a water source and is received within the spray head. The engine may include a massage mode assembly that has a turbine and a shoe connected to the turbine, where the movement of the shoe is restricted to a single axis. As the turbine rotates, the shoe alternating fluidly connects and disconnects a first set of nozzle apertures and a second set of nozzle apertures, where each nozzle within the specific set is open and closed at substantially the same time. Additionally, the face plate is connected to the engine and is configured to selectively rotate the engine, in order to vary the spray characteristics of the showerhead.

Other embodiments include a method of assembling a showerhead. The method includes connecting together two or more flow directing plates to create an engine for the showerhead, placing the engine with a spray head a number of degrees out of phase from an operational orientation, rotating the engine the number of degrees into the operational direction, and connecting the engine to the spray head by a fastener received through a back wall of the spray head.

Another embodiment includes a showerhead having a housing defining a chamber in fluid communication with a fluid source, an engine received within the housing and fluidly connected to the chamber, where the engine includes a plurality of outlets in selective communication with the chamber, and an engine release assembly connected to the housing and the engine, where the engine release assembly selectively secures and releases the engine from the housing.

Still other embodiments include a showerhead with multiple modes. The showerhead includes a spray head fluidly connected to a fluid source and an engine at least partially received within the spray head. The engine includes a face plate defining a plurality of outlets and a back plate connected to the face plate. The connection between the face plate and the back plate defines at least a first fluid channel and a second fluid channel in selective fluid communication with the fluid source and with respective subsets of the plurality of outlets. The engine also includes a first mode aperture defined through the back plate and in fluid communication with the first fluid channel, a second mode aperture defined through the back plate and in fluid communication with the second fluid channel, and an alternate mode aperture defined through the back plate and in fluid communication with the first fluid source.

Another embodiment includes a showerhead including a housing, an engine received within the housing, and an engine release assembly connected to the housing and the engine. The housing may define a chamber in fluid communication with a fluid source. The engine may be fluidly connected to the chamber. The engine may include a plurality of outlets in selective communication with the chamber. The engine release assembly may selectively secure and release the engine from the housing.

Another embodiment includes a showerhead with a housing, an engine at least partially received within the housing, and an engine release assembly selectively securing the engine to the housing. The housing may define a chamber in fluid communication with a fluid source. The engine may be fluidly connected to the chamber. The engine release assembly may include a keyed washer connected to the engine by a fastener. The keyed washer may be at least partially seated against a portion of the housing.

Another embodiment may include an engine release assembly selectively securing a showerhead engine to a showerhead housing. The engine release assembly may include a keyed washer connected to the showerhead engine, and a fastener arranged to secure the keyed washer to the showerhead engine. The keyed washer may include a plurality of engagement features engaged with corresponding features of the showerhead engine to rotationally position the keyed washer relative to the showerhead engine.

This Summary is provided to introduce a selection of concepts in a simplified form that are further described below in the Detailed Description. This Summary is not intended to identify key features or essential features of the claimed subject matter, nor is it intended to be used to limit the scope of the claimed subject matter. A more extensive presentation of features, details, utilities, and advantages of the present invention as defined in the claims is provided in the following written description of various embodiments of the invention and illustrated in the accompanying drawings.

DETAILED DESCRIPTION

Figure 1A:
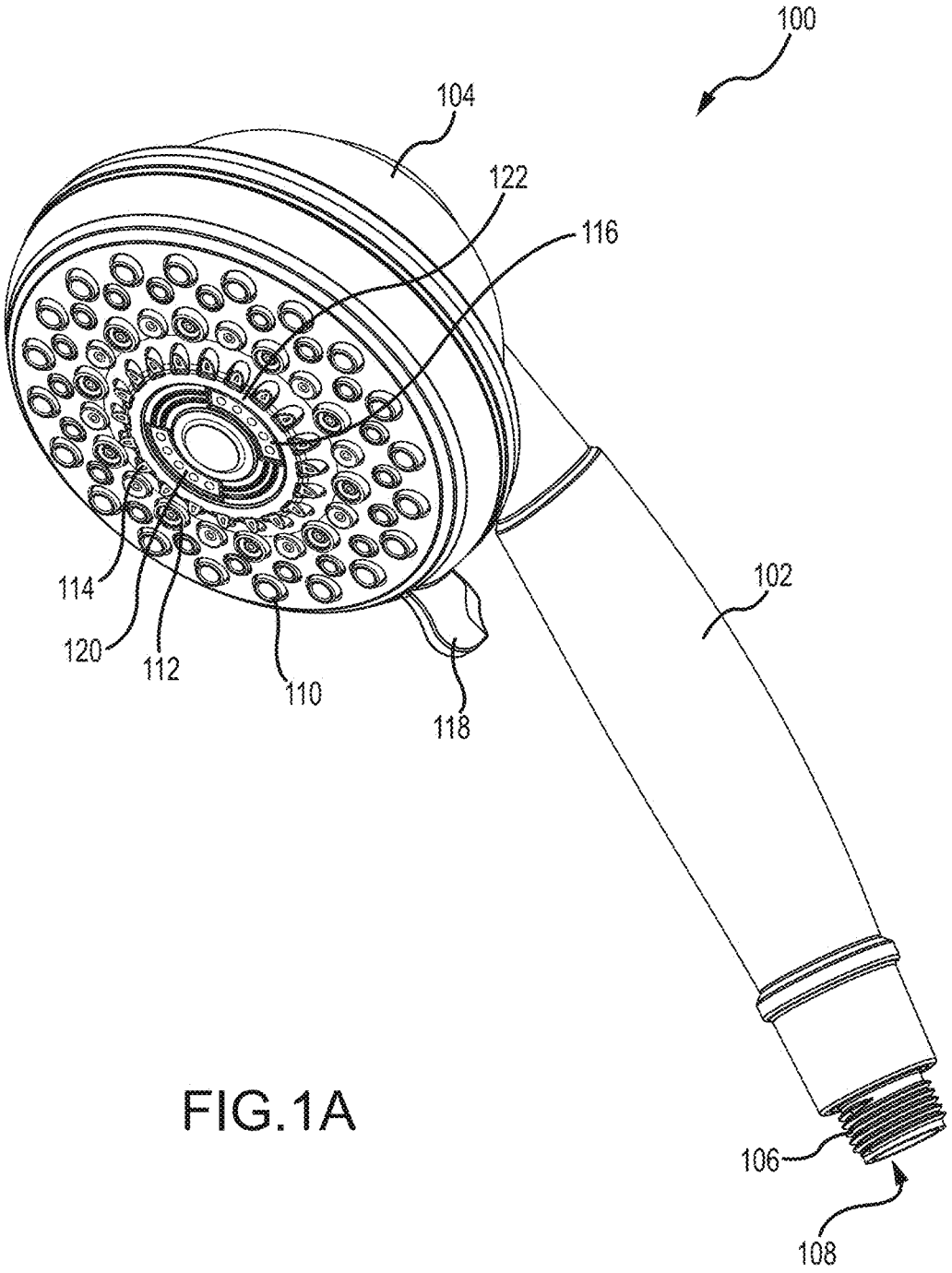
FIG. 1A is an isometric view of a showerhead including a massage mode assembly.

This disclosure is related to a showerhead including a pulsating or massaging spray. The showerhead may include a massage mode assembly including a jet disk, a turbine, a shutter, and a housing. The massage mode assembly is used to create the pulsating or intermittent spray. In one embodiment, the turbine defines one or more cams or cam surfaces and the shutter, which may be restrained in certain directions, follows the movement of the cam to create the pulsating effect by selectively blocking and unblocking outlet nozzles.

In operation, water flowing through the showerhead causes the turbine to spin and, as the turbine spins, the cam rotates causing the shutter to oscillate. In examples where the shutter movement is constrained in one or more directions, the shutter may move in a reciprocal motion, such as a back and forth motion, rather than a continuous motion. The reciprocal motion allows a first group of nozzles to be covered by the shutter, while a second group of nozzle is uncovered and, as the shutter reciprocates, the shutter moves to close the second group of nozzles at the same time that the first group of nozzles is opened. In many embodiments the nozzles in both groups may not be open or "on" at the same time. In particular, nozzles from a first nozzle group may be closed while nozzles from the second group are open and vice versa. As such, the showerhead may not include a set of "transitional" nozzles, i.e., nozzle groups in which the nozzles in a group progressively open and close such as due to a rotating shutter.

The binary functionality of the massage mode or pulsating mode allows the showerhead to produce a stronger fluid force during the pulsating mode, allowing the user to experience a more intense "massage" mode, even with lower fluid flow rates. In some instances the pulse mode may be 50% more forceful than the pulse mode of conventional "progressive" pulse showerheads. Thus, the showerhead may be able to conserve more water than conventional showerheads, while avoiding a decrease in force performance, and in fact may allow a user to experience a greater force during the massage mode.

In some embodiments, a pulsating showerhead spray may be formed by an oscillating shutter. The shutter may be configured to oscillate past the openings of discreet sets of spray nozzles. As an example, the shutter may be actuated by one or more eccentric cams attached to, or formed integrally with, the water driven turbine. These elements include one or more shutters operating in an oscillatory fashion, a turbine with one or multiple cams, and two or more individual groups of water outlet nozzles. Other embodiments may also include links between the cam(s) and shutter(s).

Some embodiments of showerheads of the present disclosure may also include a pause or trickle mode. For example, in one embodiment the showerhead may include a plurality of modes, such as full body mode, massage mode, mist mode, and a trickle mode. The trickle mode allows a minimum amount of flow to exit the showerhead when the water source is on. Depending on the structural characteristics of the showerhead, such as the housing and flow directing plates, the trickle mode may prevent substantially all flow from the showerhead out of the nozzles, to "pause" the showerhead flow without requiring a user to turn the water supply off. As one example, the showerhead may include a back plate with a plurality of mode apertures, where each mode aperture corresponds to a particular fluid channel and nozzle group of the showerhead. In this example, the trickle mode may include a mode aperture that has a smaller width than the remaining showerhead modes, so that the flow of water into the fluid channel is restricted. In addition to or separate from the trickle mode, the showerhead may also include a low flow mode as a water saving feature. The low flow mode may correspond to a low flow aperture that may be larger than the trickle mode aperture, but smaller than the regular mode apertures.

In embodiments including the trickle mode and the low flow mode, the trickle mode aperture and the low flow aperture may be selected by over-clocking or chocking a mode selector assembly to an extreme position. The fluid from a water source may then be directed toward the desired trickle mode or low flow mode, with the diameter of the corresponding mode aperture determining the flow rate output by the showerhead.

Additionally, in some embodiments the various components of the showerhead may be configured to be assembled and disassembled quickly and repeatedly. For example, the showerhead may include a handle having a spray head, a face plate cover, and an engine. The engine may include the various internal components of the showerhead such as the massage mode assembly, one or more flow directing plates, and so on. The engine is received within the spray head and the cover is secured to the engine and showerhead to secure the engine within the spray head. The engine may be configured to engage one or more keying elements in the spray head, cover, housing, or other component such as a mounting plate connected thereto. A fastener or other component may be used to secure the engine to the spray head once the engine is rotated to a desired, locked position. The fastener may be easily accessible from the exterior of the showerhead to allow the fastener to be removed without damaging the housing. Once the fastener is removed the engine can rotated out of alignment with the keying features and removed easily without damaging the other components.

In one example, the fastener may include a snap-fit connection between a back plate of the engine and a mounting plate connected to the housing or the housing itself. In this example, the engine may be snapped into place within the spray head. In another example, the fastener may be a screw or other threaded element that is threaded to a keyed washer. The keyed washer may be connected to the engine through a cap cavity in a back wall of the spray head or other housing. In this example, the showerhead may include a decorative cap that may conceal the fastener when the showerhead is assembled.

In embodiments where the engine may be selectively attached and detached from the spray head, the showerhead may be manufactured at a lower cost with increased reliability. In particular, often the handle and/or cover may be plated with an aesthetically pleasing material, such as a chrome or metal plating. These may be the most expensive components of the showerhead as the remaining components may be constructed out of plastic and other relatively inexpensive materials. In conventional showerheads, once the showerhead had been assembled, the engine could not be removed without damaging components of the showerhead. As such, if one or more components within the engine were damaged or flawed, the entire showerhead was often tossed out. However, in embodiments having the removable engine, the showerheads can be assembled, tested, and, if a component is not operating as desired, the engine can be removed and replaced without disposing of the more expensive components as well.

Figure 1B:
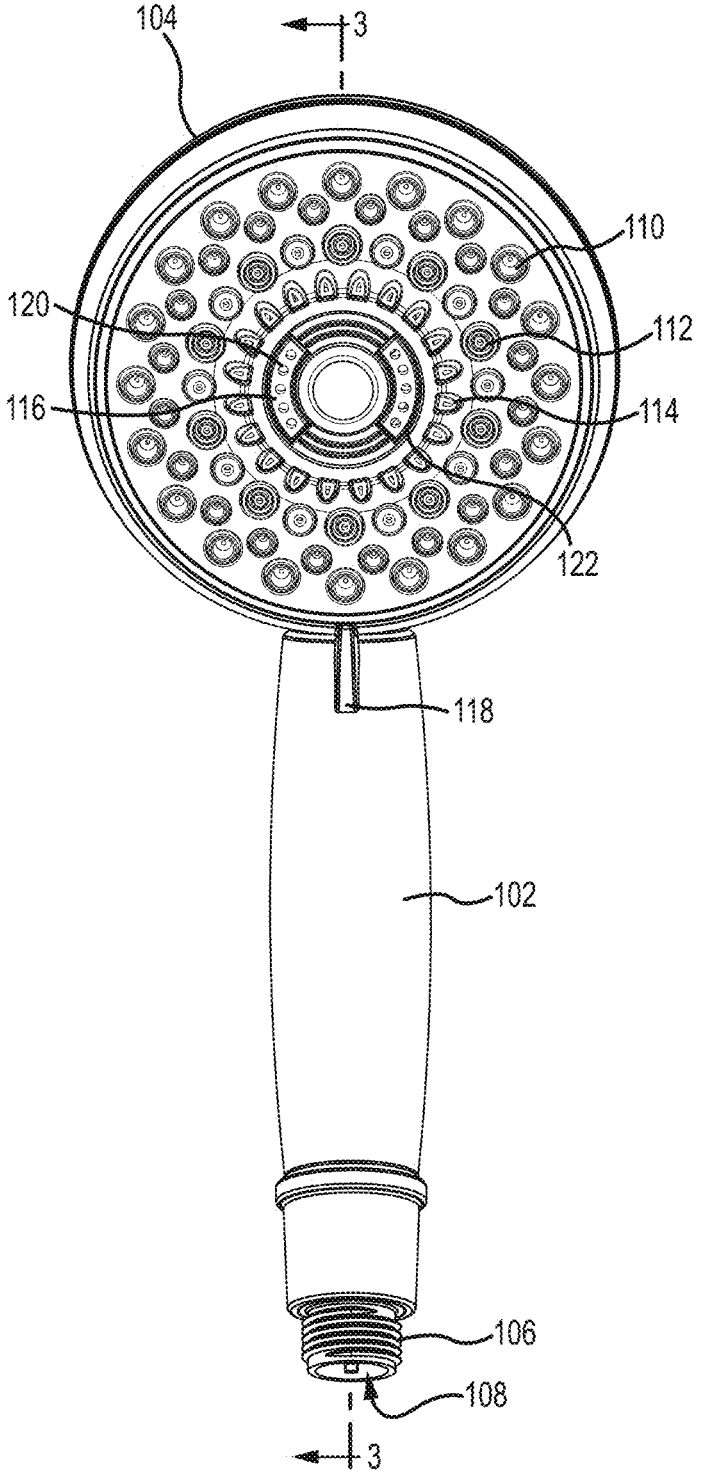
FIG. 1B is a front elevation view of the showerhead of FIG. 1A.
Figure 2:
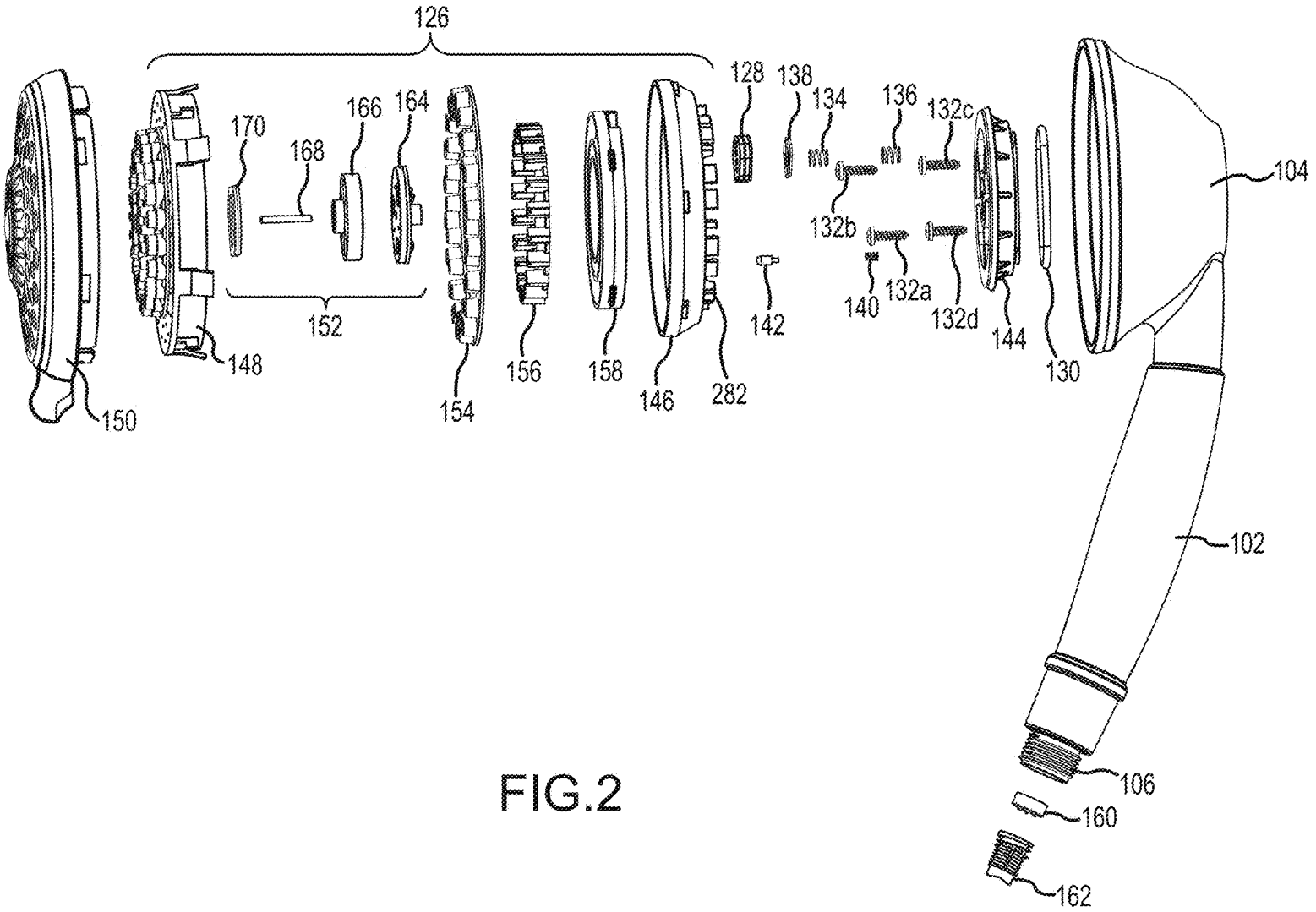
FIG. 2 is an exploded view of the showerhead of FIG. 1A.
Figure 3:
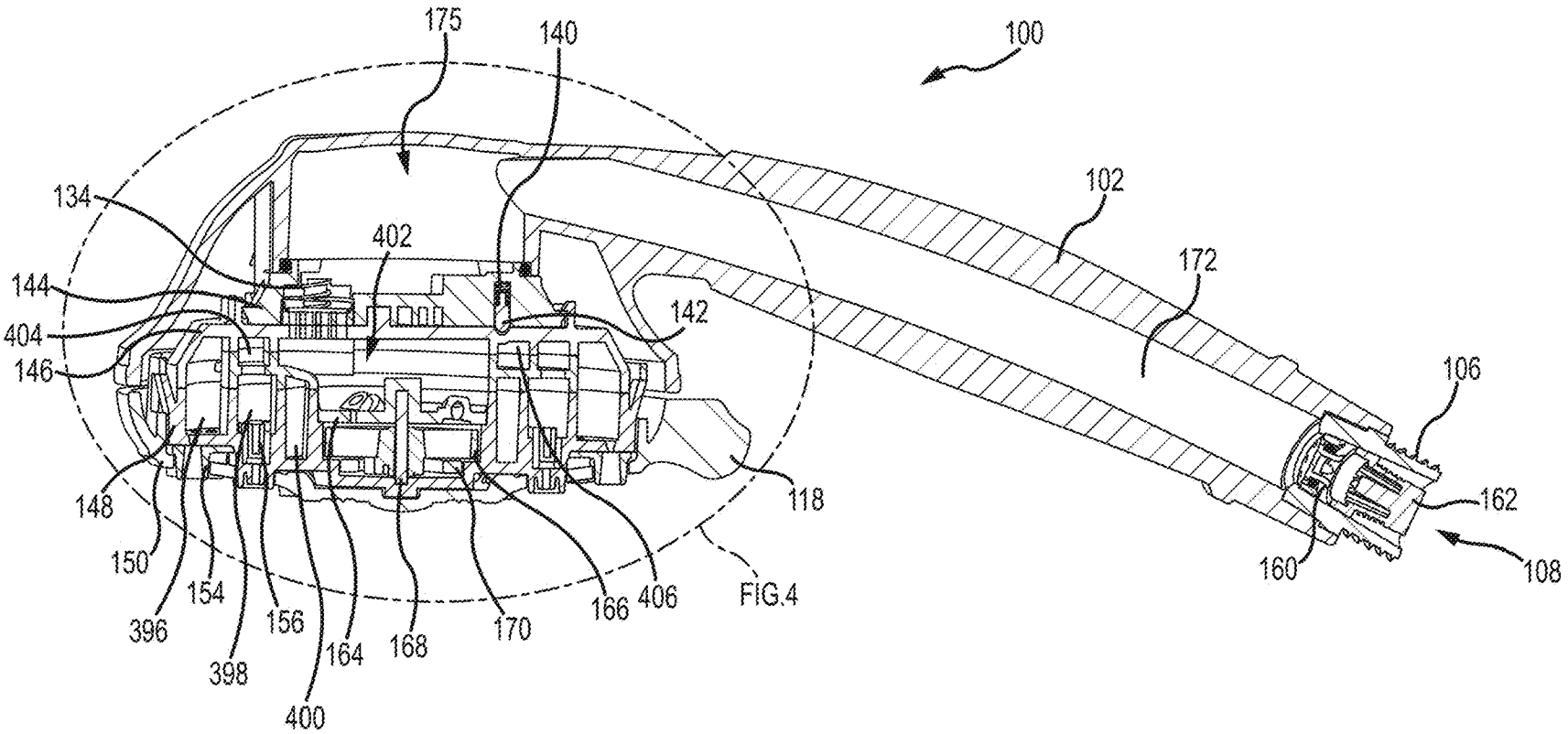
FIG. 3 is a cross-sectional view of the showerhead of FIG. 1A taken along line 3-3 in FIG. 1B.
Figure 4:
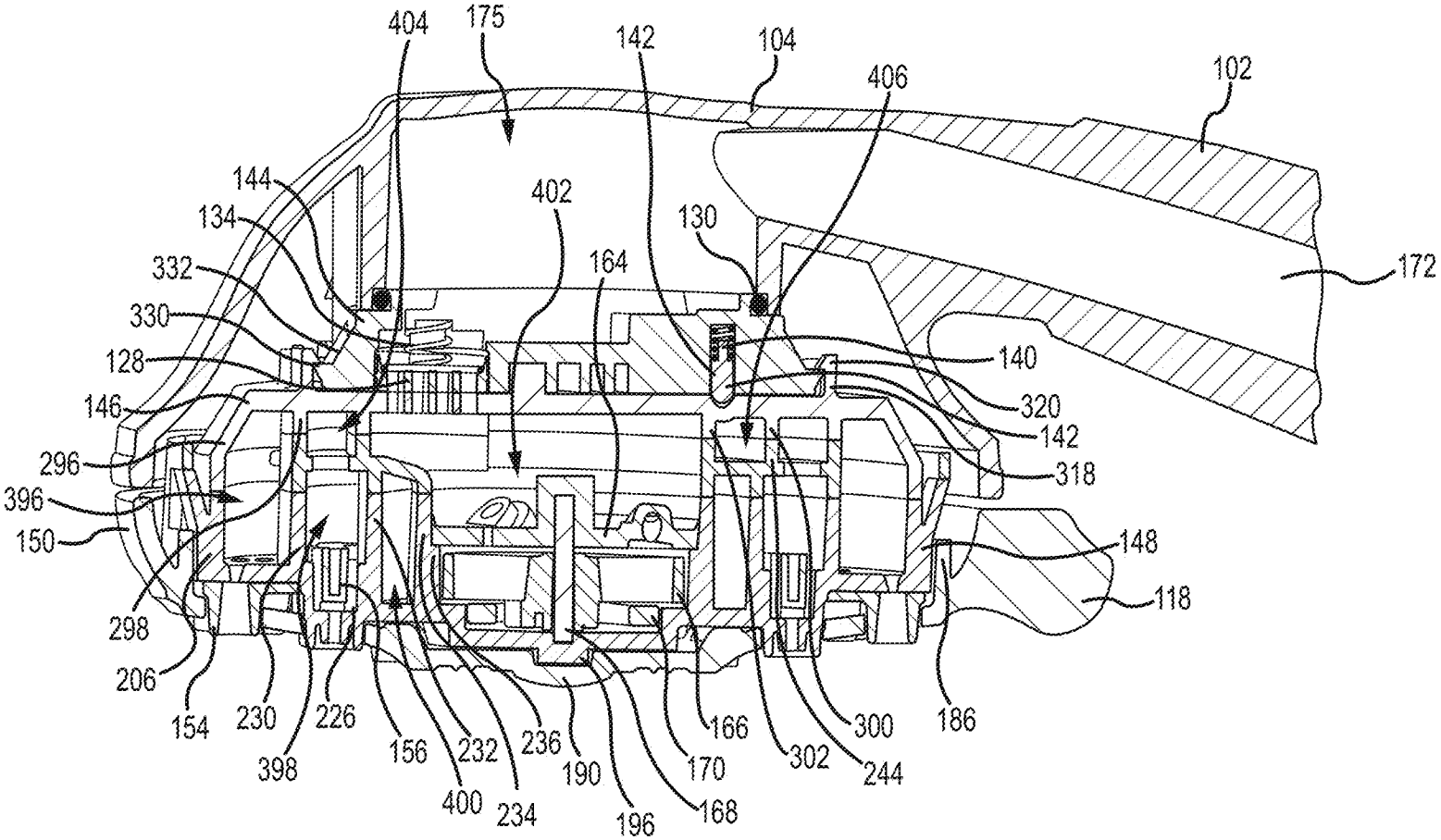
FIG. 4 is an enlarged cross-sectional view of a portion of the showerhead of FIG. 1A as indicated in FIG. 3.

Turning to the figures, showerhead embodiments of the present disclosure will now be discussed in more detail. FIGS. 1A and 1B are various views of the showerhead. FIG. 2 is an exploded view of the showerhead of FIG. 1A. FIGS. 3 and 4 are cross-section views of the showerhead of FIG. 1A. With reference to FIGS. 1A-2, the showerhead 100 may include a handle 102 and a spray head 104. In the embodiment shown in FIGS. 1A-2, the showerhead 100 is a handheld showerhead. However, in other embodiments (see, e.g., FIG. 23), the showerhead 100 may be a fixed or wall mount showerhead, in which case the handle 102 may be omitted or reduced in size. The handle 102 defines an inlet 108 for the showerhead 100 that receives water from a fluid source, such as a hose, J-pipe, or the like. Depending on the water source, the handle 102 may include threading 106 or another connection mechanism that can be used to secure the handle 102 to the hose, pipe, etc.

In embodiments where the showerhead 100 is a handheld showerhead, the handle 102 may be an elongated member having a generally circular cross section or otherwise be configured to be comfortably held in a user's hand. Additionally, as shown in FIG. 2, the showerhead 100 may also include a flow regulator 160 and a filter 162 that are connected to the handle 102.

With reference to FIGS. 1A and 1B, the spray head 104 includes a plurality of output nozzles arranged in sets or groups, e.g., a first nozzle group 110, a second nozzle group 112, a third nozzle group 114, and a fourth nozzle group 116, that function as outlets for the showerhead 100. As will be discussed in more detail below, each of the selected nozzle groups 110, 112, 114, 116 may be associated with a different mode for the showerhead 100. Additionally, certain groups of nozzles, such as the fourth nozzle group 116 may include nozzle subsets such as a first nozzle bank 120 and a second nozzle bank 122. In this example, the two nozzle banks 120, 122 may be crescent shaped, include five nozzles, and may be positioned opposite one another. However, the example shown in FIGS. 1A and 1B is meant as illustrative only and many other embodiments are envisioned. The showerhead mode is varied by rotating the mode selector 118, which in turn rotates an engine 126 received within the spray head 104, which will be discussed in more detail below.

Figure 5:
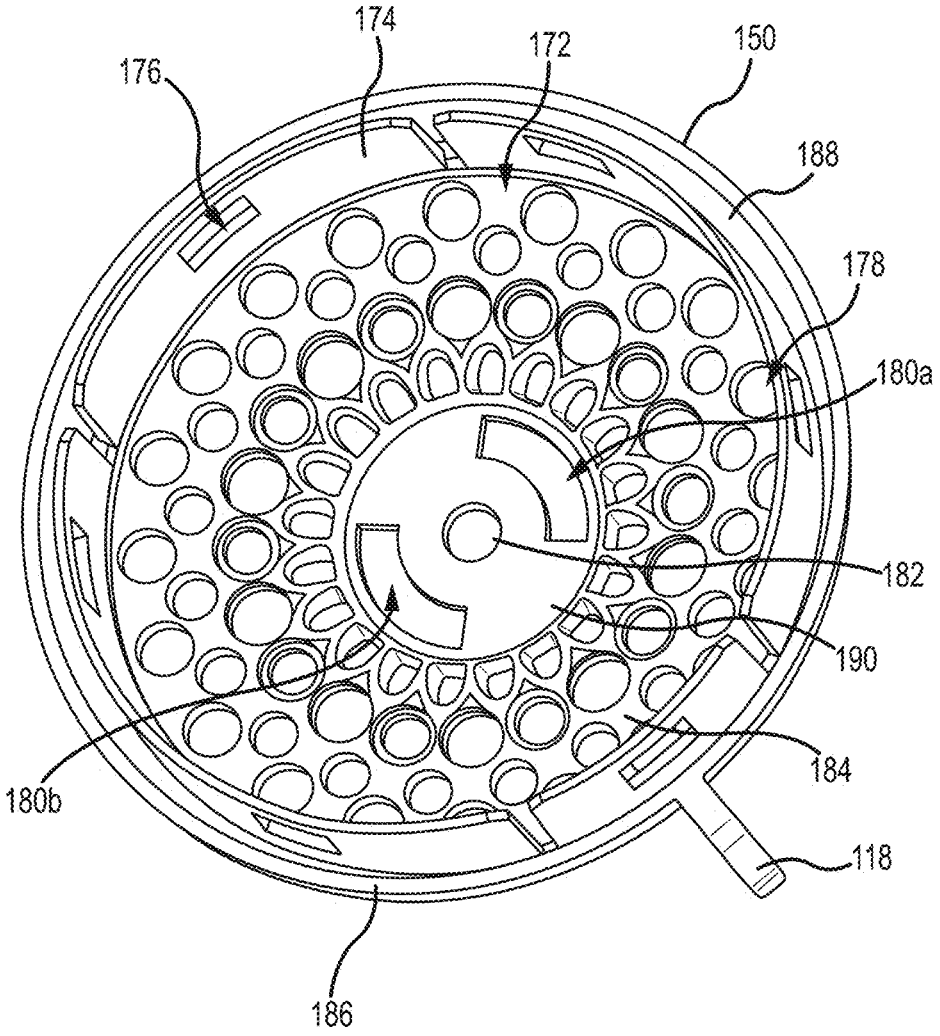
FIG. 5 is a rear isometric view of a cover plate for the showerhead.

With reference to FIG. 2, the showerhead 100 may include the engine 126 having a plurality of flow directing plates, 146, 158, 146, a massage assembly 152, and additional mode varying components. The engine 126 is received within the spray head 104 and a cover 150 contains the engine 126 within the spray head 104 and provides an aesthetically pleasing appearance for the showerhead 100. FIG. 5 is a rear isometric view of the cover. With reference to FIGS. 1A, 2, and 5, the cover 150 is configured to generally correspond to the front end of the spray head 104 and may be a generally circularly shaped body. The cover 150 defines a plurality of apertures, such as the nozzle apertures 178 and the bank apertures 180*a*, 180*b*. As will be discussed below these apertures 178, 180*a*, 180*b* receive nozzles that form the nozzle groups 110, 112, 114, 116 of the showerhead 100. Accordingly, the shape, size, and position of the nozzle apertures 178 and bank apertures 180*a*, 180*b* may be provided to correspond to the number and position of the mode nozzles.

The cover 150 forms a cup-like structure on the rear side that defines a cover chamber 172. The cover chamber 172 may be configured to receive one or more components of the engine 126. A plurality of alignment brackets 174 define the perimeter of the cover chamber 172 and extend upward from an interior bottom wall 184. The alignment brackets 174 have a curvature substantially matching the curvature of the perimeter of the cover 150 and are spaced apart from one another around the perimeter. In one embodiment the showerhead cover 150 may include seven alignment brackets 174. However, the number of brackets 174 and the spacing between the brackets 174 may be varied based on the diameter of the cover 150, the number of modes for the showerhead 100, and other factors. Additionally, although a plurality of alignment brackets 174 are illustrated, in other embodiments the cover 150 may include a single outer wall defining the perimeter of the cover chamber 172. Each alignment bracket 174 may include a bracket aperture 176 defined therethrough.

With reference to FIG. 5, the alignment brackets 174 may be spaced apart from a top edge of a rim 186 forming the back end of the cover 150. The spacing between the brackets 174 and the top edge of the rim 186 defines a gap 188.

The interior bottom wall 184 of the cover 150 may include a center area 190 that is recessed further than the other portions of the bottom wall 184. The center area 190 may be located at a central region of the cover 150. A small disk-shaped recess 182 may be formed at the center point of the center area 190. The recess 182 is located below the interior surface of the center area 190 and extends outward past the exterior of the center area 190. The mode selector 118 may be a finger grip formed integrally with the cover 118 and extending outward from the rim 186.

Figure 6A:
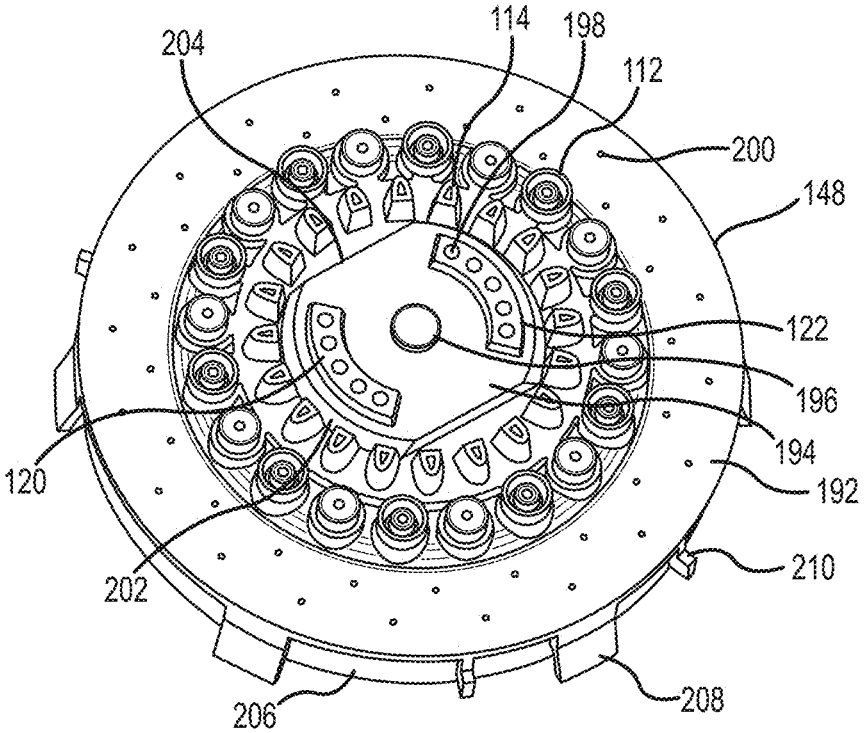
FIG. 6A is a front isometric view of a face plate for the showerhead.
Figure 6B:
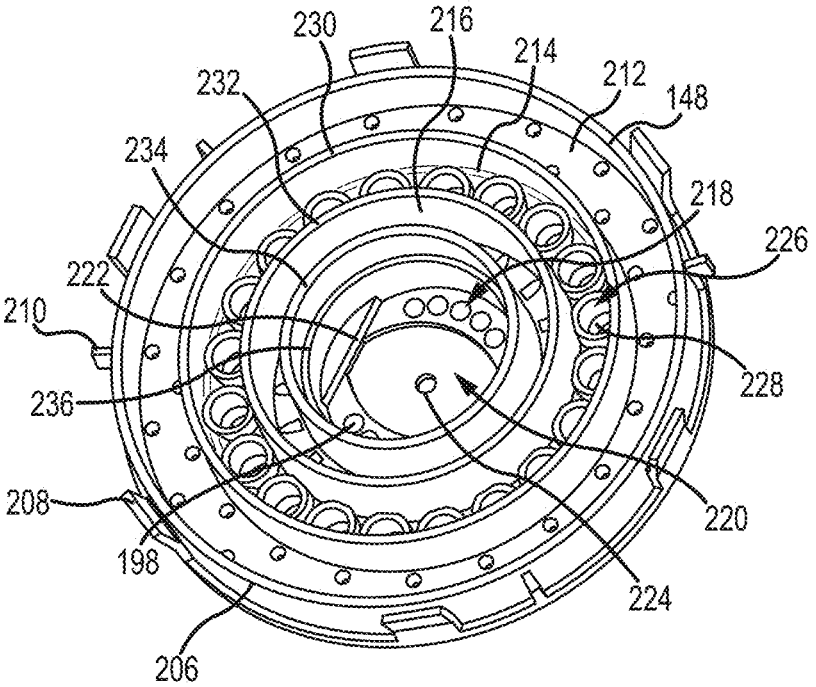
FIG. 6B is a rear isometric view of the face plate of FIG. 6A.
Figure 14:
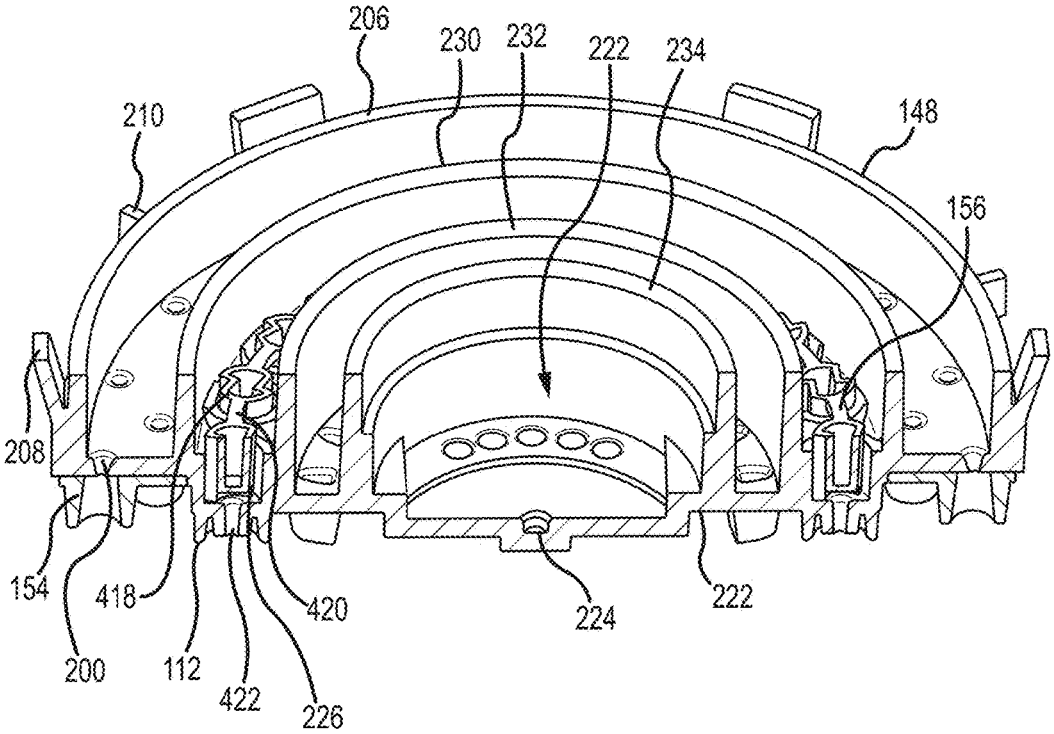
FIG. 14 is a cross-sectional view of the face plate and a mist ring of the showerhead of FIG. 1A.

The face plate 148 will now be discussed in more detail. FIGS. 6A and 6B are front and rear perspective views of the face plate 148. FIG. 14 is a cross-section view of the face plate 148 and mist plug ring 156. The face plate 148 includes a front surface 192 and a rear surface 194. The front surface 192 defines a plurality of outlets 198, 200 as well as the nozzles for select nozzle groups 112, 114. Depending on the desired spray characteristics for each mode of the showerhead 100, the outlets 198, 200 and nozzles 112, 114 may be raised protrusions with an outlet in the middle, apertures formed through the face plate 148, or the like. For example, the nozzles for the second nozzle group 112 may include raised portions that extend outward from the front surface 192 of the face plate 148 and on the back surface 194 may include nozzle chambers 226. The nozzle chambers 226 may be formed as individual cylindrical cavities that funnel toward the nozzle outlet. Each nozzle chamber 226 may include an interior shelf 228 defined toward a bottom end of the chamber 226. The interior shelf 228 reduces the diameter of the chamber 226 before the nozzle outlet, which may be formed as a mist outlet 4 422 defined through the shelf 228 on the bottom of the chambers 226.

With continued reference to FIGS. 6A, 6B and 14, the face plate 148 may include a raised platform 194 extending outward from a central region of the face plate 148. The platform 194 may include two curved sidewalls 202 facing one another and two straight sidewalls 204 connecting the two curved sidewalls 202. The raised platform 194 also includes a nub 196 extending outward from the center of the platform 194. The two nozzle banks 120, 122 are defined as raised, curved formations on the top of the platform 194. In this example, the two nozzle banks 120, 122 are curved so as to form opposing parenthesis shapes facing one another with the nub 196 being positioned between the two banks 120, 122. The banks 120, 122 may generally match the curvature of the curved sidewalls 202 of the platform 194. Each bank 120, 122 may include a plurality of outlets 198. In one example, each bank 120, 122 may include five outlets 198; however, the number of outlets 198 and the positioning of the outlets may vary based on the desired output characteristics of the showerhead 100.

The nozzle groups 112, 114 may be formed in concentric rings surrounding the platform 194. In this manner, the banks 120, 122 may form the innermost ring of nozzles for the showerhead 100 with the remaining nozzle groups 110, 112, 114 surrounding the banks 120, 122.

With reference to FIG. 6B, the face plate 148 may also include a perimeter wall 206 extending outward from the perimeter edge of the bank surface 194. The perimeter wall 206 forms an outer wall of the face plate 148. The face plate 148 may include a plurality of concentric ring walls 230, 232, 234 that along with the perimeter wall 206 define a plurality of flow paths 212, 214, 216, 218. For example, the first ring wall 230 extends upward from the back surface 194 of the face plate 148 but is positioned closer toward the center of the face plate 148 than the outer perimeter wall 206. The gap between the perimeter wall 206 and the first ring wall 230 defines the first flow path 212 and includes a first set of outlets 200. As another example, the first ring wall 230 and the second ring wall 232 define the second flow path 214 that includes the second nozzle group 112 and the second ring wall 232 and the third ring wall 234 define the third flow path 216. When the face plate 148 is connected to the other plates of the showerhead 100, the flow paths 212, 214, 216, 218 defined by the various walls 206, 230, 232, 234 correspond to fluid channels for discrete modes of the showerhead 100. As should be understood, the walls 206, 230, 232, 234 prevent fluid from one flow path 212, 214, 216, 218 from reaching outlets and/or nozzles in another flow path when the engine 126 is assembled. The shape and locations of the walls may be varied based on the desired modes for the showerhead.

The third ring wall 234 defines the fourth flow path 218, as well as a massage chamber 220. The massage chamber 220 is configured to receive the massage assembly 152 as will be discussed in more detail below. The massage chamber 220 may include an annular wall 236 concentrically aligned and positioned against the third ring wall 234. However, the annular wall 236 is shorter than the third ring wall 234 so that it defines a shelf within the massage chamber 220.

A bottom surface of the massage chamber 220 includes two curb walls 2222. The curb walls 2 222 extend toward a center of the chamber 220 and include a straight edge that varies the geometry of the bottom end of the chamber 220. The two curbs 2 222 oppose each other to transform the bottom end of the chamber 220 to a rectangle with curved ends or a truncated circle. The curb walls 2 222 generally correspond to the straight edges 204 of the platform 194 on the front surface 192 of the face plate 148.

A pin recess 224 is defined at the center of the chamber on the bottom surface and extends into the back of the nub 196. The pin recess 224 is configured to receive and secure a pin from the massage assembly 152 as will be discussed in more detail below. Additionally, the nozzle outlets 198 for each bank 120, 122 are defined along a portion of the bottom surface of the massage chamber 220.

Figure 7A:
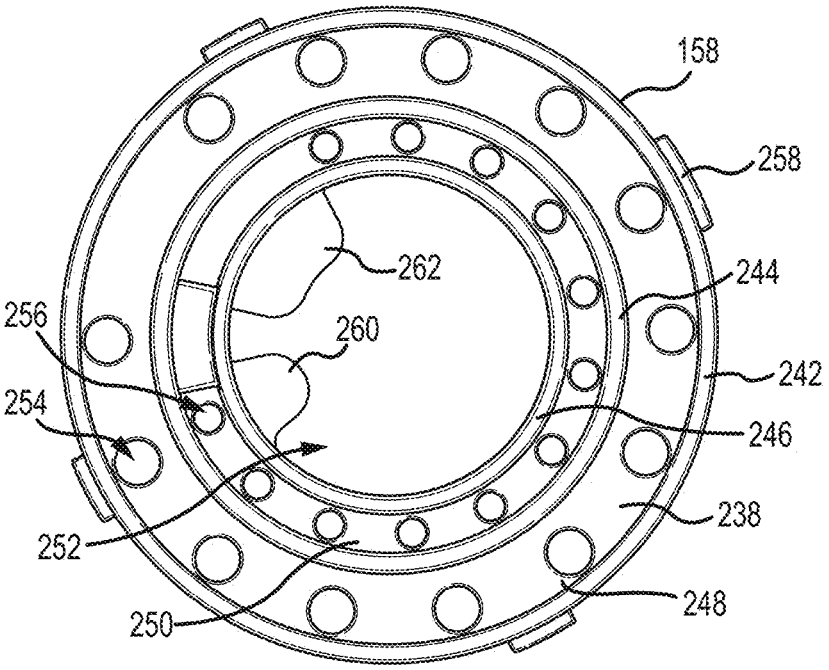
FIG. 7A is a front plan view of an inner plate of the showerhead.
Figure 7B:
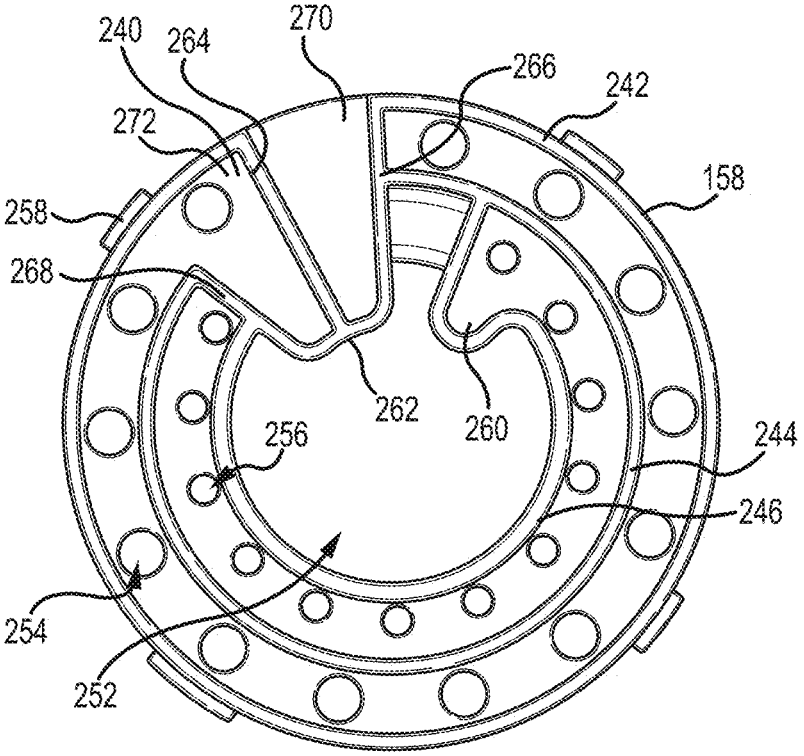
FIG. 7B is a rear plan view of the inner plate of FIG. 7A.

The engine 126 may also include an inner plate 158. The inner plate 158 may define additional modes for the showerhead. However, in embodiments where fewer modes may be desired, the inner plate may be omitted (see, e.g., FIGS. 17A-24) FIGS. 7A and 7B illustrate front and rear views, respectively, of the inner plate 158. With reference to FIGS. 7A and 7B, the inner plate 158 may be a generally circular plate having a smaller diameter than the face plate 148. The inner plate 158 may include a plurality of tabs 258 extending outward from a sidewall of the inner plate 158. A massage aperture 252 is formed through the center of the inner plate 158 such that the inner plate 158 has a ring or donut shape. Similar to the face plate 148, the inner plate 158 may include a plurality of walls defining a plurality of flow paths. For example, the inner plate 158 may include an outer perimeter wall 242 along the outer perimeter of the plate 158 and first and second ring walls 244, 246 defined concentrically within the perimeter wall 242. The perimeter wall 242 and the first and second ring walls 244, 246 extend from both the front and rear surfaces 238, 240 of the inner plate 158. The perimeter wall 242 and the first and second ring walls 244, 246 form closed concentric circles on the front surface 238. The perimeter wall 242 and the first ring wall 244 define a first flow path 248 and the first ring wall 244 and the second ring wall 246 define a second flow path 250. Each of the flow paths 248, 250 include apertures 254, 256 defined through the front surface and rear surfaces 238, 240 of the inner plate 158. As will be discussed in more detail below, the flow paths 248, 250 and the respective apertures 254, 256 fluidly connect select nozzle groups based on the selected mode of the showerhead 100.

With reference to FIG. 7B, the inner plate 158 may include a first finger 260 and a second finger 262 that project into the mode aperture 252 on the rear side of the inner plate 158. As will be discussed in more detail below, the fingers 260, 262 provide structural support for the mode selection components and help direct water to a desired fluid channel. The first finger 260 is fluidly connected to the second flow path 250. On the rear surface 240 of the inner plate 158, the second finger 262 includes a plurality of separating walls 264, 266, 268 that intersect with one or more of the outer wall 242, first ring wall 244, and/or second ring wall 246. For example, the first separating wall 264 bisects the second finger 262 to define a first portion 270 and a second portion 272. The first separating wall 264 intersects with the outer wall 242. The second separating wall 266 is defined on an outer edge of the second finger 262 and intersects with both the outer wall 242 and the first ring wall 244 to fluidly separate the first flow path 248 from the first portion 270 of the second finger 262. Similarly, the third separating wall 268 is formed on the opposite edge of the second finger 262 from the second separating wall 266. The third separating wall 268 intersects with the interior wall of the inner plate 158 defining the massage aperture 252 and the second ring wall 246. In this manner, the third separating wall 268 fluidly separates the second portion 272 of the second finger 262 from the second flow path 250.

Figure 8A:
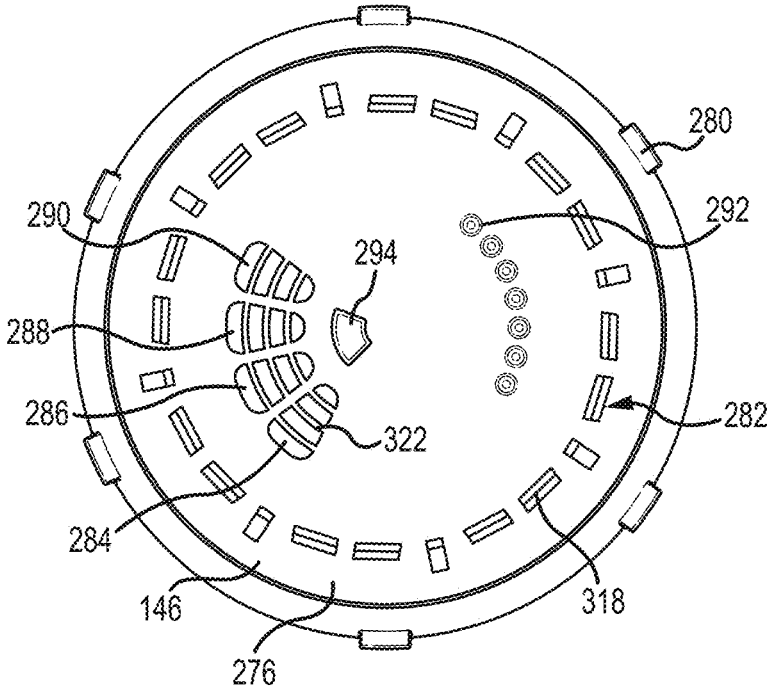
FIG. 8A is a top plan view of a back plate of the showerhead.
Figure 8B:
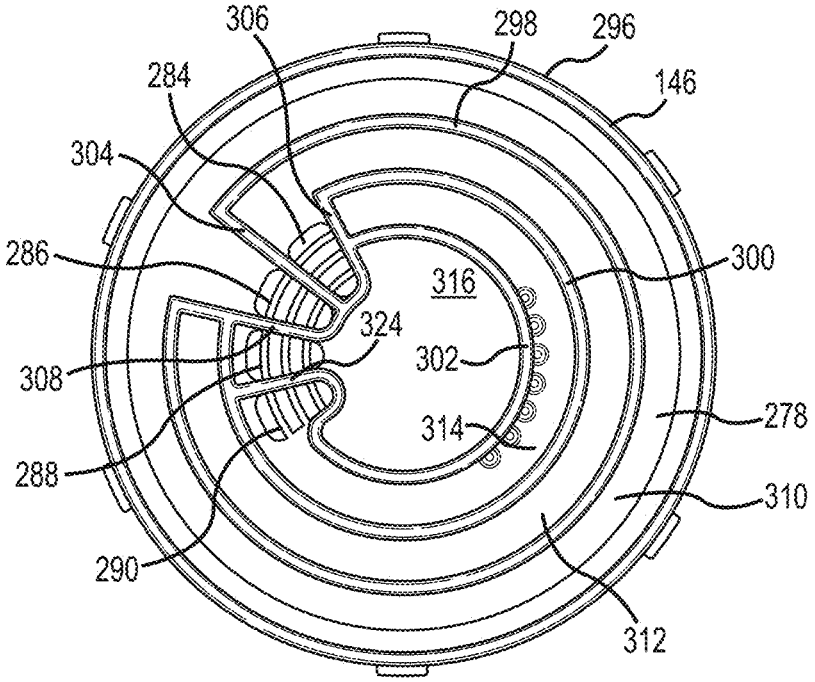
FIG. 8B is a bottom plan view of the back plate of FIG. 8A.

The back plate 146 for the showerhead 100 will now be discussed in more detail. FIGS. 8A and 8B are top and bottom views of the back plate 146. With reference to FIGS. 8A and 8B, the back plate 146 has a back side 276 and a front side 278. A perimeter wall 296 extends outward and at an angle from the back side 276 and then transitions to a cylindrical form to extend normal to the front side 278. In embodiments where the perimeter wall 296 is angled, the back side 276 of the back plate 146 may have a frustum or partially conical shape (see FIGS. 2 and 8A). The back plate 146 may include a plurality of tabs 280 extending outward and spaced apart from one another on the outer surface of the perimeter wall 296. The configuration of the back plate may be modified based on the connection to the spray head as will be discussed in more detail below.

With reference to FIG. 8A, a locking band 282 is formed on the back side 276 of the back plate 146. The locking band 282 includes a plurality of locking fingers 318. The locking fingers 318 are spatially separated from each other and are configured to act as fasteners to connect the back plate to the mounting plate 144, as will be discussed in more detail below. The locking fingers 318 are separated from one another so that they will be more flexible than a solid band of material so as to allow the fingers 318 to flex and resiliently return to an initial position. The locking fingers 318 may include lips 320 (see FIG. 4) extending from a front sidewall. The locking band 282 is defined in a generally circular shape on the back side 276.

With continued reference to FIG. 8A, the back plate 146 may also include a plurality of detent recess 292 defined on the back side 276. In one embodiment, there may be seven detent recess 292, however, the number of recesses 292 may be based on a desired number of modes for the showerhead 100. Thus, as the number of modes varies, so may the number of detent recesses 292. The back plate 146 may also include a stop bump 294 extending upward from the back side 276. The stop bump 294 may be somewhat trapezoidal-shaped with a curved interior surface facing the center of the back plate 146.

With continued reference to FIG. 8A, the back plate 146 includes a plurality of mode apertures 284, 286, 288, 290. The mode apertures 284, 286, 288, 290 are somewhat triangularly shaped apertures and are positioned adjacent one another. Each of the apertures 284, 286, 288, 290 may correspond to one or more modes of the showerhead 100, as will be discussed below. In some embodiments, the mode apertures 284, 286, 288, 290 may include a plurality of support ribs 322 extending lengthwise across each aperture to form groups of apertures.

With reference to FIG. 8B, the back plate 146 may include a plurality of ring walls 298 300, 302 extending outward from the front side 278. Similar to the other plates of the showerhead, the ring walls 298, 300, 302 of the back plate 146 may be generally concentrically aligned and may have decreasing diameters, where combinations of ring walls define flow paths for the back plate 146. In particular, the outer perimeter wall 296 and the first ring wall 298 define a first flow path 310, the first ring wall 298 and the second ring wall 300 define a second flow path 312, the second ring wall 300 and the third ring wall 302 define a third flow path 314, and the third ring wall 302 defines a forth flow path 316.

Similar to the inner plate 158, the back plate 146 may include a plurality of separating walls 304, 306, 308 that fluidly separate the flow paths 310, 312, 314 from one another. In one embodiment, the back plate 146 may include a first separating wall 304 that intersects with the first ring wall 298 to fluidly separate the first flow path 310 from the second flow path 312, a second separating wall 306 intersects the second and third ring walls 300, 302 to separate the second flow path 312 from the third flow path 314, and a third separating wall 308 that intersects the second and third ring walls 300, 302 to separate the froth flow path 316 from the other flow paths. In this embodiment, the third ring wall 302 may transition into a separating wall 324 that functions to separate the fourth flow path 316 from the first flow path 310. The separating walls 304, 306, 308, 324 are configured to separate each of the mode apertures 284, 286, 288, 290 accordingly the thickness of the separating walls 304, 306, 308, 324 may be determined in part by the separation distance between each of the mode apertures 284, 286, 288, 290.

Figure 9A:
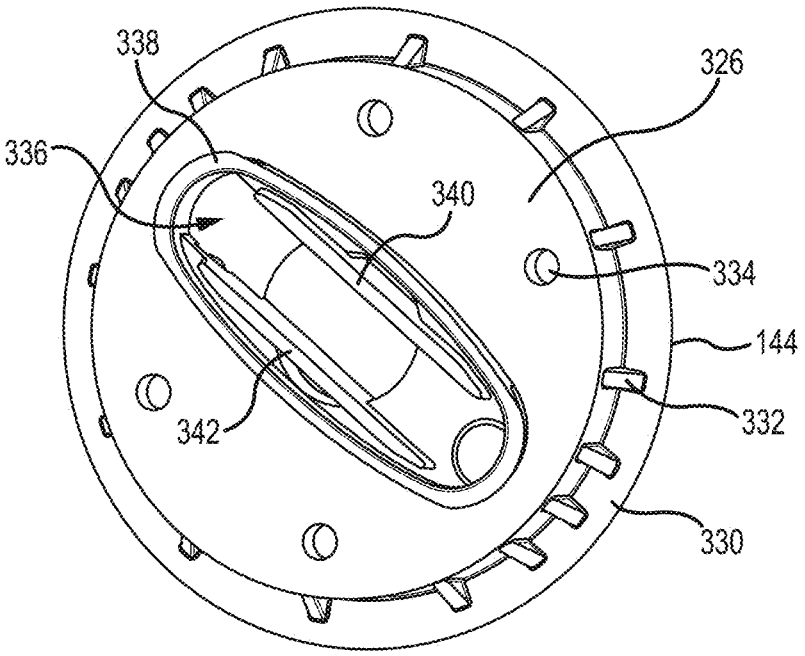
FIG. 9A is a top isometric view of a mounting plate for the showerhead.
Figure 9B:
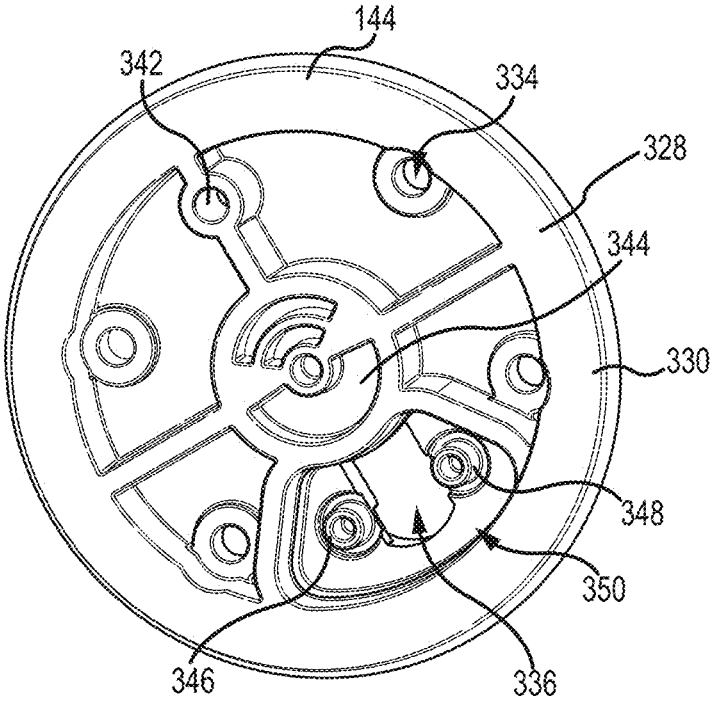
FIG. 9B is a bottom isometric view of the mounting plate of FIG. 9B.

A mounting plate 144 connects the engine 126 to the showerhead 100. FIGS. 9A and 9B illustrate top and bottom views of the mounting plate 144. With reference to FIGS. 9A and 9B, the mounting plate 144 may include a top face 326 and a bottom face 328. A brim 330 extends outward from a terminal bottom edge of the 1top face 326. The brim 330 has a larger diameter than the top face 326 and may be substantially planar. A plurality of braces 332 extend upward 3at an angle between at sidewall of the top face 326 and the brim 330 to provide support for the top face 326 of the mounting plate 144.

With reference to FIG. 9A, the mounting plate 144 may include an oval shaped engagement wall 338 extending upward from the top face 326. The engagement wall 338 extends across a width of the top face 326. Two parallel sidewalls 340, 342 are positioned within the engagement wall 338 along the longitudinal sides of the engagement wall 338. The sidewalls 340, 342 are parallel to each other and a spaced apart from the interior surface of the engagement wall 338. An engine inlet 336 is defined as an aperture through the top face 326 of the mounting plate 144. The engine inlet 336 is defined at one end of the engagement wall 338 and is surrounded by the engagement wall 338. The mounting plate 144 may further include a plurality of fastening apertures 334 defined at various positions on the top face 326.

With reference to FIG. 9B, the mounting plate 144 may include a seal cavity 350 defined by walls extending upward from the bottom face 328. The seal cavity 350 may have a somewhat trapezoidal shape but with one of the walls being slightly curved. The engine inlet 336 is located within the seal cavity 350. The mounting plate 144 may also include two spring columns 346, 348 extending downward from the bottom face 328. The spring columns 346, 348 are positioned on opposite sides of the engine inlet 336 and may be formed on a bottom surface of the two parallel sidewalls 340, 342 on the top end of the mounting plate 144.

With continued reference to FIG. 9B, the mounting plate 144 may further include a stop cavity 344 defined as a semicircular cavity in the central region of the bottom face 328. The stop cavity 344 may be configured to correspond to the shape and of the stop bump 294 of the back plate 146 to allow the stop bump 294 to be received therein. A detent pin cavity 342 is defined on an opposite side of the bottom face 328 from the seal cavity 350. The detent pin cavity 342 may be a generally cylindrically-shaped volume.

Figure 10:
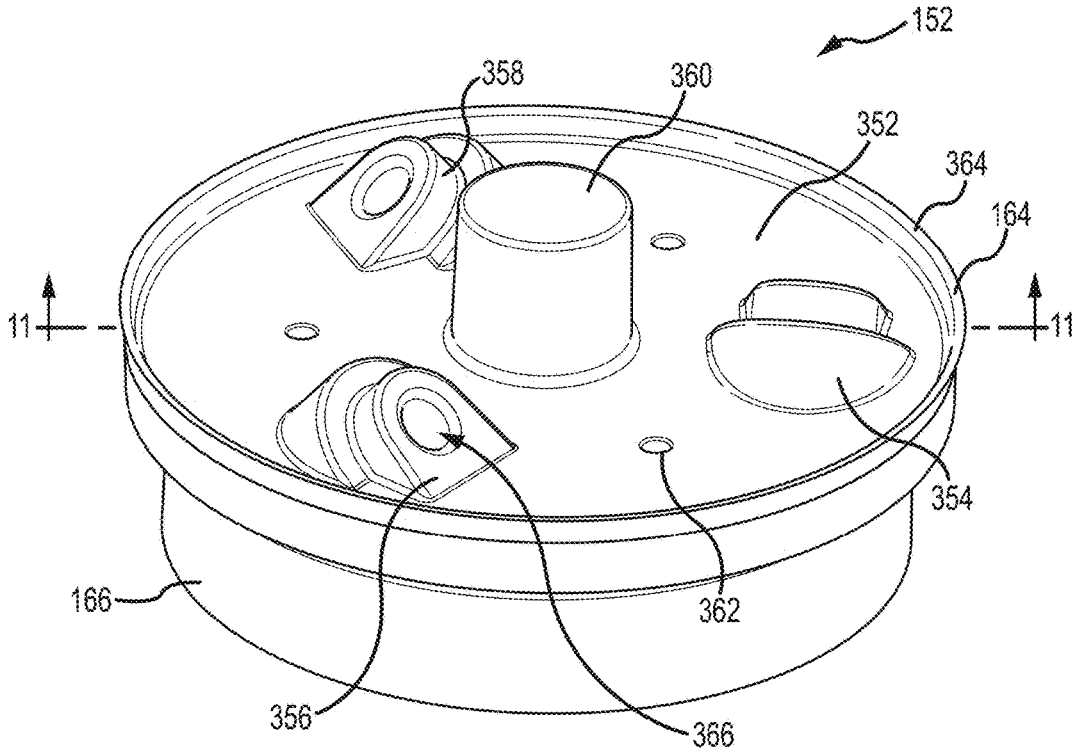
FIG. 10 is a top isometric view of the massage mode assembly of the showerhead.
Figure 11:
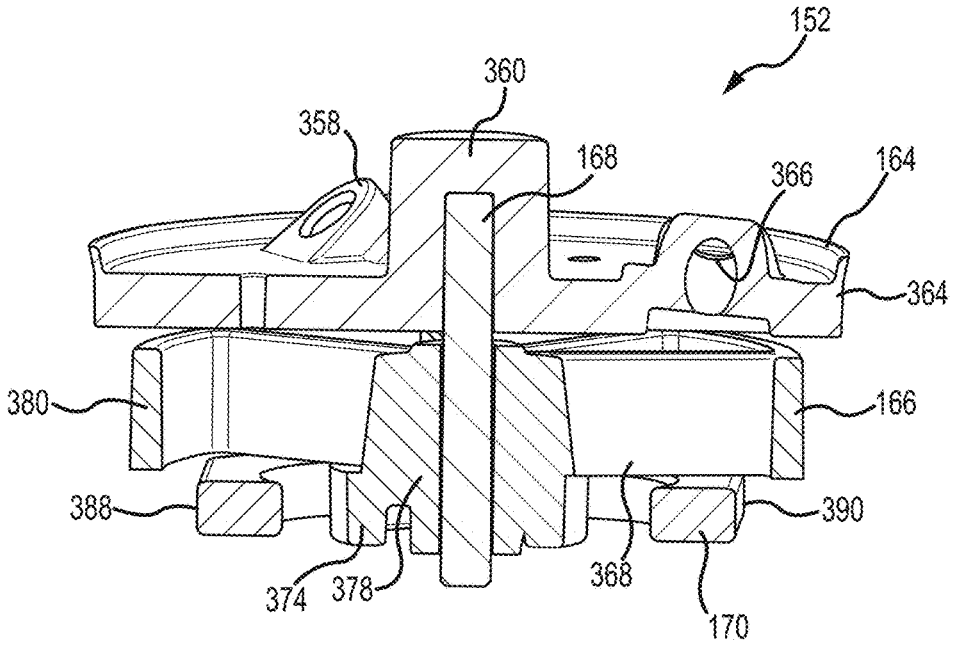
FIG. 11 is a cross-sectional view of the massage mode assembly taken alone line 11-11 in FIG. 10.
Figure 12:
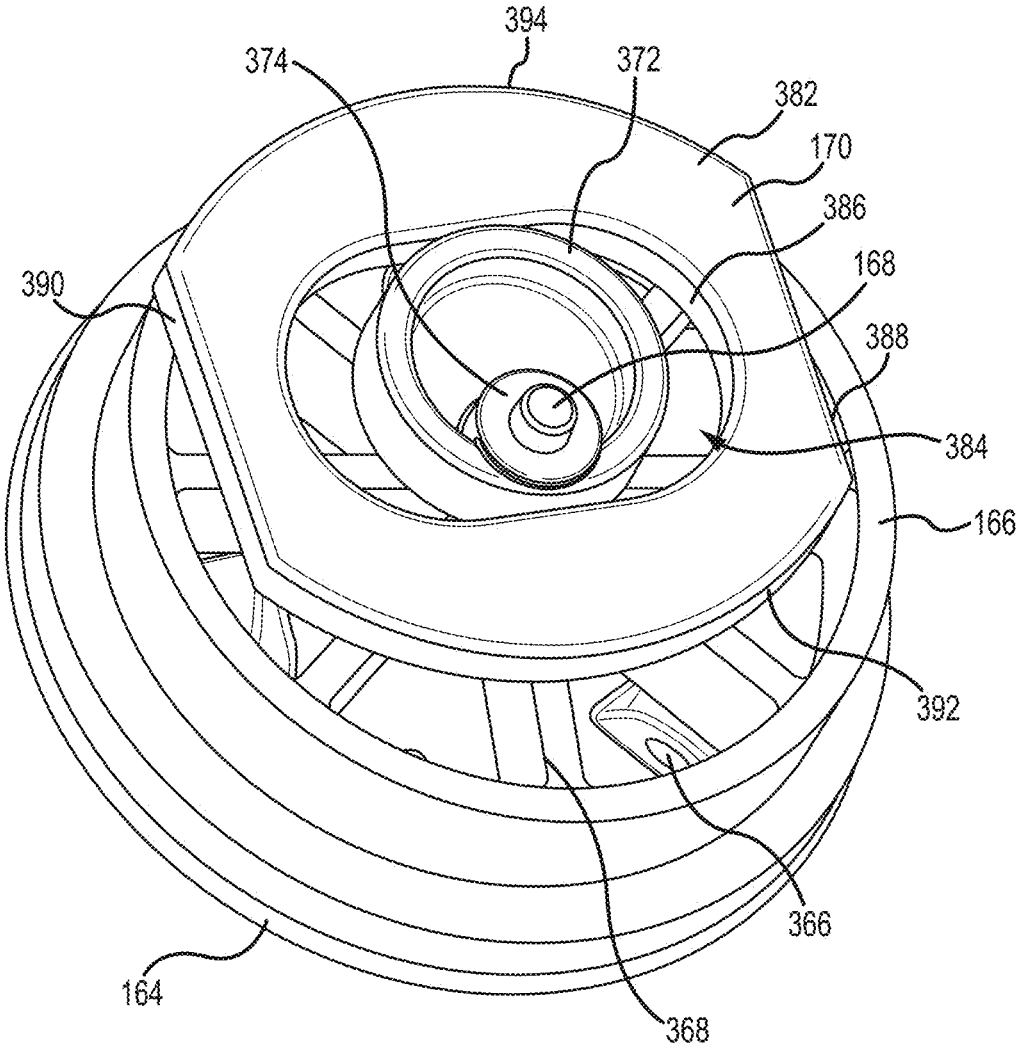
FIG. 12 is a bottom isometric view of the massage mode assembly of FIG. 10.

The massage mode assembly 152 will now be discussed in more detail. FIG. 10 is a top perspective view of the massage mode assembly 152. FIG. 11 is a cross-sectional view of the massage mode assembly 152 taken along line 11-11 in FIG. 10. FIG. 12 is a bottom isometric view of the massage mode assembly 152 of FIG. 10. With reference to FIGS. 2, 10, and 11, the massage mode assembly 152 may include a jet plate 164, a pin 168, a turbine 166, and a shutter 170. Each of these components will be discussed in turn below.

The jet plate 164 forms a top end of the massage mode assembly 152 and may be a generally planar disc having a plurality of inlet jets 354, 356, 358. The inlet jets 354, 356, 358 are raised protrusions that extend upward and at an angle from the top surface 352 of the jet plate 164. Each inlet jet 354, 356, 358 includes an inlet aperture 366 providing fluid communication through the jet plate 164. A plurality of pressure apertures 362 may be defined through the jet plate 164 and spaced apart from the inlet jets 354, 356, 358.

With reference to FIGS. 10 and 11, the jet plate 164 may also include an anchor column 360 extending upward from the top surface 352. The anchor column 360 may be at least partially hollow to define a cavity configured to receive the pin 168 (see FIG. 11). Additionally, the jet plate 164 may include a rim 364 extending upward from the top surface 352 along the outer perimeter edge of the top surface 352.

Figure 13A:
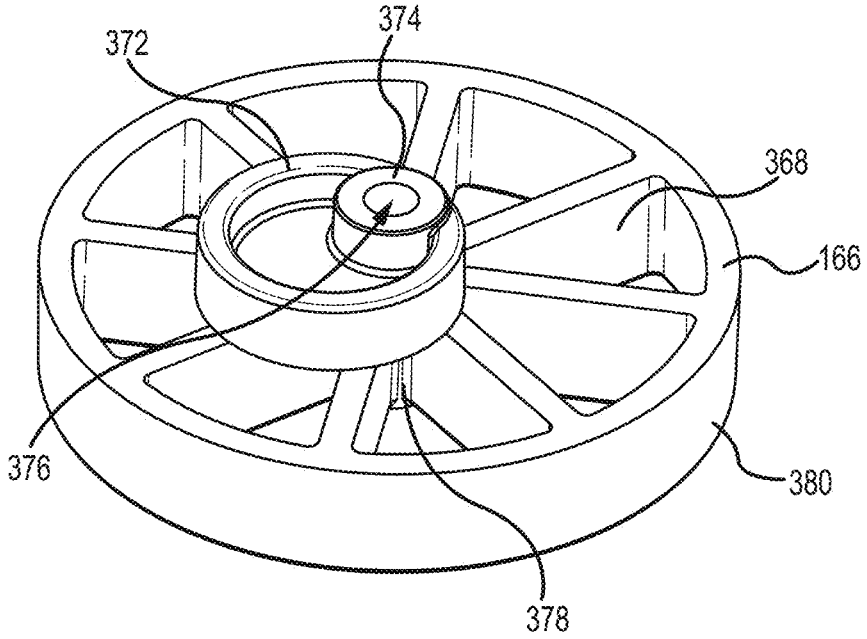
FIG. 13A is a bottom isometric view of a turbine for the massage mode assembly.
Figure 13B:
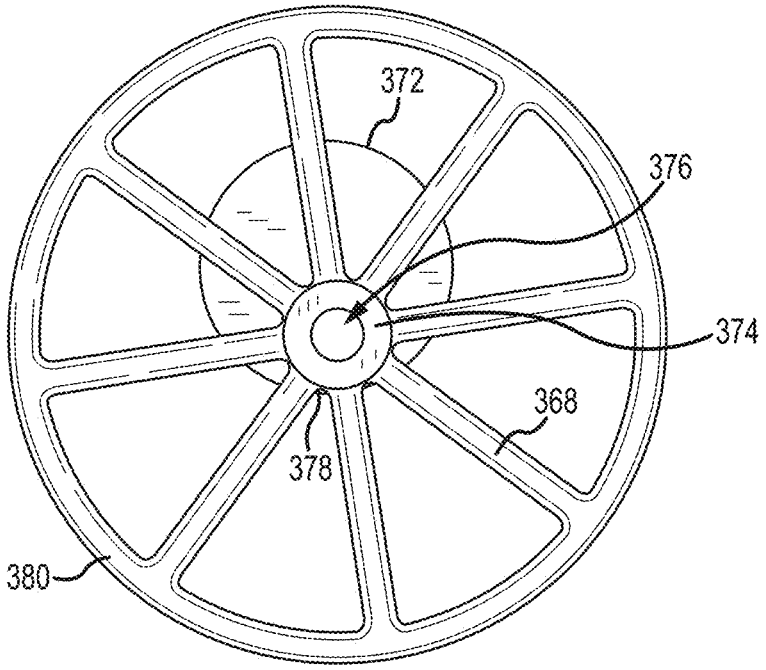
FIG. 13B is a top plan view of the turbine of FIG. 13A.

The turbine 166 of the massage mode assembly 152 will now be discussed. FIGS. 13A and 13B are various views of the turbine. The turbine 166 may be a generally hollow open-ended cylinder having blades 368 extending radially inward toward a central hub 378 from a generally circular turbine wall 380. The turbine wall 380, or portions thereof, may be omitted in some embodiments. Additionally, although eight blades 368 have been illustrated, the turbine 166 may include fewer or more blades 368. The turbine 166 may include a pin-shaped extrusion 374 extending generally through the hub 378. The pin shaped extrusion 374 may extend slightly upward from the upper side of the turbine 166 and downward from the lower side of the turbine 166. A pin aperture 376 is defined longitudinally through the pin-shaped extrusion 374 and has a diameter corresponding to a diameter of the pin 168.

Figure 31:
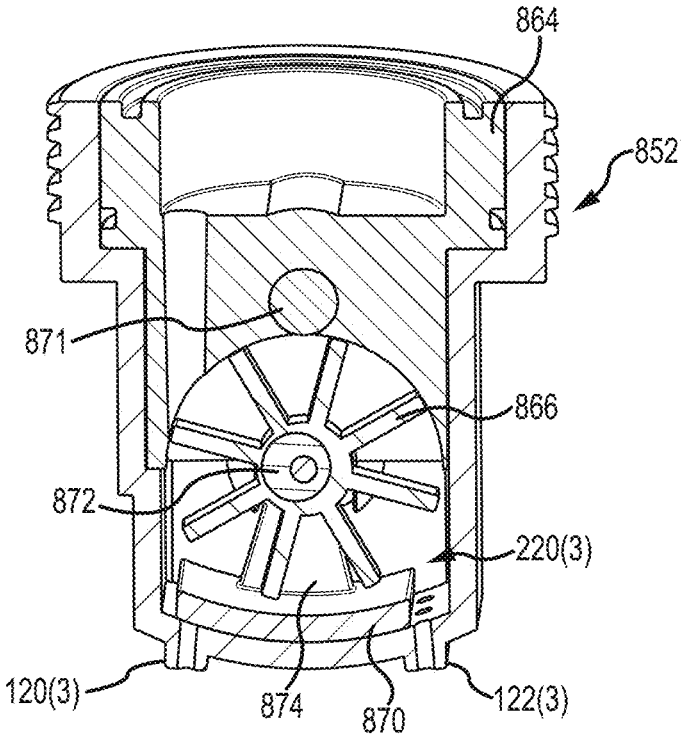
FIG. 31 is a cross-section view of the massage mode assembly of FIG. 30 taken along line 31-31 in FIG. 30.

The turbine 166 may also include an eccentric cam 372 on its lower side (i.e., the downstream side of the turbine 166). The cam 372 is positioned off-center from the hub 378 and is formed integrally with the turbine 166. In one embodiment, the cam 372 includes a cylindrically shaped disc that is offset from the center of the turbine 166. In other embodiments, the cam 372 may be otherwise configured and may be a separate component connected to or otherwise secured to the turbine 166. (See, e.g., FIG. 31 illustrating alternative examples of the cam and turbine structure).

With reference to FIG. 12, the shutter 170 will now be discussed in more detail. The shutter 170 or shoe includes a shutter body 382 having a cam aperture 384 defined therethrough. The shutter body 382 is a solid section of material (other than the cam aperture 384), which allows the shutter 170 to selectively block fluid flow to outlets when positioned above those outlets. The cam aperture 384 may be a generally oval-shaped aperture defined by an interior sidewall 386 of the shutter body 382. The width of the cam aperture 384 is selected to substantially match the diameter of the cam 372 of the turbine 166. However, the length of the cam aperture 384 is longer than the diameter of the cam 372.

With continued reference to FIG. 12, the shutter 170 may be a substantially planar disc having a generally oval shaped body 382 but with two parallel constraining edges 388, 390 formed on opposing ends. In particular, the shutter body 382 may have two relatively straight constraining edges 388, 390 formed at opposite ends from one another and two curved edges 392 formed on opposite sides from one another. In one embodiment, the curved ends 392 form the longitudinal edges for the shutter body 382 and the constraining edges 388, 390 form the lateral edges. However, in other embodiments, the shutter 170 may be otherwise configured.

As briefly mentioned above with respect to FIG. 2, the showerhead 100 may also include a mist plug ring 156. The mist plug ring 156 creates a mist output from the showerhead 100 nozzles, in particular the second nozzle group 112. With reference to FIGS. 2 and 14, the mist plug ring 156 may include a plurality of mist plugs 418 interconnected together on a ring 420. There may be a mist plug 418 for every mist outlet 422 in the second nozzle group 112. The mist plugs 418 may have a "Z" shape configured to seat against some portions of the sidewall of the mist nozzle chamber 226, but not fill the entire chamber 226. In particular, the stepped or notched edges on either side of the mist plugs 418 provide a gap between the sidewall of the chamber 226 and the plug 418 to allow water to flow into the chamber 226 and through the outlet 422. As will be discussed in more detail below, the mist plugs 418 create a varying fluid flow within the mist chamber 226 that creates a misting characteristic for the water outflow.

In some embodiments, the variation in geometry within the mist chambers 226 caused by the shape of the mist plugs 418 may be achieved by varying the geometry the mist chambers 226 themselves. That is, the mist chambers 226 can be modified so that the chambers 226 includes a geometry that changes one or more characteristics of the fluid flow through the chamber, such as inducing a spin, to create a desired output characteristic for the water. However, it should be noted that in embodiments where the variation in the geometry of the mist chambers 226 is created due to the inserted mist plug ring 156, the showerhead 100 may be manufactured at less cost than in instances where the geometry change is done by varying the chamber itself.

Figure 15:
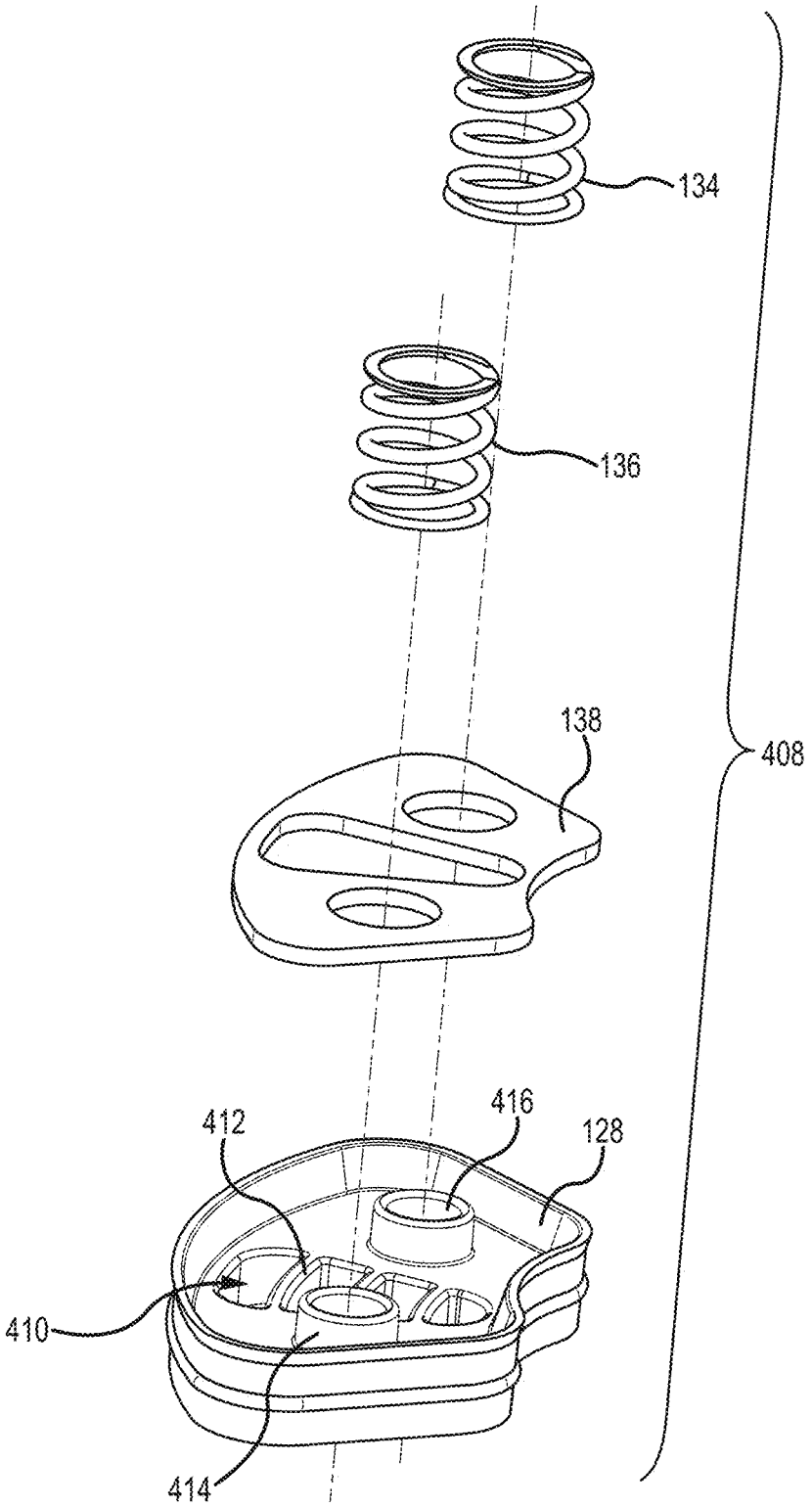
FIG. 15 is an exploded view of a selecting assembly for the showerhead of FIG. 1A.

The mode selection assembly 408 will now be discussed in more detail. FIG. 15 is an enlarged view of a portion of the exploded view of FIG. 2 illustrating the mode selection assembly 408. With reference to FIG. 15, the mode selection assembly 408 may include biasing members 134, 136, a seal support 138, and a mode seal 128. The mode seal 128 is shaped to correspond to the seal cavity 350 in the mounting plate 144 and is configured to seal against the top surface of the back plate 146, which allows a user to selectively direct fluid flow form the handle to a particular set or group of nozzles of the showerhead 100. For example the mode seal 128 may be a sealing material, such as rubber or another elastomer, and may include a mode select aperture 410 define therethrough. In this manner, the mode seal 128 can be aligned with a particular mode aperture to fluidly connect the handle 102 to the engine 128 and to a particular mode aperture within the engine 128, while sealing the other mode apertures into the engine 128. In some embodiments, the mode select aperture 410 may be configured to substantially match the configuration of the mode apertures 284, 286, 288, 290 and so may include a plurality of support ribs 412 spanning across the width of the aperture 410. However, in other embodiments the ribs 412 may be omitted. The mode seal 128 may also include first and second spring columns 414, 416 extending upward from a top surface thereof.

The seal support 138 provides additional rigidity and structure to the mode selection assembly 408, in particular, to the mode seal 128. The seal support 138 may be, for example, a rigid material such as plastic, metal, or the like. The structure provided by the seal support 138 assists the seal 128 in maintaining a sealed relationship with the back plate 146 when under water pressure. In some embodiments, the seal support 138 may substantially match the configurations of the mode seal 128 and may include apertures for the spring columns 414, 416 and mode select aperture 410. Although the seal support 138 is shown as a separate component from the mode seal 128, in other embodiments, the seal support 138 may be integrated to the structure of the mode seal 128.

Assembly of the Showerhead

With reference to FIGS. 2 and 4, assembly of the showerhead 100 will now be discussed in more detail. At a high level the engine 126 is assembled and then connected to the spray head 104 as will be discussed in more detail below. To assemble the engine 126, the massage mode assembly 152 is assembled and then the flow directing plates, i.e., the front plate 148, the inner plate 146, and the back plate 146, are connected together with the nozzle ring 154 and mist ring 156 connected to the respective plates. In particular, with reference to FIG. 11, the pin 168 of the massage assembly 152 is received into the corresponding aperture in the anchor column 360 of the jet plate 164. The pin-shaped extrusion 374 of the turbine 166 is then slid around the pin 168. The turbine 166 is oriented so that the cam 372 is located on the opposite side of the turbine 166 that faces the jet plate 164. With the turbine 166 and jet plate 164 connected via the pin 168, the shutter 170 is connected to the turbine 166. Specifically, the cam 372 of the turbine is positioned within the cam aperture 384 of the shutter 170.

Once the massage mode assembly 152 has been constructed, the massage mode assembly 152 is connected to the face plate 148 and is received within the massage chamber 220. With reference to FIGS. 2, 4, 6B, and 11, the pin 168 is positioned within the pin recess 224 on the shelf 228 of the face plate 148. The shutter 170 is oriented such that the constraining edges 388, 390 are parallel to the curb walls 222 of the face plate 148. The curved walls 392, 394 of the shutter 170 align with the curved walls of the massage chamber 220. As shown in FIG. 4, the turbine 166 is received within the massage chamber 220 so as to be positioned below a top edge of the annular wall 236 of the massage chamber 220 and the bottom edge of the jet plate 164 seats on top of the annular wall 236. The annular wall 236 supports the jet plate 164 and prevents the jet plate 164 from frictionally engaging the top of the turbine 166 to help ensure that the turbine 166 has clearance from the jet plate 164 to allow the turbine 166 to rotate without experiencing frictional losses from engagement of the jet plate 164. The spacing gap between the turbine 66 and the jet plate 164, as determined by the height of the annular wall 236, may be varied as desired.

In the embodiment shown in FIG. 4, the turbine inlets 354, 356, 358 are on a top surface of the jet plate 164 so that the inlets 354, 356, 358 do not interfere with the motion of the turbine 166. However, in other embodiments, the inlets 354, 356, 358 may be positioned on a bottom surface of the jet plate 164 and the turbine 166 may be spaced a greater distance away from the jet plate 164 than as shown in FIG. 4 so as to allow further clearance between the top of the turbine 166 and the turbine jet inlets 354, 356, 358. It should be noted that the jet plate 164 may be press fit against the sidewalls of the third ring wall 234 so that the jet plate 164 is secured in position and the jet plate 164 helps to secure the pin 168 in position within the pin recess 224. This configuration secures the massage mode assembly 152 to the facet plate 148, while still allowing the turbine 166 to rotate within the massage chamber 220.

With reference to FIGS. 4, 6B, and 14, once the massage mode assembly 152 is positioned within the massage chamber 220, the mist plug ring 156 is connected to the face plate 148. In one embodiment, the mist plugs 398 are received in the respective nozzle chambers 226, with the bottom end of each mist plug 398 raised above the shelf 228 surround the nozzle outlet 396. As discussed above with respect to FIG. 14, the mist plugs 398 are configured so that water can flow around the mist plugs 398 and into the chamber 226 and out through the mist outlets 396 as will be discussed in more detail below.

In some embodiments the mist plugs 398 may be interconnected together by the ring 420 of webbing. In these embodiments, the mist plugs 398 may be easier to handle and assemble than if they were individual plugs that were not interconnected. For example, a user assembling the showerhead 100 can pick up the ring 420, which may be easier to handle than the individual plugs 398, and then press fit each plug 398 into its respective chamber 226. The webbing forming the interconnections between the mist plugs 398 in the ring 420 may also rest on the upper rims of each of the chambers 226. The length of the mist plugs 398 below the webbing of the ring 420 may not be as long as the depth of the chambers 226. The bottoms of the mist plugs 398 are thereby spaced apart from the shelf 228 in each of the chambers 226.

After the mist plug ring 156 is connected to the face plate 148, the inner plate 158 may be connected to the face plate 148. With reference to FIGS. 4, 6B-7B, the inner plate 158 is coaxially aligned with the face plate 148 and the massage aperture 252 is positioned over the massage chamber 220 so as to allow fluid communication to the massage chamber 220 although the inner plate 158 is positioned above the face plate 148.

The front surface 238 of the inner plate 158 is aligned so as to face the back surface 194 of the face plate 148. The outer wall 242 of the inner plate 158 sits on top of the first ring wall 230 of the face plate 148 and the first ring wall 244 of the inner plate 158 sits on top of engages the second ring wall 232 of the face plate 148. The engagement between the outer wall 242 and first ring wall 244 of the inner plate 158 with the first ring wall 230 and second ring wall 232, respectively, of the face plate 148 defines a second fluid channel 398 (see FIG. 4). That is, the engagement of the walls of the face plate 148 and inner plate 158 fluidly connects the first flow path 248 of the inner plate 158 and the second flow path 214 of the face plate 148 to define the fluid channel 398 within the showerhead 100.

Similarly, the first ring wall 244 and the second ring wall 246 of the inner plate 158 engage with the second ring wall 232 and third ring wall 234 of the face plate 148 to define a third fluid channel 400, which is formed by the second flow path 250 of the inner plate and the third flow path 216 of the face plate 148.

The two fingers 260, 262 of the inner plate 158 jut out over the massage chamber 220 and the massage mode assembly 152. However, due to the separating walls 264, 266, 268, fluid can be selectively distributed to one or more fluid channels either individually or in combination with one another, as discussed in more detail below.

With reference to FIGS. 4, 6A-8B, once the inner plate 158 has been aligned with and connected to the face plate 148, the back plate 146 is connected to the inner plate 158 and face plate 148. In particular, the perimeter wall 296 of the back plate 146 is aligned with perimeter wall 206 of the face plate 148 so as to engage one another. In this manner, the back plate 146 may be configured so that the back side 276 will be positioned above stream from the front side 278 of the back plate 146.

The first ring wall 298 of the back plate 146 engages the top surface of the outer wall 242 of the inner plate 158. Thus, the combination of the back plate 146, the inner plate 158, and the front plate 148 defines a first fluid channel 396 (see FIG. 4). Additionally, the second ring wall 300 of the back plate 146 engages the first ring wall 244 of the inner plate 158 to define an upper second mode channel 404 (see FIG. 4). As will be discussed in more detail below, the first apertures 254 of the first flow path 248 of the inner plate 158 fluidly connect the upper second mode channel 404 to the second mode channel 398 defined by the face plate 148 and the inner plate 158.

With continued reference to FIGS. 4, 6A-8B, the third ring wall 302 of the back plate 146 engages the second ring wall 246 of the inner plate 158 so that the engagement of the first and second ring walls 244, 246 of the inner plate 158 with the second and third ring walls 300, 302, respectively, of the back plate 146 define an upper third mode channel 406. The upper third mode channel 406 is fluidly connected to the third mode channel 400 via the second set of apertures 256 of the inner plate 158, as will be discussed in more detail below.

The second ring wall 246 of the inner plate 158 and the third ring wall 302 of the back plate 146 define the forth mode channel 402 (see FIG. 4). The fourth mode channel 402 is fluidly connected to the massage mode assembly 152.

The separating walls 264, 266, 268 of the inner plate 158 engage with the respective separating walls 304, 306, 308 of the back plate 146 to define the various distribution channels for each mode of the showerhead. For example, separating wall 268 of the inner plate 158 engages with separating wall 306 of the back plate 146, separating wall 264 of the inner plate 158 engages with separating wall 304 of the back plate 146, and separating wall 266 of the inner plate 158 engages with separating wall 308 of the back plate 146.

Due to the engagement between the inner plate 158 and the back plate 146, the first mode aperture 284 is fluidly connected to the fourth mode channel 404, the second mode aperture 286 is fluidly connected to the first mode channel 396, the third mode aperture 288 is fluidly connected to the fourth mode channel 402, and the fourth mode aperture 290 is fluidly connected to the upper third mode channel 406. In this example, the first mode aperture 284 corresponds to a mist mode, the second mode aperture 286 corresponds to a full body mode, the third mode aperture 288 corresponds to a massage mode, and the fourth mode aperture corresponds to a focused spray mode. However, the above mode examples are meant as illustrative only and the types of modes, as well as the correspondence between particular mode apertures may be varied as desired.

The face plate 148, inner plate 158, and the back plate 146 may be connected together once assembled. For example, the plates 146, 148, 158 may be fused such as through ultrasonic welding, heating, adhesive, or other techniques that secure the plates together. Once secured, the face plate 148, inner plate 158, and back plate 146, along with the massage mode assembly 408, form the engine 126 of the showerhead 100. This allows the engine 126 to be connected to the spray head 104 as a single component, rather than individually attaching each of the plates. Additionally, the connection between each of the plates may be substantially leak proof such that water flowing through each of the channels within plates is prevented from leaking into other channels.

Once the back plate 146 is connected to the inner plate 158, the mounting plate 144 and the mode selection assembly 408 may be connected to the back plate 146. With reference to FIGS. 2, 4, 8A, 9A-9B, and 15, the first and second biasing members 134, 136 are received around the first and second spring columns 346, 348, respectively, of the mounting plate 144. The biasing members 134, 136 are then received through the corresponding biasing apertures in the seal support 138. The mode seal 128 is then connected to the biasing members 134, 136 as the biasing members 134, 136 are received around the spring columns 414, 416 of the mode seal 128. The mode seal 128 is then positioned within the seal cavity 350 of the mounting plate 144.

In embodiments where the showerhead 100 includes a feedback feature, the spring 140 is received around a portion of the plunger 142 and the plunger and spring are received into the detent pin cavity 342 of the mounting plate 144. The spring 140 is configured to bias the plunger 142 against the back side 276 of the back plate 146.

After the mode selection assembly 408 and the plunger 142 and spring 140 are connected to the mounting plate 144, the mounting plate 144 is connected to the spray head 104. An O-ring 150 is received around the outer surface of the engagement wall 338 of the mounting plate 144. The fasteners 132*a*, 132*b*, 132*c*, 132*d* are then received through the fastening apertures 334 in the mounting plate 144 and secure into corresponding fastening posts (not shown) extending from a surface within the spray head 104 and/or handle 102. The fasteners 132*a*, 132*b*, 132*c*, 132*d* secure the mounting plate 144 to the showerhead 100.

Once the mounting plate 144 is connected to the spray head 104, the engine 126 may be connected to the mounting plate 144. In particular, the brim 330 of the mounting plate 144 is received within the locking band 282 and the fingers 318 flex to allow the brim 330 to be positioned within the locking band 282 and then snap-fit around the edge of the brim 330. The lips 320 on each of the fingers 318 extend over a portion of the brim 330 (see FIG. 4) to grip the brim 330. Because the engine 126 is secured together as a single component, the engine 126 can be quickly attached and detached from the spray head 104 by snap-fit connection to the mounting plate 144. It should be noted that the fingers 318 may allow the engine 126 to rotate relative to the mounting plate 144, so as to allow the user to selectively change the mode of the showerhead 100. However, the lips 320 prevent the engine 126 from separating from the mounting plate 144, even under water pressure.

With reference to FIGS. 2, 4, and 5, once the engine 126 is connected to the mounting plate 144, the nozzle ring 154 is received into the cover 150 and the individual rubber nozzles are inserted into respective nozzle apertures 178. In some embodiments only certain modes may include rubber nozzles and in these embodiments, the nozzle ring 154 may correspond to a particular mode. However, in other embodiments, every mode may have rubber nozzles and/or may be associated with the nozzle ring. In embodiments where the nozzles are formed through the rubber nozzle ring 154, the nozzles may be more easily cleaned. For example, during use, the nozzles may be become clogged with sediment or calcification of elements from the water supply source. With rubber nozzles, the nozzles can be deformed or bent to break up the deposits and which are flushed out of the nozzles, whereas with non-flexible nozzles, the nozzles may have to be soaked in a chemical cleaning fluid or cleaned through another time consuming process.

With reference to FIGS. 2, and 4-6B, the cover 150 may be secured to the engine 126. In particular, the face plate 148 is positioned within the cover chamber 170 with the respective nozzle groups aligning with the respective nozzle apertures in the cover 150. The alignment brackets 174 are connected to the face plate 148 as the locking tabs 208, 210 are received through the bracket apertures 176 in the cover 150. The locking tabs 208, 210 connect the engine 126 to the cover 150 so that as the cover 150 is rotated, the engine 126 will rotate correspondingly. For example, as a user turns the mode selector 118, the alignment brackets 174 will engage the tabs 208, 210 to move the engine 126 along with the cover 150.

With reference to FIGS. 2 and 3, the regulator 160 and filter 162 may be received at the threaded end of the handle 106 and secured to the handle 102. Once the cover 150 is secured to the engine 126 (and thereby to the spray head 104), and the filter 162 and regulator 160 (if included) are connected, the showerhead 100 is ready to be connected to a water supply, e.g., J-pipe or other fluid source, and be used.

Operation of the Showerhead

The operation of the showerhead 100 will now be discussed in more detail. With reference to FIGS. 2-4, water enters the showerhead 100 through the inlet 108 in the handle 102 or, in instances when the showerhead 100 is a fixed or wall mount showerhead, directly through an inlet to the spray head 104. As the water enters, the water travels through the inlet conduit 172 to the spray head chamber 175. The spray head chamber 175 is fluidly connected to the engine inlet 336 in the mounting plate 144. The fluid flows through the engine inlet 336 and through the mode select aperture 410 of the mode seal 128 that is aligned with the engine inlet 336. The fluid path of the water after it flows through the mode select aperture 410 depends on the alignment of the engine 126, in particular the back plate 146, with the mode selection assembly 408.

For example, during a first mode, such as a fully body spray mode, the mode seal 128 may be aligned such that the mode select aperture 410 is positioned directly over the second mode aperture 286 of the back plate 146. Fluid flows through the mode select aperture 410, through the second mode aperture 286 and into the first mode channel 396. The sealing material of the mode seal 128 prevents fluid from flowing into other mode channel apertures. From the first mode channel 396, the fluid exits through the outlets 200 in the face plate 148 and into the rubber nozzles of the nozzle ring 154 and out through the cover 150.

During a second mode, such as a mist mode, the engine 126 is rotated via the mode selector 118 to a position where the mode seal 128 is aligned with the first mode aperture 284. In this example, the mode select aperture 410 of the mode seal 128 is aligned directly with the first mode aperture 284 to fluidly connect the spray head chamber 175 with the upper second mode channel 404. As water flows into the upper second mode channel 404, the water flows through first apertures 254 in the inner plate 158 into the second mode channel 398. From the second mode channel 398, the fluid flows around the mist plugs 418 into the nozzle chamber 226. The shape of the mist plugs 418 causes the water to spin, prior to exiting the mist outlets 422. The spinning of the water causes a misting spray characteristic where the water appears as a fine mist and the droplets are reduced in size.

During a third mode, such as a focused spray, the engine 126 is rotated so that the mode select aperture 410 of the mode seal 128 is aligned with the fourth mode aperture 290. In this example, the fluid flows from the spray head chamber 175 through the fourth mode aperture 290 into the upper third mode channel 406. The fluid flows into the third mode channel 400 by flowing through the second apertures 256 in the inner plate 158. Once in the third mode channel 400, the fluid exits the showerhead through the second group of nozzles 114 of the face plate 148.

During a fourth mode, such as a massage mode, the engine 126 is rotated so that the mode select aperture 410 of the mode seal 128 is aligned with the third mode aperture 288 of the back plate 146. Fluid flows from the spray head chamber 175 into the fourth mode channel 402. Once in the fourth mode channel 402, the fluid impacts the jet plate 164. With reference to FIGS. 4, 10, and 11, as the water impacts the jet plate 164, the water enters the inlet apertures 366 and optionally the pressure apertures 362. As the water flows through the inlet apertures 366, it impacts the blades 368 of the turbine 166. As the water hits the blades 368 of the turbine 166, the turbine 166 spins around the pin 168, which is secured to the face plate 148.

Figure 16A:
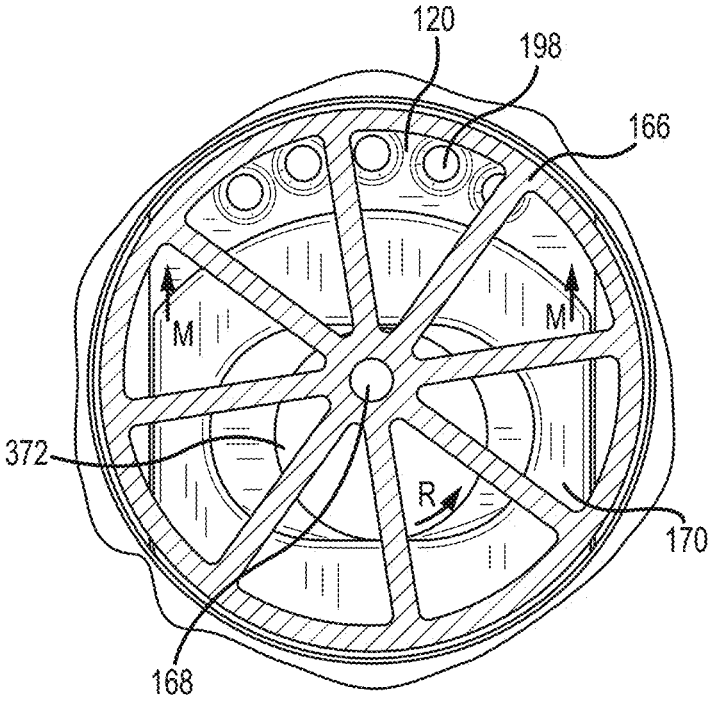
FIG. 16A is an enlarged cross-section view of the massage mode assembly with the shutter in a first position.
Figure 16B:
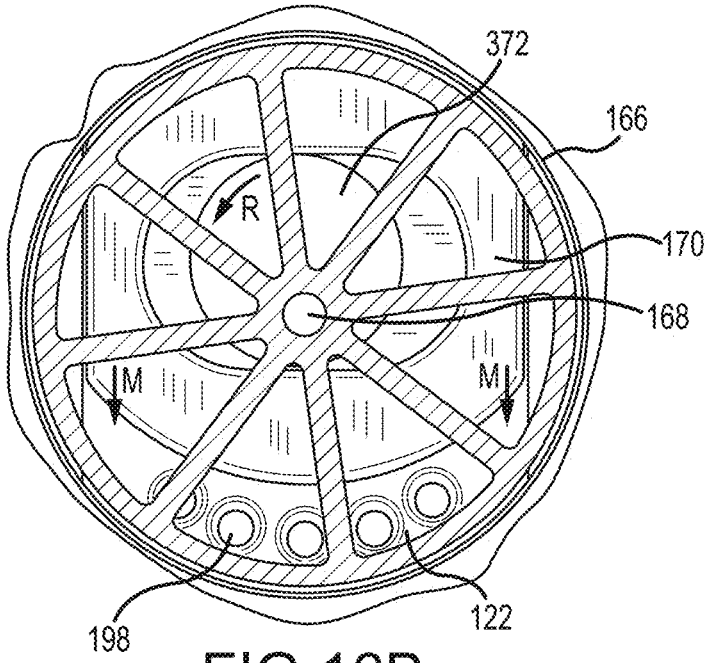
FIG. 16B is an enlarged cross-section view of the massage mode assembly with the shutter in a second position.

FIG. 16A is an enlarged cross-section view of the showerhead 100 illustrating the shutter 170 in a first position. FIG. 16B is an enlarged cross-section view of the showerhead illustrating the shutter 170 in a second position. With reference to FIGS. 4, 10-12, and 16A-16B, as the turbine 166 rotates, the cam 372 moves correspondingly. As the cam 372 is rotated, the cam 372 abuts against the interior sidewall 386 of the shutter 170 and moves the shutter 170. Due to the eccentricity of the cam 372, the shutter 170 moves around a center axis of the turbine 166. However, the movement of the shutter 170 is constrained by the curb walls 222 as they engage the constraining edges 388 of the shutter 170. As such, as the cam rotates 372 the shutter 170 is moved substantially linearly across the massage chamber 220 in a reciprocating pattern. In particular, the curb walls 222 restrict the motion of the shutter 170 to a substantially linear pathway.

For example, as shown in FIG. 16A, as the cam 372 rotates in the R direction, the shutter 170 moves in the linear movement M direction across the massage chamber 220. In this position, fluid flows from the jet plate 164 through the open spaces between each of the turbine blades 368, past the shutter 170 to the first nozzle bank 120. Due to the substantially linear motion of the shutter 170, each of the massage outlets 198 in the first bank 120 open substantially simultaneously. Water exits the face plate 148 through the first bank 120 at substantially the same time.

With reference to FIG. 16B, as the turbine 166 continues to rotate, the cam 372 continues to move in the R direction, which causes the shutter 170 (due to the curb walls 222) to move substantially in the linear movement direction M, but toward the opposite sidewall of the massage chamber 220. As the shutter 170 moves to the second position, each of the nozzles of the first bank 120 are covered at substantially the same time and each of the nozzles of the second bank 122 are uncovered or opened at substantially the same time. This causes the water flow through each outlet 198 in a particular nozzle bank 120, 122 to start and stop simultaneously, creating a "hammer" or more forceful effect. That is, rather than the outlets 198 in a particular nozzle bank 120, 122 opening and closing progressively, as is done in conventional massage mode showerheads, the nozzle banks 120, 122 operate in a binary manner where each bank 120, 122 is either "on" or "off" and in the "on" state every outlet is open and in the "off" state every outlet is closed.

The intermittent opening and closing of the outlets in each nozzle bank 120, 122 creates a massaging spray characteristic. In particular, the water flows out the first bank 120 and the flows out the second bank 122 and as it impacts a user creates a forceful hammer type effect. The water flow is instantly started and stopped, which creates a more powerful massaging effect. The binary effect allows the massage force to feel more powerful, which allows the showerhead 100 to use a reduced water flow rate and still produce a massaging experience that replicates showerheads with an increased water flow rate.

As briefly described above, the user can selectively change the mode of the showerhead 100 by rotating the mode selector 118. With reference to FIG. 4, as the user rotates the mode selector 118, the cover 150 engages the tabs 208 on the face plate 148 and rotates the engine 126 therewith. As the engine 126 rotates within the spray head 104, the back plate 146 rotates relative to the mode seal 128 and plunger 142.

As the back plate rotates 146, the force of the user overcomes the spring force exerted by the spring 140 on the plunger 142 and the biasing members 134, 136 to move the back plate 146. As the user rotates the mode selector 118, the plunger 142 compresses the spring 140 and disengages from a first detent recess 292. When the back plate 146 has been sufficiently rotated to reach a second detent recess 292, the spring 140 biases the plunger 142 into the detent recess 292. This allows a user to receive feedback, both haptically and optionally through a clicking or mechanical engagement sound, so that the user will know that he or she has activated another mode. In one embodiment, as will be discussed below, the mode seal 128 may be positioned to span across two mode apertures 284, 286, 288, 290 so that two modes of the showerhead 100 may be activated at the same time. In this embodiment, the back plate 146 may include a detent recess 292 for every separate mode and every combination mode, i.e., for four discrete modes there may be seven detent recesses. However, in other embodiments, the combination modes may not have detents associated therewith and/or there may be fewer or more detents and modes for the showerhead.

Additionally, as the back plate 146 rotates due to the user's rotation of the mode selector 118, the mode seal 128 is positioned at various locations along the back plate 146. The mode seal 128 may directly align with one or more of the mode apertures 284, 286, 288, 290 to activate a single mode. Alternatively, the mode seal 128 may be positioned such that the mode select aperture 410 is fluidly connected to two of the mode apertures 284, 286, 288, 290. For example, the mode seal 128 may be positioned between two of the apertures so that a portion of each aperture is sealed and a portion is opened. In this configuration, the water may flow through two mode apertures 284, 286, 288, 290 simultaneously, activating two modes of the showerhead 100 at the same time. The combination modes may be limited to the modes having mode apertures 2984, 286, 288, 290 positioned adjacent to one another or, in other embodiments, the seal 128 may be varied or the showerhead may include two or more mode seals which may allow for the showerhead 100 to activate two or more modes that do not have mode apertures adjacent one another.

In an embodiment where the back plate 146 includes the stop bump 294 received into the stop cavity 344 of the mounting plate 144, the stop bump 294 may rotate within the stop cavity 344 as the user rotates the engine 126. The stop cavity 344 may be configured to provide a "hard stop" to the user to limit the range that the mode selector 118 can rotate. In particular, the rotation may be determined by the arc length of the stop cavity 344. As the engine 126 is rotated by the mode selector 118, the stop bump 294 travels within the cavity 344 until it reaches an end of the cavity 344. Once the stop bump 294 reaches an end of the cavity 344, the engagement of the stop bump 294 against the cavity walls prevents the user from further rotating the mode selector 118. The hard stop helps to prevent damage to the showerhead 100 as a user cannot over-rotate the mode selector 118 past a desired location.

Engine Release and Mode Variation Examples

Alternative examples of the engine release and attachment and mode apertures will now be discussed. FIGS. 17A-22B illustrate another example of a showerhead of the present disclosure having another example of a releasable engine and multiple spray modes of a different configuration than the showerhead of FIGS. 1A and 1B. In the below examples, like numbers are used to describe features that are substantially similar to those in the showerhead of FIGS. 1A and 1B. Additionally, any features not specifically identified below are the same as or similar to features of the showerhead of FIGS. 1A and 1B.

Figure 17A:
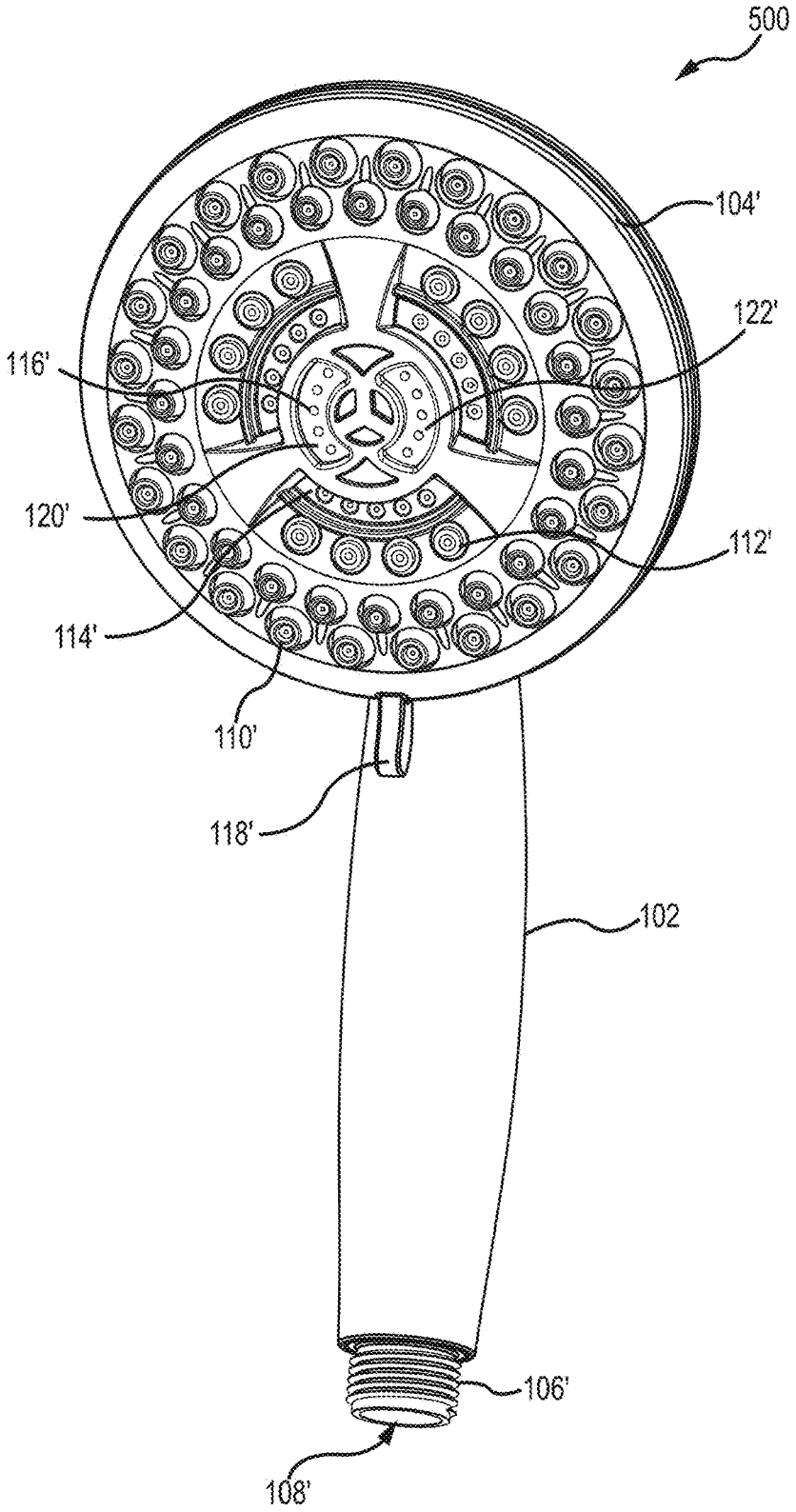
FIG. 17A is an isometric view of a second example of a showerhead including the massage mode assembly.
Figure 17B:
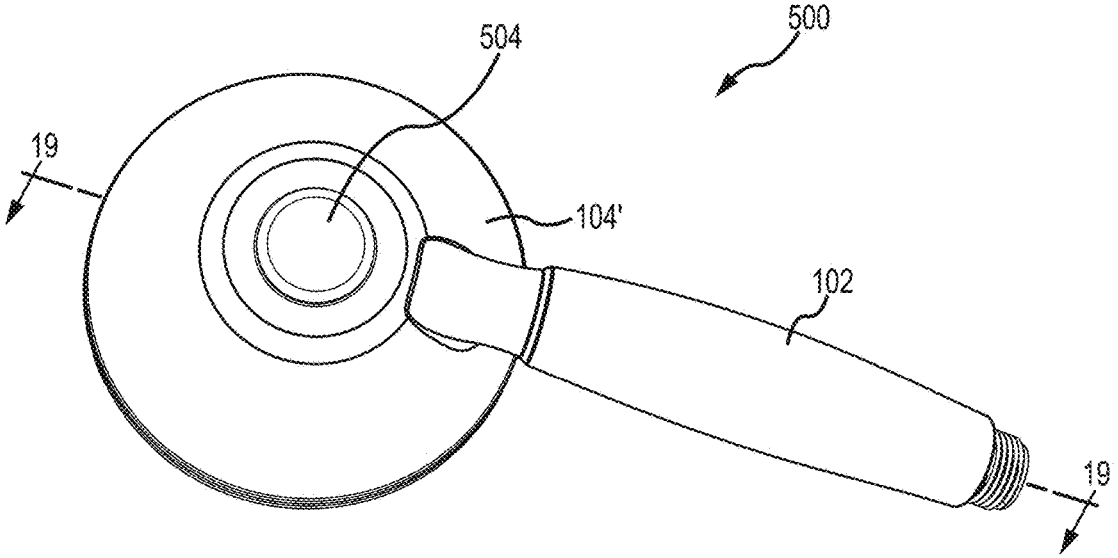
FIG. 17B is a rear isometric view of the showerhead of FIG. 17A.
Figure 18:
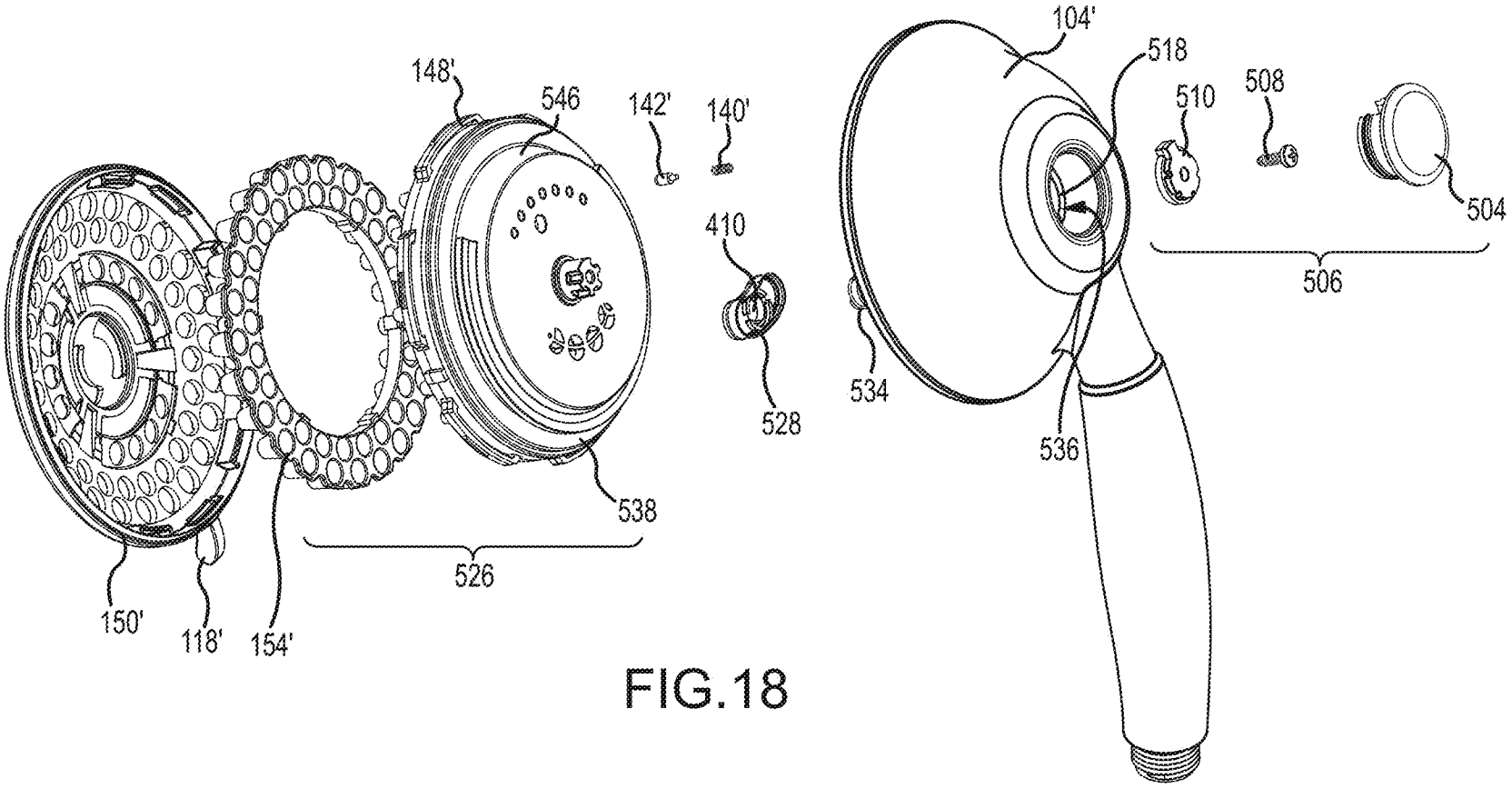
FIG. 18 is an exploded view of the showerhead of FIG. 17A.
Figure 19:
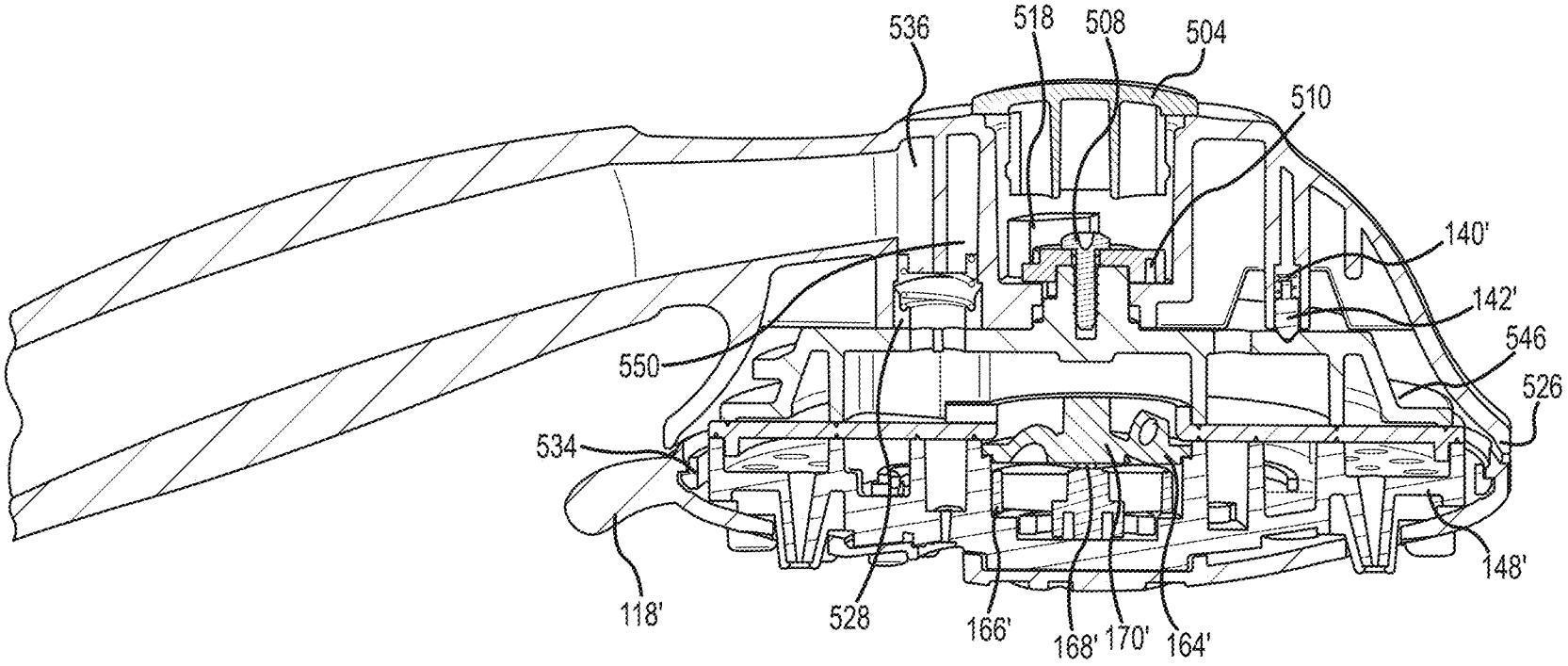
FIG. 19 is a cross-section view of the showerhead of FIG. 17A taken along line 19-19 in FIG. 17B.

FIGS. 17A and 17B are various isometric views of another example of a showerhead of the present disclosure. FIG. 18 is an exploded view of the showerhead of FIGS. 17A and 17B. FIG. 19 is a cross-sectional view of the showerhead taken along line 19-19 in FIG. 17B. With reference to FIGS. 17A-19, the showerhead 500 may be substantially the same as the showerhead 100 of FIG. 1A. However, the showerhead 500 may include another example of an engine release and back plate as compared to the showerhead 100. In particular, the showerhead 500 may include an engine release assembly 506. The engine release assembly 506 may be used to selectively secure and release the engine 526 from the spray head 104. Additionally, the engine 526 may include another example of a back plate 546 and the mounting plate may be omitted in this showerhead example.

Figure 20A:
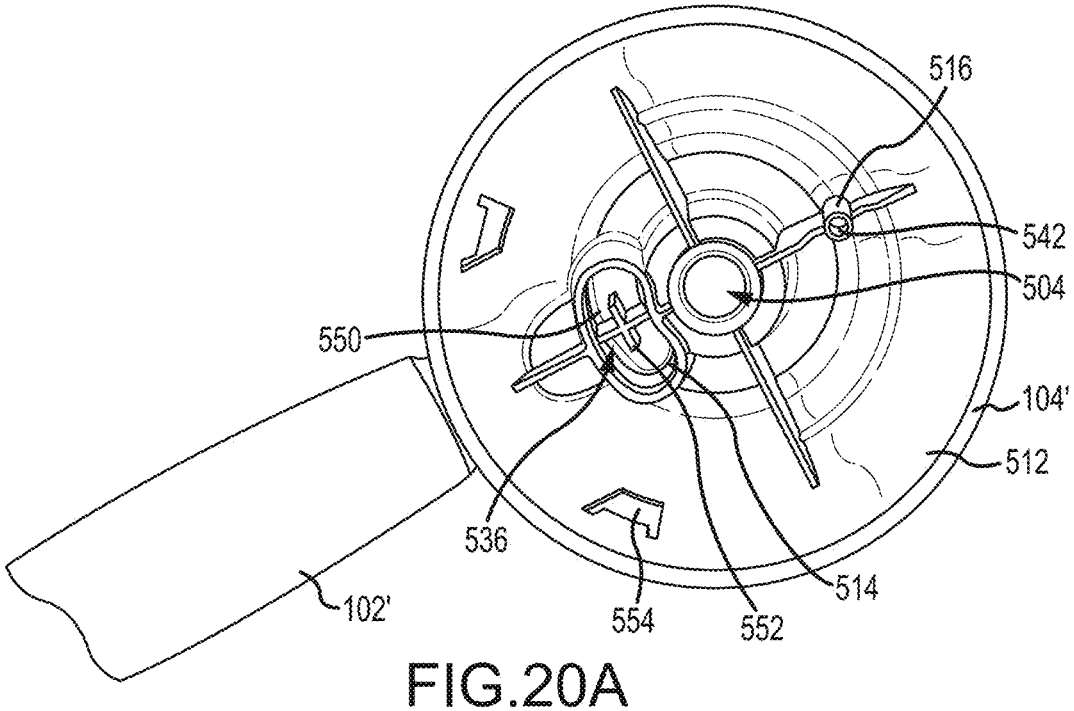
FIG. 20A is a front isometric view of a spray chamber housing of the showerhead of FIG. 17A.
Figure 20B:
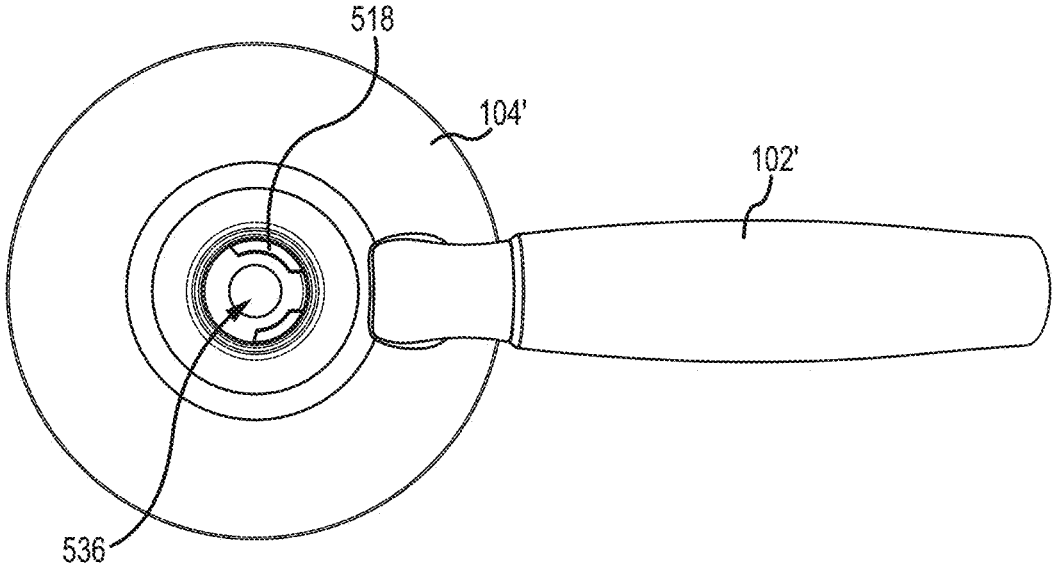
FIG. 20B is a rear plan view of the housing of the showerhead of FIG. 17A.

FIG. 20A is a front isometric view of the spray head 104' and handle 102' of the showerhead 500. FIG. 20B is a rear elevation view of the spray head 104' and handle. With reference to FIGS. 19-20B, in some examples, the showerhead 500 may include features defined on an interior surface 512 of the spray head 104' that are similar to elements of the mounting plate 144. This configuration may allow the mounting plate 144 to be omitted and/or differently configured. For example, with reference to FIG. 20A the spray head 104' may include a seal cavity 550 defined by a sealing wall 514 extending downward from the interior surface 512 of the spray head 104'. The sealing cavity 550 is configured to receive a mode seal 528 and may include a spring column 552 positioned in a center thereof, the spring column 552 being configured to receive one or more biasing members and extending downward from the interior surface 512.

The spray head 104' may include a spray head inlet 536 in fluid communication with the inlet 108' to the handle 102'. The spray head inlet 536 fluidly connects the sealing cavity 550 to the inlet 108' of the handle 102'. In this example, the spray head chamber may be defined by the sealing cavity 550 rather than the entire interior of the spray head 104'. In other words, the fluid may be channeled directly from the handle 104' into the sealing cavity 550.

Additionally, the spray head 104' may include a detent wall 516 extending downward from the interior surface 512 on an opposite side of a center of the spray head 104' from the sealing cavity 550. The detent wall 516 defines a detent cavity 542 configured to receive the plunger 142' and the spring 140' for the detent assembly.

As the spray head 104' itself may include features such as the seal cavity 550 and the detent cavity 542, which may be substantially similar to the seal cavity 350 and detent cavity 342 on the mounting plate 144 in FIG. 9B, the mounting plate 144 may be omitted. This allows the engine 526, and in particular the back plate 546, to be directly connected to the spray head 104' rather than through an intermediate component. By omitting the mounting plate 144, the showerhead 500 may be cheaper to manufacture and faster to assemble than the showerhead 100 of FIG. 1A.

With reference to FIG. 20A, in this example, the showerhead 500 may also include two or more positioning tabs 554 extending inward from the interior surface 512 toward a center of the spray head 104'. The positioning tabs 554 may be connected to the engine 526 to help ensure that the engine 526 remains in the correct position within the spray head 104'.

With reference to FIG. 20B, the spray head 104' may include a cap cavity 536 defined on a back surface of the spray head 104'. The cap cavity 536 may be configured to receive one or more components of the engine release assembly 506. Additionally, the cap cavity 536 provides access to the top surface of the back plate 546, which as discussed in more detail below, may be used to quickly connect and disconnect the engine 526. In some embodiments, the cap cavity 536 may include one or more keyed features 518. For example, the keyed feature 518 may be a protrusion such as a curved sidewall that extends into the cap cavity 536 from a sidewall surrounding and defining the cap cavity 536. In one embodiment, the spray head 104' may include two keying walls 518 on opposite sides of the cap cavity 536 from one another. The spacing between the two keyed features 518 may be configured based on a desired degree of rotation available to the engine 526 during installation and as such may be modified based on a desired engine rotation within the spray head.

Figure 21A:
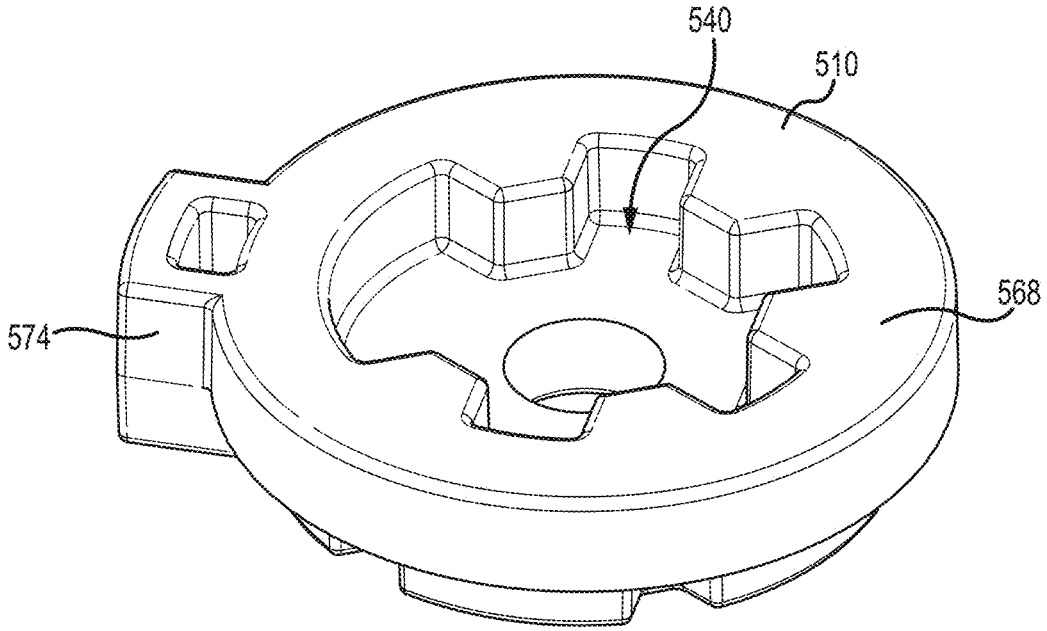
FIG. 21A is a bottom isometric view of a keyed washer of the showerhead of FIG. 17A.
Figure 21B:
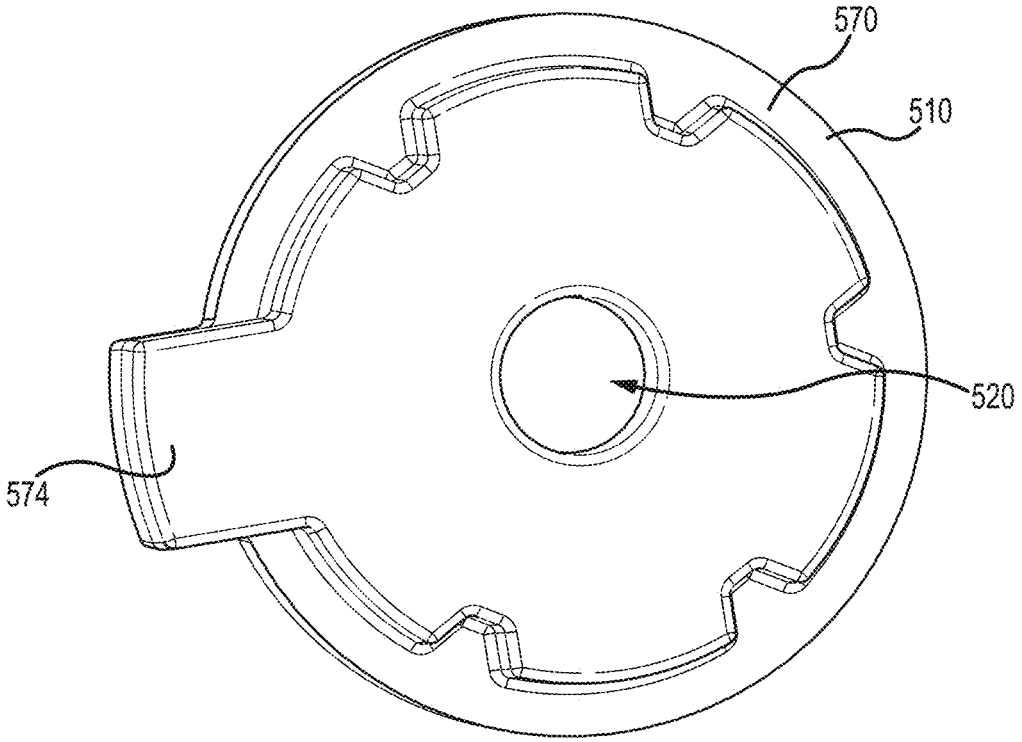
FIG. 21B is a top isometric view of the keyed washer of FIG. 21A.

The engine release assembly 506 of the showerhead 500 may include a cap 504, a fastener 508, and a keyed washer 510. FIGS. 21A and 21B illustrate bottom and top views, respectively, of the keyed washer 510. With reference to FIGS. 18, 21A, and 21B, the keyed washer 510 selectively connects to the back plate 546 of the engine 526. The keyed washer 510 may include a keyed cavity 540 recessed from a bottom surface 568 and the keyed cavity 540 may form a protrusion extending outward from the top surface 570 of the keyed washer 510 (see FIG. 21B). The keyed cavity 540 may have a varying shape including a plurality of keyed protrusions, angled sidewalls, or other keying elements configured to correspond to a keyed protrusion on the back plate 546, as will be discussed in more detail below. For example, in the embodiment shown in FIG. 21A, the keyed cavity 540 may have a five prong shape with the prongs jutting out from a center of the keyed washer 510 and with one of the prongs having a larger width and a curved surface that is differently configured from the other prongs. The center of the keyed washer 510 includes a fastening aperture 520 defined therethrough. It should be noted that the shape and configuration of the keying features of the keying washer 510 shown in FIGS. 21A and 21B are meant as illustrative only and many other keying features are envisioned.

The keyed washer 510 may also include an alignment tab 574 extending outward from a sidewall of the washer 510. The alignment tab 574 may be positioned adjacent the differently configured prong of the keyed cavity 540. The alignment tab 574 may form another keying feature for the keyed washer 510 that may interface with different components than the components that interface with the keyed cavity 540.

Figure 22A:
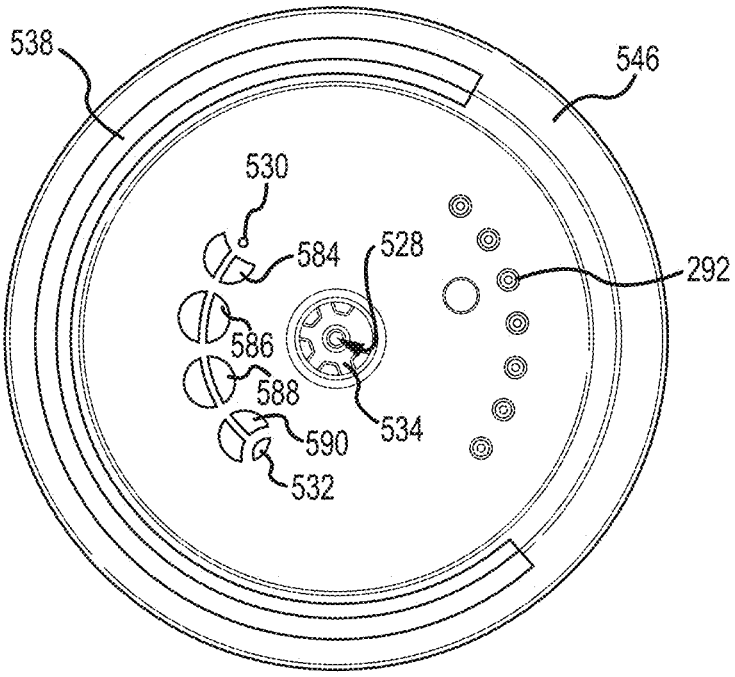
FIG. 22A is a top plan view of a back plate of the showerhead of FIG. 17A.
Figure 22B:
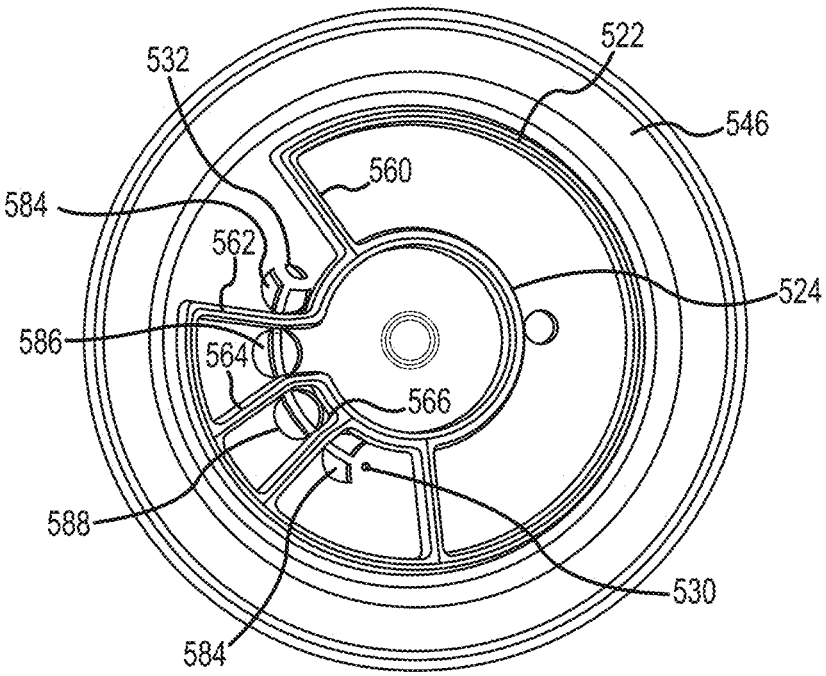
FIG. 22B is a bottom plan view the back plate of FIG. 22A.

The engine 526 of the showerhead 500 will now be discussed in more detail. FIGS. 22A and 22B illustrate top and bottom plan views, respectively, of the back plate of the engine 526. With reference to FIGS. 18, 19, 22A, and 22B, the engine 526 may be substantially similar to the engine 126 but may include a modified back plate 546. In particular, the back plate 546 may include a keyed protrusion 534 extending from a top surface thereof. In this example, the keyed protrusion 534 may be configured to substantially match the keying cavity 540 of the keying washer 510. For example, as shown in FIG. 22A, the keyed protrusion 534 may include a plurality of raised prongs extending outward from a central region with one of the prongs being differently configured than the other four prongs. As with the keying washer 510, it should be understood that the actual configuration of the keying elements of the keyed protrusion 534 are meant as illustrative only and other keying configurations may be used. The back plate 546 may also include a ledge 538 extending partially around the outer perimeter sidewall.

The back plate 546 may also include a plurality of mode apertures 584, 586, 588, 590 defined through a top surface. The mode apertures 584, 586, 588, 590 may be substantially the same as the mode apertures 284, 286, 288, 290 of the back plate 146. However, in this example, the mode apertures 584, 586, 588, 590 may be differently shaped. For example, in the back plate 546, the mode apertures 584, 586, 588, 590 may include generally circular apertures including a support rib extending laterally across each aperture. Additionally, the first mode aperture 584 and the second mode aperture 590 may be slightly smaller than the other remaining apertures or otherwise may be differently configured from the remaining apertures 586, 588.

The first mode aperture 584 and the fourth mode aperture 590 may be modified to accommodate two additional mode apertures as compared to the back plate 146. In this example, the showerhead 500 may include a trickle or pause aperture 530 and a low flow aperture 532. The trickle aperture 530 may be an aperture defined through the top surface of the back plate 526 that has a substantially reduced diameter as compared to the mode apertures 584, 586, 588, 590. The smaller diameter of the trickle aperture 530 (as compared to the other apertures) limits the water flow therethrough and may be used to substantially reduce the water flow output by the showerhead 500. For example, when the showerhead 500 is in the trickle mode such that the mode select aperture 410 of the mode seal 528 is aligned with the trickle aperture 530, the constricted diameter of the aperture 530 limits the water flow into the engine 526 and thus the water flow that flows out of the nozzles. In one embodiment, the trickle aperture 530 may share the outlet nozzles with the first mode aperture 584. However, in other embodiments the trickle aperture 530 may have a separate set of nozzles or a specific nozzle that functions as a weep hole to allow the reduced amount of fluid to flow out when the showerhead 500 is in the trickle mode. The trickle aperture 530 and low flow aperture 532 will be discussed in more detail below.

With reference to FIG. 22B, the back plate 546 may also include a plurality of ring walls 522, 524 and separating walls 560, 562, 564, 566. The ring walls 522, 524 and the separating walls 560, 562, 564, 566 extend downward from an interior or bottom surface of the back plate 546 and are used to fluidly separate flow from each of the mode apertures 584, 586, 588, 590 from one another and define the flow channels when connected to the face plate 148' as discussed above. The ring walls 522, 524 and separating walls 560, 562, 564, 566 may be modified based on a desired flow path through the engine 526 but provide the same functionality as the respective walls in the back plate 146 of the showerhead 100.

As mentioned above, the back plate 546 includes two specialty mode apertures as compared to the back plate 146. In one example, the back plate 546 includes the trickle aperture 530 and the low flow aperture 532. These two apertures may be in fluid communication with the same flow paths as the first mode aperture 584 and the fourth mode aperture 590, respectively, and as such may be in fluid communication with the outlet nozzles of those modes. However, in other embodiments, the trickle aperture 530 and the low flow aperture 532 may have separate outlets or nozzles.

Additionally, the trickle aperture 530 and the low flow aperture 532 may be used in combination with the first mode aperture 584 and the fourth mode aperture 590, respectively. In other words, the mode seal 528 may be positioned so that both the main mode aperture 584, 590 and one of the specialty mode apertures 530, 532 are in fluid communication with the sealing cavity 536 simultaneously. In this example, the mode seal 528 may be configured to allow the mode and specialty apertures to both be fully open simultaneously or may be configured to allow only a portion of each to be opened simultaneously.

The diameter of the trickle aperture 530 may be selected in consideration of the anticipated water pressure from a fluid source, as well as the structural strength of the engine 526 and spray head 104'. In particular, the stronger the fluid pressure and the weaker the showerhead components the larger the trickle aperture 530 may be. In some embodiments, the trickle mode may correspond to a seal rather than the trickle aperture 530. For example, depending on the strength of the showerhead components and/or the anticipated water pressure, the showerhead 500 may include a pause mode where the mode select aperture 410 of the mode seal 528 is aligned with another seal or the top surface of the back plate 546. In this example, the back plate 546 seals the mode select aperture substantially preventing water from flowing into the engine 526.

Using the trickle aperture 530 or in examples where the showerhead 500 includes a pause mode, the user can substantially reduce or eliminate the water flow out of the showerhead, without having to adjust the water source. For example, the user can change the mode of the showerhead 500 to the trickle mode when he or she is lathering shampoo in his or her hair or doing another activity that does not require water use. Because the water source does not have to be adjusted in order to pause/reduce the flow, the user can quickly reactivate the normal flow through the showerhead 500 and maintain his or her previous temperature settings. This allows a user to have more control of the water flow through the showerhead and save water during bathing without having to adjust the temperature and/or other characteristics of the water supply.

With reference to FIGS. 22A and 22B, the low flow aperture 532 may be positioned adjacent the fourth mode aperture 590. The low flow aperture 532 may be larger than the trickle aperture 530, but may be smaller than the mode apertures 584, 586, 588, 590. The low flow aperture 532 is similar to the trickle aperture 530 in that it acts to reduce the flow output by the showerhead 500, but with an increased water flow rate as compared to the trickle aperture 530. The low flow aperture 532 may be used in instances where a water supply and/or water usage is monitored or constrained (e.g., septic tank systems), in instances where low flow is desired (e.g., users or locations where an "eco" mode using less water is desired), and/or in instances where the amount of water to be used is desired to be reduced as compared to conventional showerheads but where a user may wish to still shower.

In one example, the trickle mode aperture 530 may correspond to a flow of 0.2-0.5 gallons per minute, the low flow mode aperture may correspond to a flow of 1.0-1.4 gallons per minute, and the regular mode apertures may correspond to a flow between 1.5-2.5 gallons per minute.

With reference to FIGS. 18 and 19, in some instances, the mode seal 528 may be slightly modified from the mode seal 128. For example, in the showerhead 500 the mode select aperture 410 may be a single opening without any support ribs extending across width. Additionally, in this example, the mode seal 528 may be generally oval or bean shaped as compared to the somewhat trapezoidal shape of the mode seal 128. Further, in this example, the mode selection assembly may include a single biasing spring 534 and this spring 534 may be received around the spring column 552 of the spray head 104', rather than the spring columns of the mounting plate 144 as in the showerhead 100.

As briefly mentioned above, the engine 526 of the showerhead 500 may be selectively connected and released from the spray head 104'. The assembly and disassembly of the showerhead 500 will be discussed in more detail. With reference to FIGS. 17A-21B, the engine 526 may be assembled in substantially the same manner as described above with respect to FIG. 1A. However, in instances where the engine 526 may not include an inner plate 158 (such as shown in FIG. 19), the back plate 526 may be connected directly to the face plate 148' without an intermediate plate. In this example, the massage assembly 152' may be enclosed within the face plate 148' and back plate 546. Once the plates 148', 546 of the engine 526 are aligned and connected together as described above, the engine 526 is connected to the spray head 104'.

In particular, the engine 526 may be axially aligned with the handle 102' and inserted into the spray head 104'. In some embodiments the engine 526 may be inserted 180 degrees out of phase from its operational position so that the ledge 538 on the back plate 546 engages with the positioning tabs 554 of the spray head 104'. Once the ledge 538 engages the positioning tabs 554, the engine 526 is rotated 180 degrees or until it is in a desired location. When the engine 526 is properly located within the spray head 104', the keyed washer 510 is connected to the back plate 546. The keyed cavity 540 of the washer 510 is aligned with the keyed protrusion 534 on the back plate 546 and connected thereto. The fastener 508 is then received through the fastening aperture 520 in the keying washer 510 and into the fastening cavity 528 defined on the center of the keyed protrusion 534. The fastener 508 secures the engine 526 to the keyed washer 510.

Once connected, the alignment tab 574 on the washer 510 is positioned between the two keying walls 518 of the cap cavity 536. The keying walls 518 and alignment tab 574 help to prevent the engine 526 from rotating 180 degrees when attached to the spray head 104', i.e., helps to secure the engine in a desired location. Additionally, the alignment tab 574 and the keying walls 518 define the degrees of rotation available to the engine 526 to allow a user to change the mode such as by turning the mode selector 118' to rotate the engine 526. This will be discussed in more detail below.

Once the keying washer 510 and engine 526 are located as desired, the cap 504 is received into the cap cavity 536. The cap 504 provides an aesthetically pleasing appearance to cover the cap cavity and helps to seal the cavity from fluid and debris. In some embodiments, the cap 504 may be press fit, threaded, or otherwise fastened to the spray head 104'. After the engine 526 is connected to the spray head 104', the cover 150' is connected to the engine 526 in the same manner as described above with respect to the showerhead 100.

To disconnect the engine 526 from the spray head 104', the cap 504 and fastener 508 are removed and once the cover 150' is removed, the engine 526 can be removed. This allows the showerhead 500 to be assembled, tested, and if the engine 526 does not function properly the engine 526 can be removed and replaced without damaging the spray head 104' or the handle 102' As the spray head 104' and/or handle 102' are often the more expensive components of the showerhead 500 due to the fact that often they include plating, chrome, or other aesthetic finishes, by being able to replace defective components within the showerhead 500 without damaging the finished components, the manufacturing process for the showerhead may be cheaper. In other words, rather than throwing out defective showerheads that include expensive components, the showerhead of the present disclosure can be fixed by replacing the defective component, without damaging the finished components. This also may allow the showerhead to be repaired after manufacturing (e.g., after a user has purchased the showerhead) more easily.

During operation, the showerhead 500 may operate in substantially the same manner as the showerhead 100 of FIG. 1A, with slight changes based on structural differences in some of the components. For example, with reference to FIG. 19, water flows through the handle 102' and enters the spray head 104' through the spray head inlet 536. Water then flows directly into the seal cavity 550 from the spray head inlet 536 and enters the engine 526 through one or more mode apertures 530, 532, 584, 586, 588, 589. The path of the water through the engine 526 depends on the selected mode(s), after traveling through one or more paths, the water exits through one or more nozzle groups.

To change modes, the user rotates the mode selector 118', which due to its engagement to the engine 526 causes the engine 526 to rotate relative to the mode seal 528. The rotation of the engine 526 is limited by the keying walls 518 in the cap cavity 536. In particular, as the user rotates the mode selector 118' the keyed washer 510, which is secured to the engine 526 via the fastener 508, rotates therewith. As the keyed washer 510 rotates within the cap cavity 536, the alignment tab 574 rotates and when it engages against one of the keying walls 518, acts to prevent further rotation in that direction. In this manner, the alignment tab 574 and the keying walls 518 act as a hard stop to limit the rotation of the engine 526. This configuration helps to prevent the engine 526 from over-rotating within the spray head and possibly being damaged.

In some embodiments the trickle mode aperture 530 and/or the low flow aperture 532 may be aligned with the mode aperture 410 when the engine 526 is in a choked or over-clocked position. For example, the trickle mode aperture 530 and the low flow aperture 532 may be located at a position on the back plate 546 that does not correspond to the detent recesses 292' or is otherwise at the extreme ends of the rotational spectrum of the engine 526. In this manner, the user may have to rotate the engine 526 further (via the mode selector 118') than with the other modes. Additionally, in some embodiments, the trickle mode aperture and/or the low flow aperture may be fluidly connected to the fluid inlet when the "normal" mode aperture is connected to the fluid inlet. For example, during the normal mode corresponding to the particular mode aperture adjacent the alternate mode aperture (i.e., trickle mode aperture, low flow aperture), fluid may flow both through the normal mode aperture and the alternate mode aperture. However, in other embodiments, the alternate mode aperture may be sealed during the normal mode.

Fixed Mount Example

Figure 23:
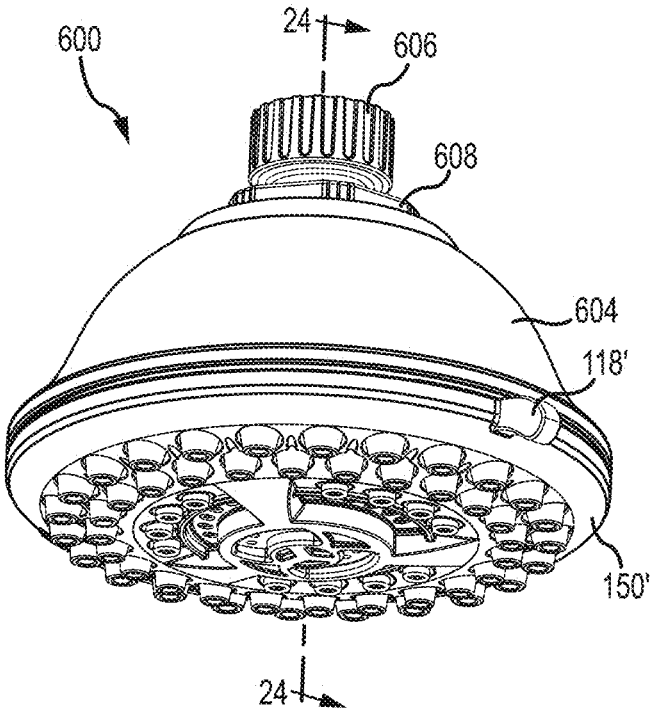
FIG. 23 is an isometric view of a third example of a showerhead including a massage mode assembly.
Figure 24:
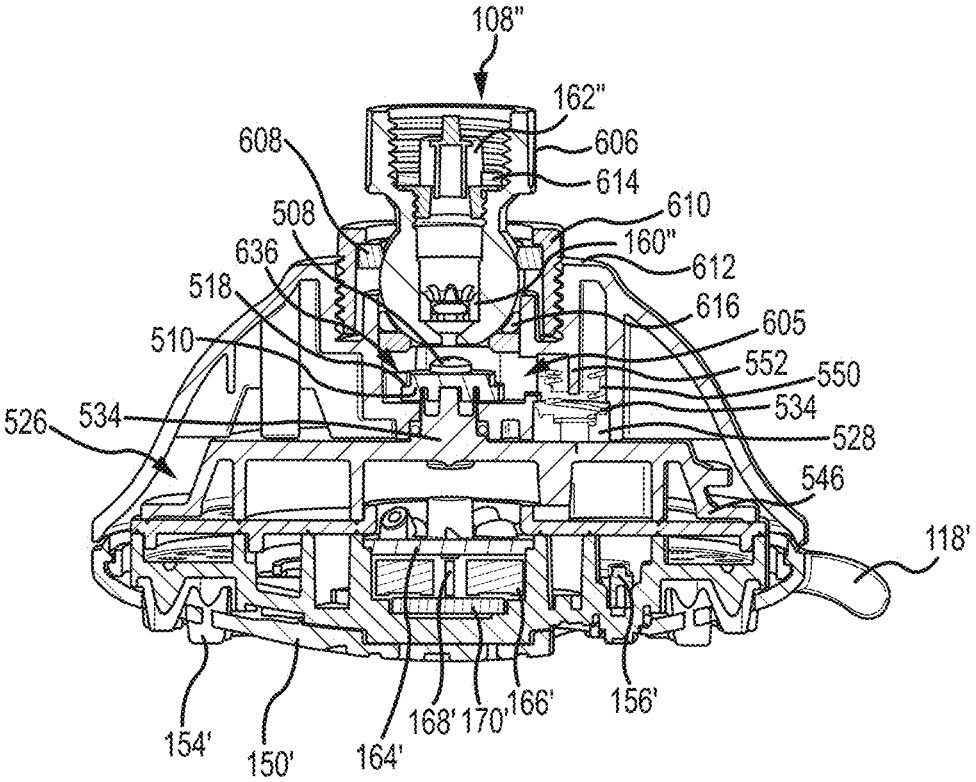
FIG. 24 is a cross-section view of the showerhead of FIG. 23 taken along line 24-24 in FIG. 23.

As discussed above, in some embodiments the showerhead 600 may be a fixed or wall mount showerhead. In these examples, the showerhead 600 may not include a handle and may be configured to be fixedly secured to a wall or other structural element. FIG. 23 is an isometric view of an example of a fixed mount showerhead 600. FIG. 24 is a cross-section view of the fixed mount showerhead 600 of FIG. 23 taken along line 24-24 in FIG. 23. With reference to FIGS. 23 and 24, the fixed mount showerhead 600 may be substantially similar to the showerhead 500 as shown in FIG. 17A. However, in this embodiment the showerhead 600 may be configured to attach to a structural feature such as a wall or other fixed location. As such, the handle 104' may be omitted and the spray head 604 may include an attachment assembly for connecting to a fluid source.

In one example, the attachment assembly may include a pivot ball connector 606. The pivot ball 606 may be similar to the pivot ball connector shown in U.S. Pat. No. 8,371,618 entitled "Hidden Pivot Attachment for Showers and Method of Making the Same," which is hereby incorporated by reference herein in its entirety. The pivot ball 606 is configured to attach to a J-pipe or other fluid source and may include a threaded portion, similar to the threaded portion on the handle 104'. Additionally, the showerhead 600 may include a collar 610, split ring 608, and one or more seals 616 that interface or connect to the pivot ball connector 606. For example, the collar 610 may be threadingly attached to the spray head 604 and the pivot ball connector 606 may be pivotably received therein. This allows the spray head 604 to be pivoted or rotated about a fixed location so that a user can reposition the showerhead 600 as desired. The split ring 608 and seal 616 assist in securing the pivot connector 606 to the collar 610 and providing a leak-tight connection.

With continued reference to FIGS. 23 and 24, the spray head 604 of the showerhead 600 includes an inlet aperture 636 defined through a back surface 612 thereof. The inlet aperture 636 may be somewhat similar to the cap cavity 536 as it may receive the engine connection assembly components such as the keyed washer 510 and fastener 508. Additionally, the inlet aperture 636 functions to provide water from the showerheads 600 inlet 108" to the seal cavity 550. For example, the spray head 604 may include a fluid passage 605 between the inlet aperture 636 and the seal cavity 550. The fluid passage 605 fluidly connects the showerhead inlet 108" to the seal cavity 550. The fluid passage 605 may be defined by one or more walls extending from an interior surface of the spray head 604 and/or apertures defined within those walls.

In operation, water flows from a fluid source into the showerhead inlet 108" and through the pivot ball connector 610. As the water exists the pivot ball connector 606, the water flows into the spray head inlet aperture 636 and then to the seal cavity 550 via the fluid passage 605. Once the water reaches the seal cavity 550 it is transmitted to the engine 526 through one or more of the mode apertures as discussed in more detail above.

Massage Mode Assembly Examples

The massage mode assembly 152 may be modified to include different features, components, and/or configurations. FIGS. 25-34 illustrate various examples of alternate massage mode assemblies. In each of the examples described below, the shutter may be activated by the turbine and move in an oscillating or sliding manner to selectively cover and uncover banks of nozzles. As with the massage mode assembly 152 in the above examples, the shutter is configured to cover or uncover all the outlets in a particular nozzle bank at substantially the same time. The below examples have been removed from the showerhead to more clearly illustrate the features of the massage mode assembly configurations. In particular, in the below examples the massage chamber is depicted as a standalone chamber rather than a chamber formed by the combination of one or more plates of the engine. These depictions are not meant as limiting and any of the below examples may be used with the showerheads 100, 500, 600 and in particular with the massage chamber 220 shown above. It should be noted that features identified used similar numbers to features described above may the same as or similar to the features in the above examples.

FIRST EXAMPLE

Figure 25:
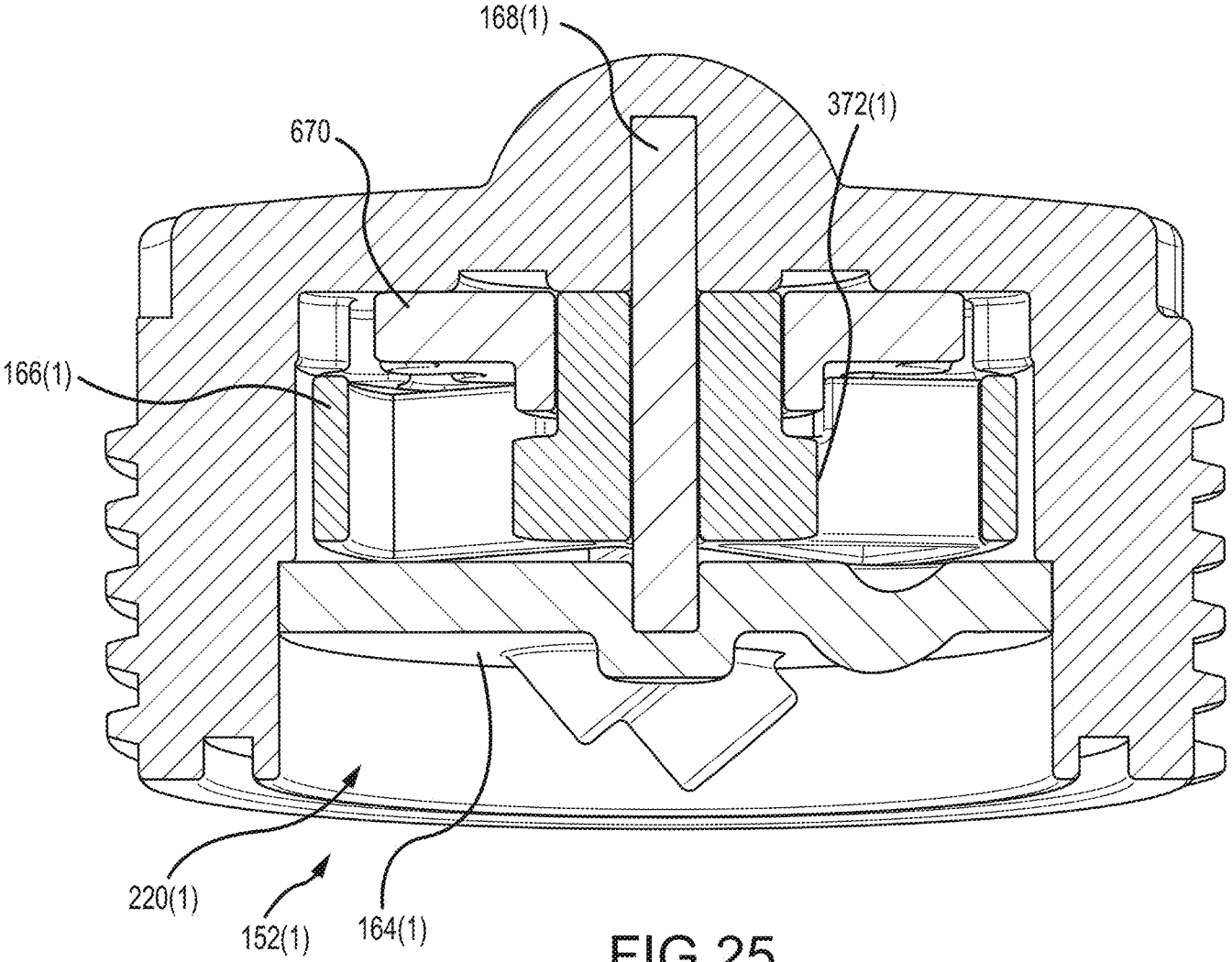
FIG. 25 is a cross-section view of a first example of a massage mode assembly.
Figure 26A:
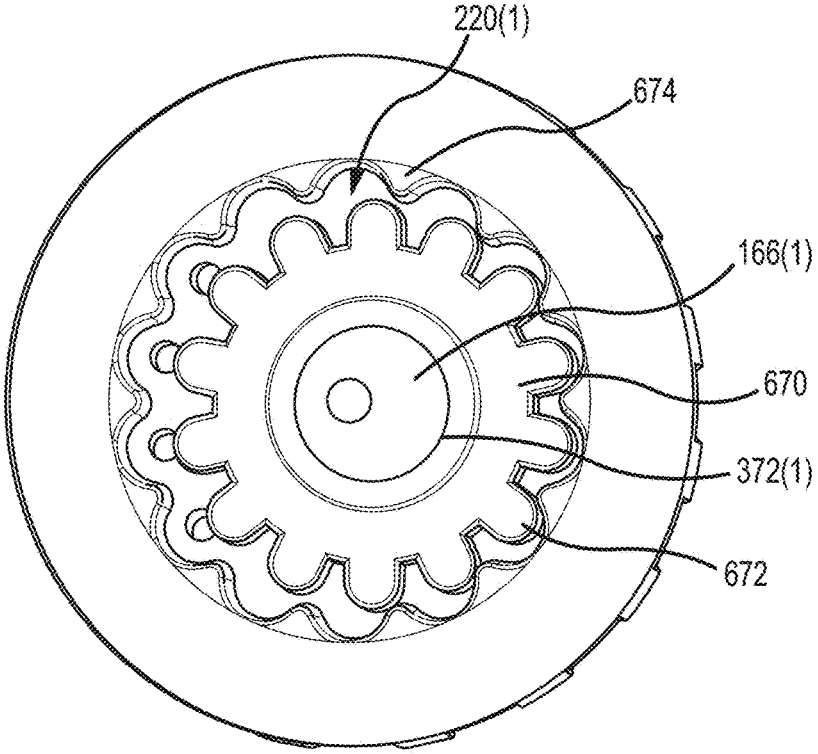
FIG. 26A is a cross-section view of the massage mode assembly of FIG. 25 with the shutter in a first position.
Figure 26B:
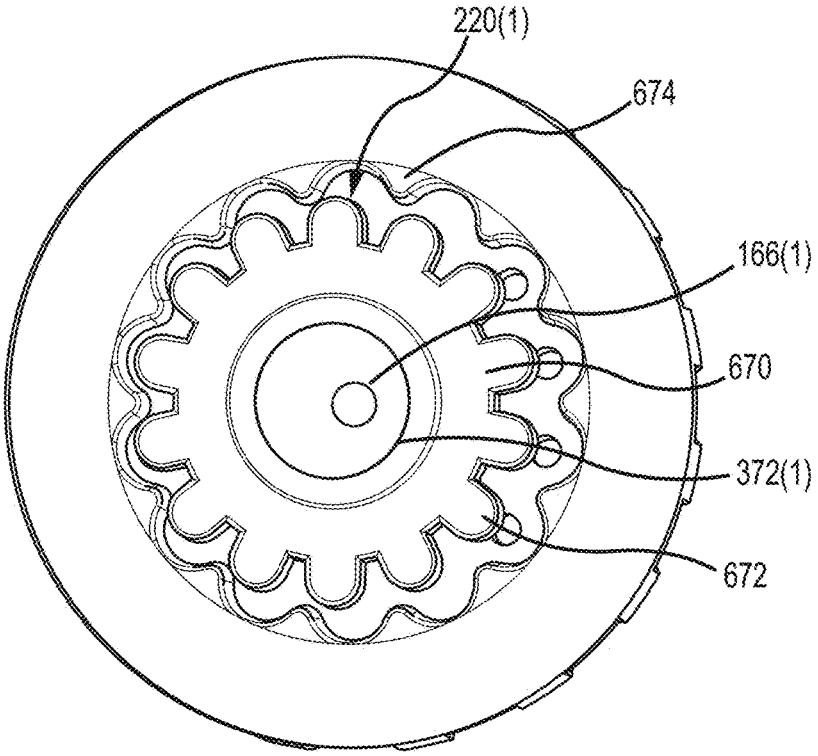
FIG. 26B is a cross-section view of the massage mode assembly of FIG. 25 with the shutter in a second position.

FIG. 25 is a cross-section view of a first example of the massage mode assembly 152(1). FIG. 26A is another cross-section view of the massage mode assembly 152(1) of FIG. 25 with the shutter 670 in a first position. FIG. 26B is a cross-section view of the massage mode assembly 152(1) as shown in FIG. 26B but with the shutter 670 in a second position. With reference to FIGS. 25-26B, in this example, the massage mode assembly 152(1) may be substantially the same as the massage mode assembly of FIG. 2. However, in this example, the shutter 670 may be a round disc having a plurality of lobes 672 or shutter teeth extending radially from the main body. The lobes 672 are positioned around the perimeter of the shutter 670. The diameter of the lobes 672 may be selected to substantially match or be larger than the outlets in the massage chamber 220(1) so that each lobe 672 can cover an outlet.

Additionally, in this example, the massage chamber 220 (1) may include a plurality of engagement teeth 674 or lobes on a bottom surface. The engagement teeth 674 may be similar to the curb walls in that they may influence the movement of the shutter 670 across the chamber 220(1).

As shown in FIGS. 26A and 26B, as the shutter 670 is moved by the turbine 166(1) turning the cam 372(1) upon water impact from the jet plate 164(1), the lobes 672 selectively cover and uncover the banks 120(1), 122(1) of nozzles. In this example, the shutter 670 may be restricted to a single translation degree by lobes 672 on the shutter 670 and in operation with the teeth 674 in the chamber 220(1). The engagement of the lobes 672 and the teeth 674 acts to restrict the shutter from rotating while allowing the sliding motion. In operation, the shutter may move across one set of nozzles while exposing the opposite set of nozzles in a repetitive motion.

SECOND EXAMPLE

Figure 27:
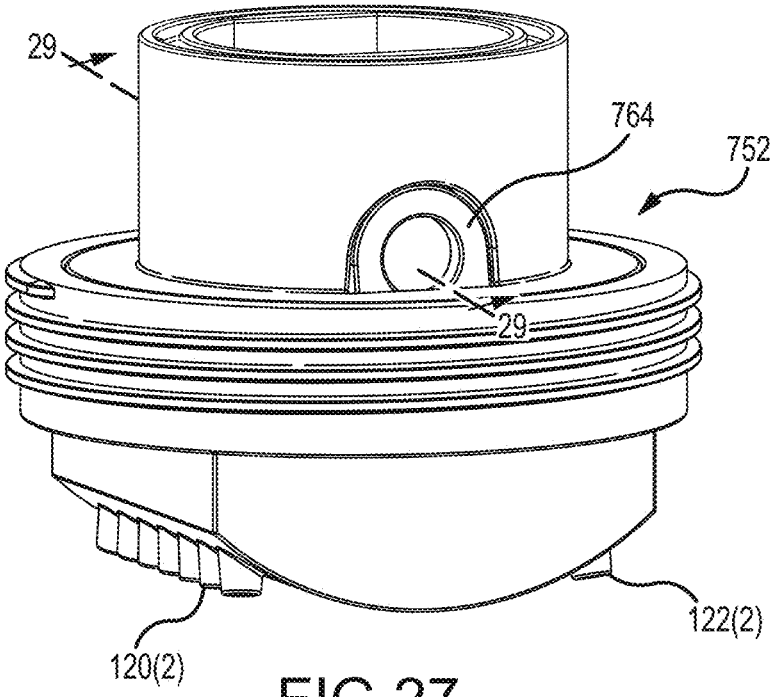
FIG. 27 is an isometric view of a second example of a massage mode assembly.
Figure 28:
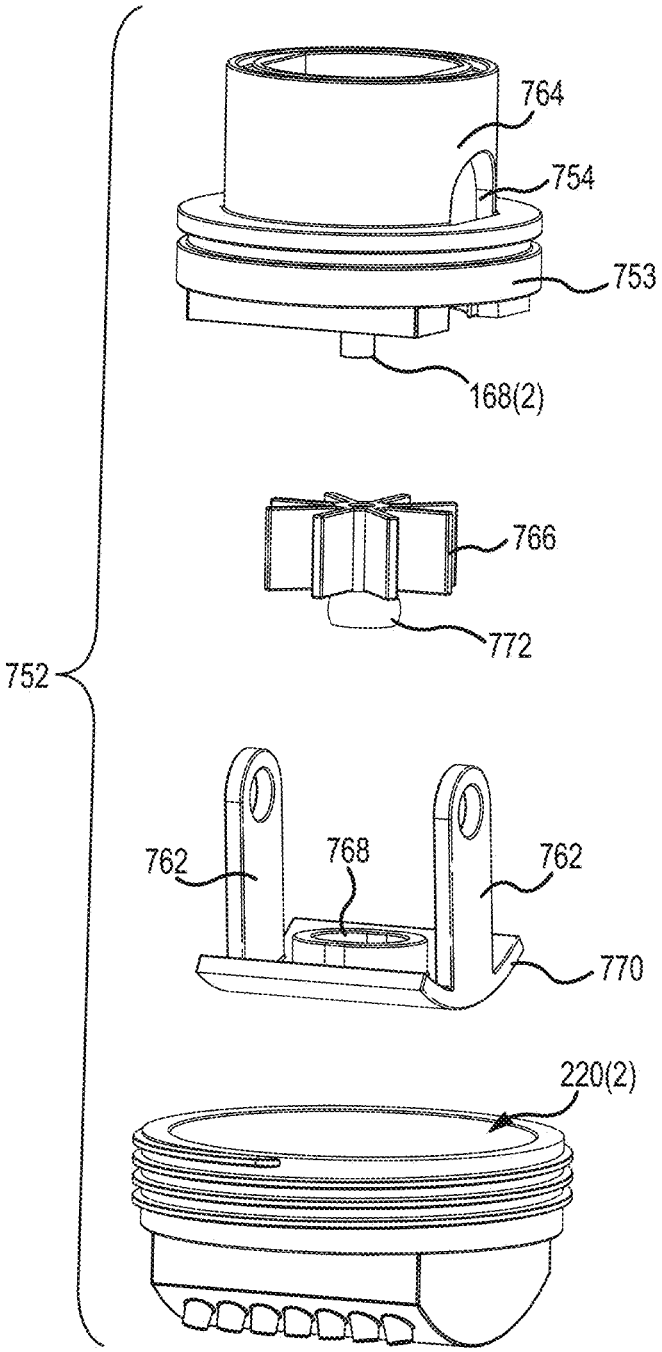
FIG. 28 is an exploded view of the massage mode assembly of FIG. 27.
Figure 29:
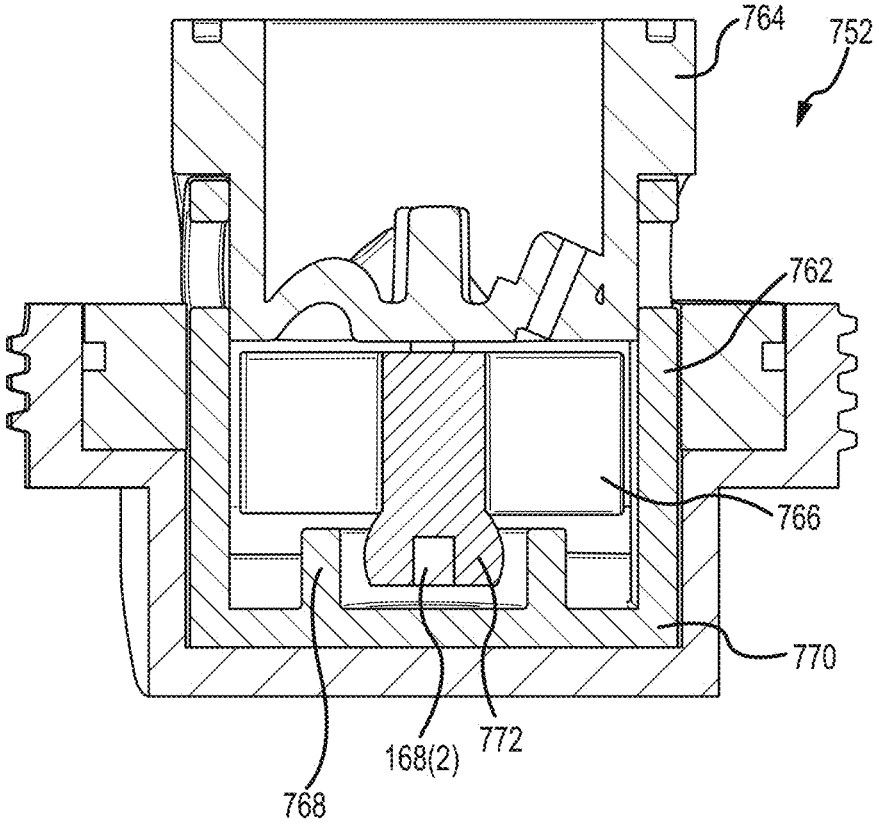
FIG. 29 is a cross-section view of the massage mode assembly of FIG. 28 taken along line 29-29 in FIG. 28.

FIGS. 27-29 illustrate another example of a massage mode assembly. With reference to FIGS. 27-29, in this example, the massage mode assembly 752 may include a jet plate 764 having a generally cylindrical shape with two apertures 754 defined in the sidewalls of the cylinder body. Additionally, an annular flange 753 extends around an outer surface of the cylindrical body. The turbine 766 in this example includes a plurality of blades and the outer turbine circular wall is omitted. Additionally, the cam 772 is formed as an eccentrically shaped hemispherical body.

The shutter 770 includes a trough shaped-bottom with a cam wall 768 defined on a top surface of the shutter 770 bottom. Additionally, two arms 762 extend upward from the trough on either side thereof. The arms 762 pivotably connect to the jet plate 764 to provide a back and forth swinging motion of the shutter 770. In other words, the range of the guide arms 762 and the shutter 770 is constrained by the interior walls of the chamber 229(2) and clearance limitations of the arms 762 in recesses of the jet plate 764 in the massage mode assembly 752.

THIRD EXAMPLE

Figure 30:
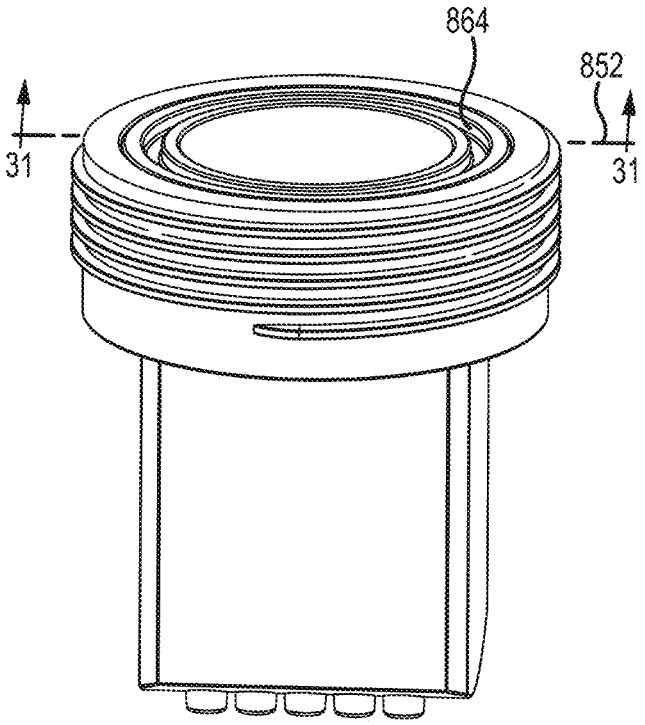
FIG. 30 is an isometric view of a third example of a massage mode assembly.
Figure 32:
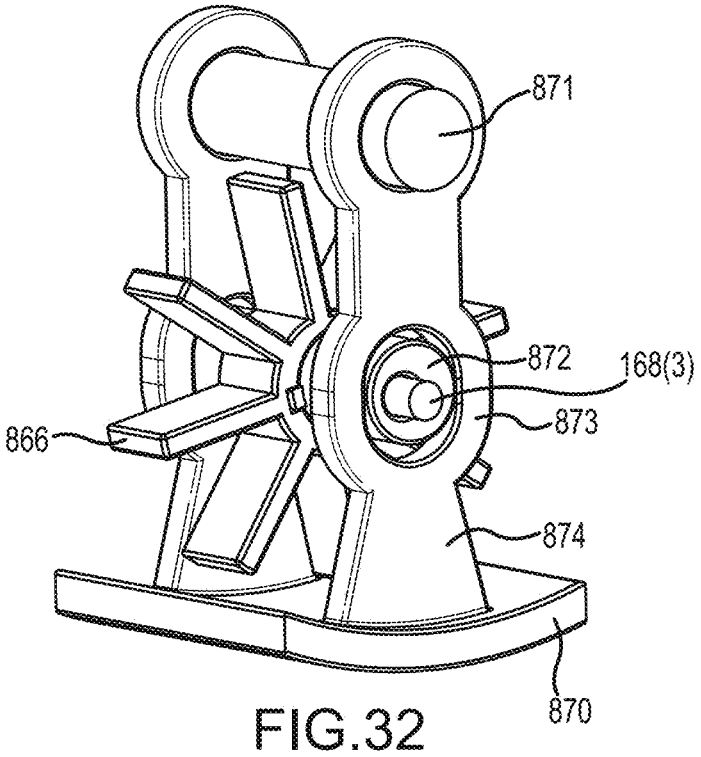
FIG. 32 is an isometric view of a fourth example of a massage mode assembly.

FIGS. 30-32 illustrate a third example of a massage mode assembly. With reference to FIGS. 30-32, the massage mode assembly 852 in this example may include an axially oriented turbine 866 positioned between two guide arms 874 of a shutter 870. In particular, the shutter 870 includes a concaved curved bottom member that functions to selectively cover and uncover the nozzle banks 120(3), 122(3). The two guide arms 874 extend on opposite sides from one another and are positioned on the longitudinal edges of the shutter body. Each of the guide arms 874 include two apertures. A first aperture is at a top end of the arms and is configured to receive a securing bar or pin 871. A second aperture 873 forms a cam follower and is configured to receive the cam 872 of the turbine.

As shown in FIG. 32, the turbine 866 is axially oriented and positioned between the two arms 874. In this example, the cam 872 extends from both sides of the turbine 866 with one end being received in the cam aperture 873 of the first guide arm 874 and the other end being received in the cam aperture 873 of the second guide arm 874. In this embodiment the turbine 866 may resemble a water wheel as the water flow causes the blades to move downward rather than in a carousel or lateral rotational movement. Additionally, the pin 168(3) is lodged in a recess or pocket in the downward extending walls of the jet plate to provide a fixed horizontal rotational axis rather than the vertical rotational axis as shown in the showerhead 100.

The jet plate 864 may also include two or more apertures (not shown) that are used to secure the shutter 870, in particular the guide arms 874 of the shutter 870, to the jet plate 864. For example, the upper pin 871 may extend laterally across a width of the jet plate 864 and be secured on either side of the jet plate 864 to secure the shutter 870 within the massage chamber 220(3) and provide a pivot point for the movement of the shutter 870.

With reference to FIGS. 31 and 32, as the turbine 866 rotates about the pin 168(3), the cam 872 causes the guide arms 874 to move laterally in a swing-type movement, which in turn causes the shutter 870 body to move in the lateral sweeping pattern within the massage chamber 220(3).

FOURTH EXAMPLE

Figure 33:
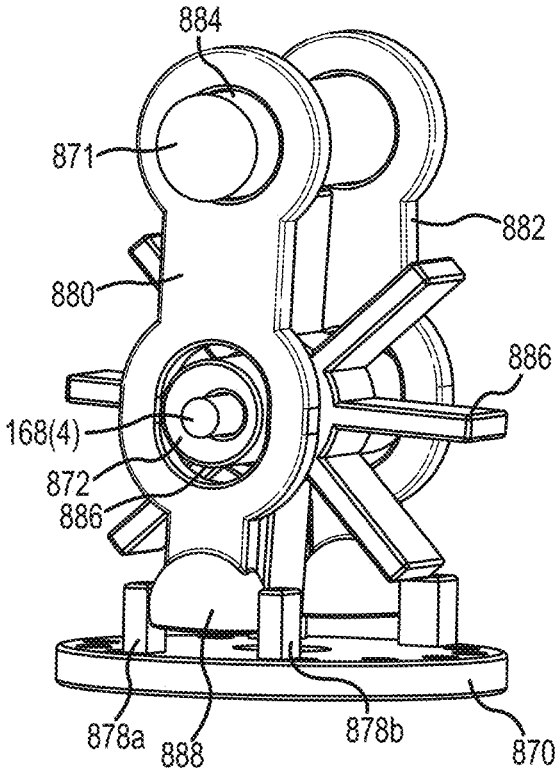
FIG. 33 is an isometric view of a fifth example of a massage mode assembly.

In a fourth example, the massage mode assembly may be similar to the third example above, but the guide arms may be separate from the shutter. FIG. 33 is an isometric view of the fourth example of the massage mode assembly. With reference to FIG. 33, in this example, the massage mode assembly may include a pair of guide arms 880, 882 that are connected to each other by a pin 871 and connected to a shutter disk 870 by connecting ends 888. Each guide arm 880, 882 may include a pin aperture 884 toward a top thereof and a cam aperture 886 toward a center thereof. The cam aperture 886 may have a generally oval shape and the sidewalls of the guide arms 880, 882 may bulge outward on both sides adjacent the cam aperture 886. The bulge provides additional strength and rigidity to the guide arms 880, 882 at the location of the cam aperture 886. The bottom end of each guide arm 880, 882 includes a hemispherical protrusion 888 with the straight face of the hemispherical shape oriented downward toward the top surface of the shutter 870.

With reference to FIG. 33, in this example the shutter 870 may be a substantially planar disc and may include two sets of securing prongs 878*a*, 878*b* that extend upward from a top surface of the shutter 870. Each hemispherical protrusion 888 of the guide arms 880, 882 is received between the respective set of securing prongs 878*a*, 878*b* of the shutter 870 to connect the shutter 870 to the guide arms 880, 882. The shutter may also include a plurality of apertures, where depending on the location of the shutter the shutter apertures selectively align with the nozzle outlets to allow fluid to exit the massage chamber.

In operation, the eccentric cams 872 of the turbine drive the disk shaped shutter 870 so that it that oscillates in a rotary fashion through the guide arms 880, 882. In this example, the cams 872 attached to the turbine 866 via the pin 168(4) are positioned with their eccentricity opposite each other such that the prescribed motion of each cam is opposite to the motion of the other, the opposite motion of the cams restricts the rotational movement of the shutter. In particular, the shutter spins back and forth selectively aligning the shutter apertures with the nozzle outlets. The back and forth rotation is limited to a few degrees in either rotation direction which quickly and selectively opens and closes the nozzle outlets on either side of the massage chamber. The alternating motion of the shutter blocks one set of nozzles while exposing the opposite set of nozzles in a repetitive motion fashion.

FIFTH EXAMPLE

Figure 34:
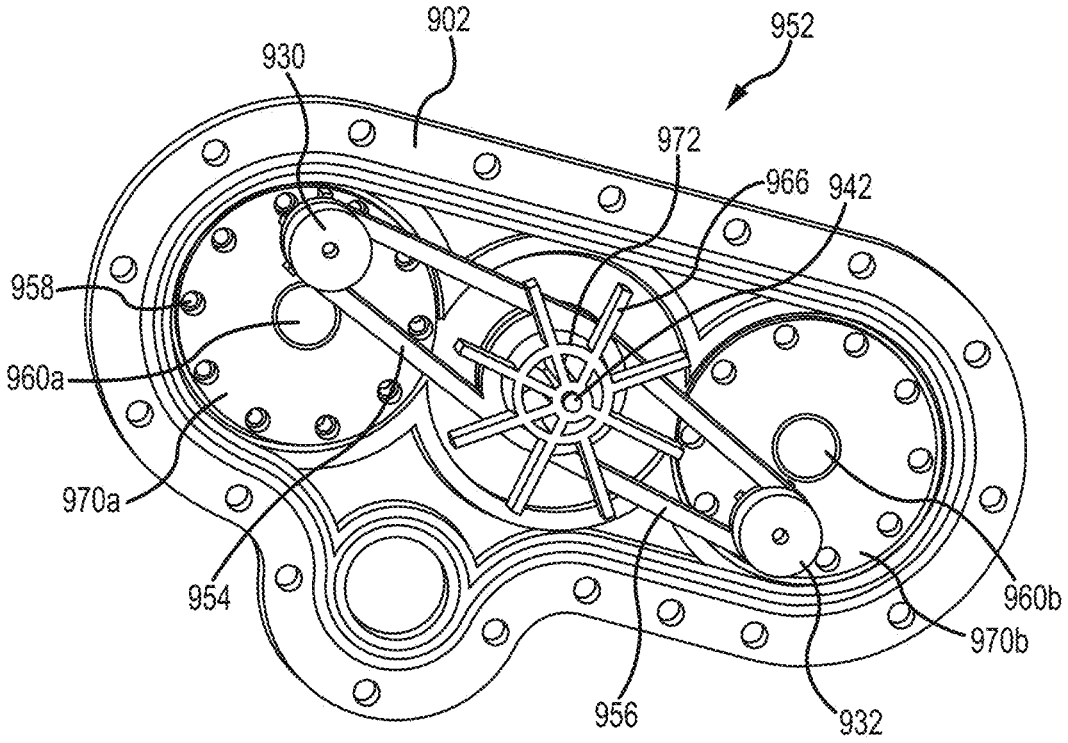
FIG. 34 is a top isometric view of a sixth example of a massage mode assembly.

FIG. 34 is a top perspective view of a fifth example of a massage mode assembly. With reference to FIG. 34, in this example, the massage mode assembly 952 may include a support bracket 902 including a plurality of nozzles therethrough and a turbine support pin 942 extending upward from a center area, two shutter pins 960*a*, 960*b* positioned on either side of the support pin 942. The support bracket 902 may form a portion of the face plate 148 for the showerhead or may replace one or more other plates within an engine of the showerhead.

The massage mode assembly 952 may also include two shutter disks 970*a*, 970*b* having a plurality of apertures 958 defined therethrough. Additionally, each of the shutters 970*a*, 970*b* may include a linkage pulley 930, 932 extending upward from a top surface.

The massage mode assembly 952 may include a turbine 966 having a plurality of blades extending outward form a central hub. The hub may form an eccentric cam 972 for the turbine 966. Additionally, the massage mode assembly 952 includes two linkage rods 954, 956. The rods 954, 956 may be substantially rigid and be configured to attach to both the turbine 966 and the pulleys 930, 932 on the shutters 970*a*, 970*b*.

With continued reference to FIG. 37, the two shutter disks 970*a*, 970*b* are received around the shutter pins 960, 960*b* on the bracket 920. The turbine 966 is received around the turbine support pin 942. A first rod 954 is connected to the first linkage pulley 930 on the first shutter 970*a* and then received around the cam 972 of the turbine 966. A second rod 956 is connected to the second linkage pulley 932 on the second shutter 970*b* and then also received around the cam 972 of the turbine 966. In operation, the turbine 966 is driven by water and the shutters 970*a*, 970*b* which are both connected to the single cam 972 are moved correspondingly. In particular, one shutter 970*a* moves across one set of nozzles, blocking the flow through that set of nozzles and the second shutter 970*b* moves to expose a second set of nozzles via alignment of the apertures 958 with the nozzles. As the turbine 966 rotates, the motion of the shutters 970*a*, 970*b* reverses, and the two motions alternately repeat in a continuing sequence to align and displace the apertures 958 on each of the shutters 970*a*, 970*b* with respective sets of nozzles.

CONCLUSION

A showerhead including the pulsating assemblies of examples 1-6 may provide a slower, more distinct pulse, as compared to conventional rotary turbine driven shutters. The flow through the nozzles may have an increased pressure as experienced by the user, as each group of nozzles may be "on" or "off", without a transition between groups. This may allow for the water flow to be directed through only the nozzles in the "open" group, increasing the flow through those nozzles. As an example, the user of a shutter that selectively opens and closes groups of nozzles simultaneously may produce a satisfying massage, even at low water flow rates. Thus, the examples described herein may be used provide a strong feeling "massage mode" for the showerhead, but at a reduced water flow rate, reducing water consumption. Additionally, by aiming the nozzles, or through the physical placement of nozzle groups on the showerhead spatially separated from each other, more distinct individual pulses may be detected by the user, which can result in a more therapeutic massage.

It should be noted that any of the features in the various examples and embodiments provided herein may be interchangeable and/or replaceable with any other example or embodiment. As such, the discussion of any component or element with respect to a particular example or embodiment is meant as illustrative only.

It should be noted that although the various examples discussed herein have been discussed with respect to showerheads, the devices and techniques may be applied in a variety of applications, such as, but not limited to, sink faucets, kitchen and bath accessories, lavages for debridement of wounds, pressure washers that rely on pulsation for cleaning, care washes, lawn sprinklers, and/or toys.

All directional references (e.g., upper, lower, upward, downward, left, right, leftward, rightward, top, bottom, above, below, vertical, horizontal, clockwise, and counterclockwise) are only used for identification purposes to aid the reader's understanding of the examples of the invention, and do not create limitations, particularly as to the position, orientation, or use of the invention unless specifically set forth in the claims. Joinder references (e.g., attached, coupled, connected, joined and the like) are to be construed broadly and may include intermediate members between the connection of elements and relative movement between elements. As such, joinder references do not necessarily infer that two elements are directly connected and in fixed relation to each other.

In some instances, components are described by reference to "ends" having a particular characteristic and/or being connected with another part. However, those skilled in the art will recognize that the present invention is not limited to components which terminate immediately beyond their point of connection with other parts. Thus the term "end" should be broadly interpreted, in a manner that includes areas adjacent rearward, forward of or otherwise near the terminus of a particular element, link, component, part, member or the like. In methodologies directly or indirectly set forth herein, various steps and operations are described in one possible order of operation but those skilled in the art will recognize the steps and operation may be rearranged, replaced or eliminated without necessarily departing from the spirit and scope of the present invention. It is intended that all matter contained in the above description or shown in the accompanying drawings shall be interpreted as illustrative only and not limiting. Changes in detail or structure may be made without departing from the spirit of the invention as defined in the appended claims.

What is claimed is:

1. A showerhead comprising:

a housing defining a chamber in fluid communication with a fluid source;

an engine received within the housing and fluidly connected to the chamber, wherein the engine includes a plurality of outlets in selective communication with the chamber; and an engine release assembly connected to the housing and the engine, wherein the engine release assembly selectively secures and releases the engine from the housing, wherein the housing comprises a cap cavity defined through a back wall of the housing, wherein the engine release assembly comprises:

a keyed washer connected to the engine and seated on a bottom wall of the cap cavity; and a fastener securing the keyed washer to the engine.

2. A showerhead comprising:

a housing defining a chamber in fluid communication with a fluid source;

an engine received within the housing and fluidly connected to the chamber, wherein the engine includes a plurality of outlets in selective communication with the chamber; and an engine release assembly connected to the housing and the engine, wherein the engine release assembly selectively secures and releases the engine from the housing, wherein the housing comprises a cap cavity defined through a back wall of the housing, wherein the engine release assembly comprises a fastener and a keyed washer, wherein to release the engine from the housing, the fastener is removed from the keyed washer and the engine.

3. The showerhead of claim 2, wherein the fastener is accessible through the cap cavity.

4. A showerhead comprising:

a housing defining a chamber in fluid communication with a fluid source;

an engine at least partially received within the housing and fluidly connected to the chamber;

an engine release assembly selectively securing the engine to the housing, the engine release assembly including a keyed washer connected to the engine by a fastener, wherein the keyed washer is at least partially seated against a portion of the housing, wherein the keyed washer is aligned with at least one corresponding keyed protrusion extending from the engine.

5. The showerhead of claim 4, wherein the keyed washer interacts with the housing to define a rotational range for the engine within the housing.

6. A showerhead comprising:

a housing defining a chamber in fluid communication with a fluid source;

an engine at least partially received within the housing and fluidly connected to the chamber;

an engine release assembly selectively securing the engine to the housing, the engine release assembly including a keyed washer connected to the engine by a fastener, wherein the keyed washer is at least partially seated against a portion of the housing, wherein the keyed washer interacts with the housing to define a rotational range for the engine within the housing, wherein rotation of the engine within the rotational range defined by the keyed washer changes a mode for the showerhead.

7. A showerhead comprising:

a housing defining a chamber in fluid communication with a fluid source;

an engine at least partially received within the housing and fluidly connected to the chamber;

an engine release assembly selectively securing the engine to the housing, the engine release assembly including a keyed washer connected to the engine by a fastener, wherein the keyed washer is at least partially seated against a portion of the housing, wherein the keyed washer interacts with the housing to define a rotational range for the engine within the housing, wherein the keyed washer includes a tab extending from a sidewall of the keyed washer, the tab seated within a seat formed in the housing.

8. The showerhead of claim 7, wherein the engine release assembly further comprises a cap covering the fastener.

9. A showerhead comprising:

a housing defining a chamber in fluid communication with a fluid source;

an engine at least partially received within the housing and fluidly connected to the chamber;

an engine release assembly selectively securing the engine to the housing, the engine release assembly including a keyed washer connected to the engine by a fastener, wherein the keyed washer is at least partially seated against a portion of the housing, wherein the engine release assembly further comprises a cap covering the fastener, wherein the cap is releasably fastened to a back wall of the housing.

10. The showerhead of claim 9, wherein the engine comprises:

a face plate defining a plurality of outlets; and a back plate connected to the face plate.

11. The showerhead of claim 10, wherein the connection between the face plate and the back plate defines at least two fluid channels in selective fluid communication with the fluid source and with respective subsets of the plurality of outlets.

12. An engine release assembly selectively securing a showerhead engine to a showerhead housing, the engine release assembly comprising:

a keyed washer connected to the showerhead engine, the keyed washer including a plurality of engagement features engaged with corresponding features of the showerhead engine to rotationally position the keyed washer relative to the showerhead engine; and a fastener arranged to secure the keyed washer to the showerhead engine, wherein the keyed washer is arranged such that a portion of the showerhead housing is positioned between the keyed washer and the showerhead engine to secure the showerhead engine to the showerhead housing.

13. An engine release assembly selectively securing a showerhead engine to a showerhead housing, the engine release assembly comprising:

a keyed washer connected to the showerhead engine, the keyed washer including a plurality of engagement features engaged with corresponding features of the showerhead engine to rotationally position the keyed washer relative to the showerhead engine; and a fastener arranged to secure the keyed washer to the showerhead engine, wherein the plurality of engagement features comprises a plurality of sidewalls defining a keyed cavity recessed within a bottom surface of the keyed washer.

14. The engine release assembly of claim 13, wherein the keyed cavity is arranged to receive one or more keyed protrusions extending from the showerhead engine.

15. The engine release assembly of claim 12, wherein the keyed washer includes one or more alignment features defining a rotational position of the keyed washer relative to the showerhead housing.

16. An engine release assembly selectively securing a showerhead engine to a showerhead housing, the engine release assembly comprising:

a keyed washer connected to the showerhead engine, the keyed washer including a plurality of engagement features engaged with corresponding features of the showerhead engine to rotationally position the keyed washer relative to the showerhead engine; and a fastener arranged to secure the keyed washer to the showerhead engine, wherein the keyed washer includes one or more alignment features defining a rotational position of the keyed washer relative to the showerhead housing, wherein the one or more alignment features comprises a tab extending from a sidewall of the keyed washer to seat within a key seat formed in the showerhead housing.

17. A showerhead comprising:

a housing defining a chamber in fluid communication with a fluid source;

an engine at least partially received within the housing and fluidly connected to the chamber;

an engine release assembly selectively securing the engine to the housing, the engine release assembly including a keyed washer connected to the engine by a fastener, wherein the keyed washer is at least partially seated against a portion of the housing, wherein the engine comprises:

a face plate defining a plurality of outlets; and a back plate connected to the face plate, wherein the keyed washer is mountably keyed to the back plate of the engine.

18. The showerhead of claim 1, wherein the keyed washer is mountably keyed to the engine.

19. The showerhead of claim 2, wherein the keyed washer is mountably keyed to the engine.

20. The showerhead of claim 2, wherein:

the keyed washer interacts with the housing to define a rotational range for the engine within the housing, and rotation of the engine within the rotational range defined by the keyed washer changes a mode for the showerhead.

* * * * *